US012331450B2

(12) United States Patent
Lee et al.

(10) Patent No.: US 12,331,450 B2
(45) Date of Patent: Jun. 17, 2025

(54) CLOTHES PROCESSING APPARATUS

(71) Applicant: LG Electronics Inc., Seoul (KR)

(72) Inventors: Hyuksoo Lee, Seoul (KR); Soowon Park, Seoul (KR); Kwangjo Lee, Seoul (KR); Manseok Lee, Seoul (KR); Woohee Kang, Seoul (KR); Seonghwan Kim, Seoul (KR); Ingeon Lee, Seoul (KR); Haeyoon Je, Seoul (KR)

(73) Assignee: LG Electronics Inc., Seoul (KR)

( * ) Notice: Subject to any disclaimer, the term of this patent is extended or adjusted under 35 U.S.C. 154(b) by 942 days.

(21) Appl. No.: 17/053,659

(22) PCT Filed: May 8, 2019

(86) PCT No.: PCT/KR2019/005476

§ 371 (c)(1),
(2) Date: Nov. 6, 2020

(87) PCT Pub. No.: WO2019/216631

PCT Pub. Date: Nov. 14, 2019

(65) Prior Publication Data

US 2021/0230788 A1 Jul. 29, 2021

(30) Foreign Application Priority Data

May 8, 2018 (KR) ..... 10-2018-0052699
May 8, 2018 (KR) ..... 10-2018-0052700
(Continued)

(51) Int. Cl.
*D06F 58/04* (2006.01)
*D06F 58/06* (2006.01)
(Continued)

(52) U.S. Cl.
CPC ..... *D06F 58/04* (2013.01); *D06F 58/06* (2013.01); *D06F 58/20* (2013.01); *D06F 58/206* (2013.01);
(Continued)

(58) Field of Classification Search
CPC ..... D06F 58/04; D06F 58/06; D06F 58/20; D06F 58/206; D06F 58/22; D06F 58/26; D06F 58/24; F25B 29/003
See application file for complete search history.

(56) References Cited

U.S. PATENT DOCUMENTS

2008/0141554 A1 6/2008 Bae et al.
2009/0071030 A1 3/2009 Myung et al.
(Continued)

FOREIGN PATENT DOCUMENTS

CN 101029449 A * 9/2007 ..... D06F 58/02
CN 104080966 10/2014
(Continued)

OTHER PUBLICATIONS

Translation, JP-2007301178-A (Year: 2007).*
(Continued)

*Primary Examiner* — Jessica Yuen
(74) *Attorney, Agent, or Firm* — Fish & Richardson P.C.

(57) ABSTRACT

A clothes processing apparatus includes a drum, a circulation flow path for circulating air from a frontal-side opening of the drum to a rear-side opening of the drum, and a base cabinet in a lower portion of the drum to provide a space for components. The base cabinet includes a base flow path part of the circulation flow path in which an evaporator, a condenser, and a circulation fan are disposed sequentially towards a rear of the base flow path part, a drum motor mounting part which is disposed at one side in front of the base flow path part, and in which a drum motor for gener-
(Continued)

ating a driving force for rotating the drum is mounted, and a compressor mounting part which is disposed at one side behind the base flow path part, and in which a compressor for generating compressed air for heat exchange is mounted.

21 Claims, 39 Drawing Sheets

(30) Foreign Application Priority Data

May 8, 2018 (KR) ..... 10-2018-0052708
May 8, 2018 (KR) ..... 10-2018-0052740

(51) Int. Cl.
*D06F 58/20* (2006.01)
*D06F 58/22* (2006.01)
*D06F 58/24* (2006.01)
*D06F 58/26* (2006.01)

(52) U.S. Cl.
CPC ..... *D06F 58/22* (2013.01); *D06F 58/26* (2013.01); *D06F 58/24* (2013.01)

(56) References Cited

U.S. PATENT DOCUMENTS

| | | | | |
|---|---|---|---|---|
| 2010/0107703 | A1 | 5/2010 | Hisano et al. | |
| 2012/0197441 | A1* | 8/2012 | Kim | D06F 58/48 34/493 |
| 2015/0020402 | A1* | 1/2015 | Cho | D06F 58/26 34/132 |
| 2017/0016171 | A1 | 1/2017 | Lee et al. | |

FOREIGN PATENT DOCUMENTS

| | | | | |
|---|---|---|---|---|
| CN | 105780417 | | 7/2016 | |
| EP | 2527528 | | 11/2012 | |
| EP | 2573252 | | 3/2013 | |
| EP | 2829653 | | 1/2015 | |
| EP | 2990519 | | 3/2016 | |
| EP | 3059342 | | 8/2016 | |
| EP | 3299513 | | 3/2018 | |
| JP | 2006-230887 | | 9/2006 | |
| JP | 2007-209603 | | 8/2007 | |
| JP | 2007301178 | A * | 11/2007 | |
| JP | 2009-291226 | | 12/2009 | |
| JP | 2014-023747 | | 2/2014 | |
| KR | 10-1999-0026245 | | 4/1999 | |
| KR | 10-2007-0015276 | | 2/2007 | |
| KR | 10-2007-0060831 | | 6/2007 | |
| KR | 10-2008-0055394 | | 6/2008 | |
| KR | 10-2009-0013962 | | 2/2009 | |
| KR | 1020110079482 | | 7/2011 | |
| KR | 10-2012-0029253 | | 3/2012 | |
| KR | 10-2012-0110498 | | 10/2012 | |
| KR | 20140038801 | | 3/2014 | |
| KR | 1020160136197 | | 11/2016 | |
| KR | 10-2016-0149852 | | 12/2016 | |
| KR | 1020160149851 | | 12/2016 | |
| KR | 1020170009656 | | 1/2017 | |
| KR | 10-2017-0016745 | A | 2/2017 | |
| KR | 101718042 | | 4/2017 | |
| KR | 10-2017-0082048 | | 7/2017 | |
| KR | 1020180032114 | | 3/2018 | |
| WO | WO-2007013327 | A1 * | 2/2007 | D06F 25/00 |
| WO | WO2014024400 | | 2/2014 | |

OTHER PUBLICATIONS

Translation, CN-101029449-A (Year: 2007).*
Translation, WO-2007013327-A1 (Year: 2007).*
Office Action in Australian Appln. No. AU2019265183, dated Oct. 13, 2021, 12 pages.
Office Action in Korean Appln. No. 10-2018-0052700, mailed on Sep. 14, 2023, 10 pages (with English translation).
Office Action in Korean Appln. No. 10-2018-0052699, mailed on Oct. 13, 2023, 10 pages (with English translation).
Office Action in Korean Appln. No. 10-2018-0052699, dated Jan. 31, 2023, 13 pages (with English translation).
Office Action in Korean Appln. No. 10-2018-0052700, dated Jan. 31, 2023, 11 pages (with English translation).
Office Action in Korean Appln. No. 10-2018-0052708, dated Feb. 14, 2023, 16 pages (with English translation).
Office Action in Korean Appln. No. 10-2018-0052740, dated Feb. 24, 2023, 15 pages (with English translation).
Office Action in Chinese Appln. No. 201980030770.1, dated Jun. 9, 2022, 24 pages (with English translation).
Extended European Search Report in European Appln. No. 19800190.1, dated Jan. 19, 2022, 8 pages.
Notice of Allowance in Korean Appln. No. 10-2018-0052708, mailed on Nov. 27, 2024, 2 pages (with English translation).

* cited by examiner

CLOTHES PROCESSING APPARATUS

CROSS-REFERENCE TO RELATED APPLICATIONS

This application is a National Stage filing under 35 U.S.C. 371 of International Application No. PCT/KR2019/005476, filed on May 8, 2019, which claims the benefit of earlier filing dates and right of priority to Korean Application No. 10-2018-0052699, filed on May 8, 2018, Korean Application No. 10-2018-0052700, filed on May 8, 2018, Korean Application No. 10-2018-0052708, filed on May 8, 2018, and Korean Application No. 10-2018-0052740, filed on May 8, 2018, the contents of which are all hereby incorporated by reference herein in their entirety.

TECHNICAL FIELD

The present disclosure relates to a clothes treatment apparatus having a function of drying clothes or bedding and a dew condensation prevention function.

BACKGROUND

A clothes treatment apparatus refers to every device which is configured to manage or treat clothes, such as washing, drying or removing wrinkles on clothes, bedding, and the like, at home or at a place like a dry-cleaning shop. Clothes treatment apparatuses may include a washing machine, a dryer, a washing and drying machine, a refresher, an iron, a steamer, and the like.

A washing machine is an apparatus that washes clothes or bedding. A dryer is an apparatus that dries moisture from clothes or bedding. A washing and drying machine is an apparatus that has both a washing function and a drying function. A refresher is an apparatus that refreshes clothes or the like, such as removing odors and dust from clothes or performing antistatic treatment. An iron is an apparatus for removing unnecessary wrinkles from clothes or creating wrinkles necessary for clothes. A steamer is an apparatus that sterilizes clothes or delicately removes unnecessary wrinkles from clothes using hot steam without a contact with a hot plate.

Among others, the dryer, as an apparatus performing a drying function, evaporates moisture contained in an object to be treated, such as clothes or bedding put in a drum (or tub), by supplying hot air to the object to be treated. Air which is discharged out of the drum after evaporating the moisture from the object to be treated contains such moisture so as to be in a hot and humid state. Here, dryers are classified into a condensing type and an exhaust type depending on a way of treating such hot humid air.

The condensing type dryer does not discharge hot and humid air to outside, but condenses moisture contained in the hot and humid air through heat exchange while circulating the air. In contrast, the exhaust type dryer directly discharges hot and humid air to outside. The condensing type dryer and the exhaust type dryer are structurally different from each other in that the condensing type dryer has a structure for treating condensate water and the exhaust type dryer has a structure for exhausting air.

The condensing type dryer is equipped with a circulation flow path for removing moisture from air discharged from the drum and heating the air to be introduced into the drum. Conventionally, as a circulation fan located at the front of an evaporator is disposed on a circulation flow path that is perpendicular to the evaporator, flow resistance is large, and heat exchange efficiency is low since the flow of air is not uniformly or evenly distributed in the evaporator.

In order to solve this problem, the circulation flow path should be simplified, and the layout of various components on a base cabinet should be optimized.

When the circulation fan is disposed at the rear of a condenser, condensate water on a bottom surface of the circulation flow path may be scattered by the suction force of the circulation fan. In this case, the condenser may be cooled by the condensate water, which may reduce efficiency of the condenser, or the condensate water may be introduced into the circulation fan, which may adversely affect driving reliability. Therefore, a new water cover structure that can reduce or prevent condensate water from scattering by the suction force of the circulation fan while providing a space for allowing the evaporator and condenser to be disposed spaced apart from the bottom surface should be researched.

In addition, as described above, condensate water may be introduced into the circulation fan by the suction force of the circulation fan. If the condensate water is not drained, driving reliability of the circulation fan is adversely affected, and thus a structure that allows the condensate water introduced into the circulation fan to be smoothly drained should be provided.

Meanwhile, for the sake of assembly convenience, the circulation fan and a motor for driving the circulation fan are installed at the base cabinet as one assembly. As such, when the circulation flow path is simplified, the installation structure of the circulation fan-motor also needs to be appropriately changed corresponding to this.

Further, noise and air volume generated when the circulation fan rotates vary according to its shape. Therefore, a study on an optimal design for the circulation fan is required for low noise and high air volume of the circulation fan.

Meanwhile, air heated after removing moisture in the condenser flows into a rear opening of the drum by the circulation fan. In order to guide the air that has passed through the circulation fan to the rear opening of the drum, a rear duct connector is provided. The rear duct connector should be designed to minimize flow resistance of air flowing and to prevent moisture from accumulating.

As for the condensing type dryer, hot humid air is not discharged to the outside, and thus hot humid air may leak outside the drum. The hot humid air leaked to the outside of the drum causes dew condensation inside the clothes treatment apparatus.

Korean Laid-Open patent application Ser. No. 10/171,8042, published on Jun. 19, 2015, (hereinafter, "Patent document"), which is hereby incorporated by reference, discloses a structure in which a blower fan is installed outside a drum. However, given that the blower fan is for cooling an auxiliary heat exchanger by sucking air through a hole formed on a front part of a cabinet, it is not suitable for preventing dew condensation.

In addition, when the size of the drum is increased, the size of a cabinet should be increased accordingly. However, a method for preventing dew condensation in a clothes treatment apparatus having a drum larger than the conventional drum is not separately provided in the Patent Document.

SUMMARY

A first aspect of the present disclosure is to implement a simplified circulation flow path that forms a path through which air discharged from a drum is heated after removing moisture and is introduced into the drum.

A second aspect of the present disclosure is to optimize a design for a base flow path provided in a base cabinet and the layout of various components, so as to provide a simpler circulation flow path.

A third aspect of the present disclosure is to provide a water cover having a new structure capable of providing a space in which an evaporator and a condenser are disposed to be spaced apart from the bottom surface while reducing or preventing condensate water on the bottom surface of a circulation path from scattering to the rear by the suction force of a circulation fan.

A fourth aspect of the present disclosure is to provide a structure capable of smoothly draining condensate water when the condensate water is introduced into a circulation fan in a structure where the circulation fan is located on a circulation flow path at the rear of a condenser.

A fifth aspect of the present disclosure is to provide an installation structure of a circulation fan and a motor for driving the circulation fan corresponding to a simplified circulation flow path.

A sixth aspect of the present disclosure is to provide an optimal design for a circulation fan that enables the circulation fan to have low noise and high air volume performance.

A seventh aspect of the present disclosure is to provide a structure capable of minimizing flow path resistance of a rear duct connector that guides air that has passed through a circulation fan to flow into a rear opening of the drum and preventing moisture from accumulating.

An eighth aspect of the present disclosure is to provide a clothes treatment apparatus having a structure capable of preventing dew condensation in the clothes treatment apparatus due to hot and humid air leaked to the outside of a drum.

Focusing on the fact that dew condensation inside a clothes treatment apparatus is caused by stagnant hot humid air, a ninth aspect of the present disclosure is to provide a clothes treatment apparatus having a structure capable of continuously circulating air between a cabinet and a drum without consuming additional energy while the drum is rotating.

A tenth aspect of the present disclosure is to provide a configuration capable of forming a circulation flow around a drum by using two or more fans and suppressing dew condensation by continuously exhausting hot humid air.

An eleventh aspect of the present disclosure is to provide a clothes treatment apparatus capable of forming an air circulation flow around a drum by using two or more fans while cooling a printed circuit board.

A twelfth aspect of the present disclosure is to provide a structure for suppressing dew condensation in a clothes treatment apparatus having a drum with a larger size than the conventional one.

In order to achieve the first aspect according to the present disclosure, there is provided a clothes treatment apparatus including: a drum having front and rear openings to accommodate clothes therein; a front supporter rotatably supporting the drum from a front side thereof and having an opening in communication with the front opening of the drum; a rear supporter rotatably supporting the drum from a rear side thereof and having vent holes in communication with the rear opening of the drum; a base cabinet disposed below the drum to define a bottom surface; a first flow path defining a path through which air discharged from the front opening of the drum flows and downwardly extending toward the front of one side of the base cabinet; a second flow path linearly extending from the first flow path toward the rear of the one side of the base cabinet and in which the air is heated after removing moisture through heat exchange while flowing; and a third flow path that connects the second flow path and the vent holes of the rear supporter, and upwardly extending from the one side of the base cabinet.

Implementations according to this aspect may include one or more of the following features. For example, the vent holes of the rear supporter may be located at a position eccentric to one side with respect to a vertical reference line that passes through a center of the rear supporter.

The vent holes of the rear supporter may be located above a horizontal reference line that passes through the center of the rear supporter.

The third flow path may be provided with a circulation fan disposed to face the second flow path, so as to suck air that has passed through the second flow path and blow the air through the vent holes of the rear supporter.

The third flow path may be provided with an intake port opened forward to face the second flow path, an exhaust port opened upward to be perpendicular to the intake port, and a circulation fan accommodating portion in which the circulation fan is accommodated. The circulation fan may be configured as a sirocco fan that laterally blows air introduced from the front.

The base cabinet may be provided with a base flow path that defines parts of the first flow path, the second flow path, and the third flow path.

The clothes treatment apparatus may further include a rear cover disposed to cover an evaporator and a condenser mounted on the base flow path so as to define the second flow path together with the base flow path, and a front cover disposed to cover the base flow path at the front of the rear cover so as to define the part of the first flow path together with the base flow path.

A communication hole may be provided in a lower periphery of the front supporter, and a front duct connector that connects the communication hole and an opening defined by the base flow path and the front cover may be mounted to the front supporter.

A rear duct connector that connects the vent holes of the rear supporter and the base flow path may be mounted to the rear supporter.

The first aspect of the present disclosure may also be achieved by a clothes treatment apparatus that includes: a drum in which clothes is accommodated; a circulation flow path that defines a path through which air discharged from a front opening of the drum is introduced into a rear opening of the drum after exchanging heat; and a base cabinet disposed below the drum to provide a space in which various components are mounted and having a base flow path that defines a part of the circulation flow path. One portion of the base flow path may be provided with an evaporator, a condenser, and a circulation fan sequentially mounted toward the rear, and the one portion of the base flow path may extend rearward from a position eccentric toward one side with respect to a center of the base cabinet.

In order to achieve the second aspect according to the present disclosure, there is provided a clothes treatment apparatus including: a drum in which clothes is accommodated; a circulation flow path that defines a path through which air discharged from a front opening of the drum is introduced into a rear opening of the drum after exchanging heat; and a base cabinet disposed below the drum to provide a space in which various components are mounted. The base cabinet may include a base flow path defining a part of the circulation flow path and having an evaporator, a condenser, and a circulation fan sequentially disposed toward the rear, a drum motor mounting portion on which a drum motor generating a driving force for rotating the drum is mounted, and a compressor mounting portion disposed at the rear of one side of the base flow path and on which a compressor generating compressed air for heat exchange is mounted.

Implementations according to this aspect may include one or more of the following features. For example, the evaporator, the condenser, and the circulation fan may be eccentric toward one side from a center of the base cabinet.

The circulation fan may be disposed such that a rotating shaft faces the condenser and the evaporator, and the circulation fan may be implemented as a sirocco fan that laterally blows air introduced from the front.

A blower fan may be mounted to a shaft of the drum motor, so as to blow air in a space between a cabinet forming an outer appearance and the drum.

When the drum motor is driven, the drum and the blower fan may be rotated together.

The cabinet may be provided with an exhaust fan so as to allow air in the space between the cabinet and the drum to be discharged to the outside.

A printed circuit board having a heat dissipation fan is mounted on an inner wall of the cabinet, and the heat dissipation fan and the blower fan may be located at opposite sides with the drum interposed therebetween so that the blower fan and the heat dissipation form a circulation flow surrounding the drum.

A condensate water collection part in communication with the base flow path may be provided between the compressor mounting portion and the base flow path, so as to allow the condensate water generated in the evaporator to be recovered.

A communication hole that provides communication between the base flow path and the condensate water collection part may be formed at a rear end of one side of the condenser.

A bottom surface of the base flow path on which the evaporator and the condenser are disposed may be inclined downward to the rear.

The bottom surface of the base flow path on which the condenser is disposed may be inclined downward to one side of the condenser.

In order to achieve the third aspect according to the present disclosure, there is provided a clothes treatment apparatus including: a drum that accommodates clothes therein and configured to be rotatable; a circulation flow path that defines a path through which air discharged from a front opening of the drum is introduced into a rear opening of the drum after exchanging heat; a heat pump system including an evaporator, a compressor, a condenser, and an expansion valve so as to remove moisture from the air that has passed through the circulation flow path to heat; and a water cover providing a space in which the evaporator and the condenser are seated, and mounted on a bottom surface of the circulation flow path so as to allow the evaporator and the condenser to be spaced part from the bottom surface.

Implementations according to this aspect may include one or more of the following features. For example, the water cover may include a seating part on which the evaporator and the condenser are seated, and a support portion extending downward from the seating part and supported on a bottom surface of the circulation flow path. A plurality of drain holes for draining condensate water generated in the evaporator may be formed at the seating part.

The seating part may include an evaporator seating portion on which the evaporator is seated, a condenser seating portion on which the condenser is seated, and a connecting portion that connects the evaporator seating portion and the condenser seating portion. The plurality of drain holes may be formed on front ends of the evaporator seating portion, the connecting portion, and the condenser seating portion.

Each of the plurality of drain holes may extend long along a widthwise direction of the condenser seating portion, and the plurality of drain holes may be continuously arranged at a predetermined interval along the widthwise direction and a lengthwise direction of the condenser seating portion.

The plurality of drain holes may be alternately disposed along the lengthwise direction of the condenser seating portion.

In order to suppress condensate water from being introduced into the condenser seating portion, an upwardly extending rib that protrudes along a widthwise direction of the seating part may be provided between the connecting portion and the condenser seating portion.

The upwardly extending rib may include a portion that is inclined toward the front.

The upwardly extending rib may include a first portion extending vertically upward with respect to the seating part, and a second portion extending in a direction crossing the first portion from an upper end of the first portion, so as to face the front of the seating part.

A downwardly extending rib that protrudes downward along the widthwise direction of the seating part may be provided between the evaporator seating portion and the connecting portion, so as to suppress condensate water from flowing upward of the seating part through the drain holes.

The circulation flow path may be provided with a circulation fan accommodating portion in which a circulation fan that sucks air that has passed through the condenser to blow is disposed. The bottom surface of the circulation flow path on which the water cover is mounted and a bottom surface defining an intake port of the circulation fan accommodating portion may be connected by a real wall extending in a vertical direction, and an edge of a rear end of the water cover may be provided with a recessed portion so that a side surface of the edge that faces the rear wall is spaced apart from the rear wall.

The bottom surface of the circulation flow path may be inclined downward to the rear of the seating part, and the support portion provided beneath the condenser seating portion may be longer than the support portion provided beneath the evaporator seating portion so that the seating part maintains a horizontal level (horizontality).

In order to achieve the fourth aspect according to the present disclosure, there is provided a clothes treatment apparatus including: a drum in which clothes is accommodated; a circulation flow path that defines a path through which air discharged from a front opening of the drum is introduced into a rear opening of the drum after passing through an evaporator and a condenser; a circulation fan located between the condenser on the circulation flow path and the rear opening of the drum; and a base cabinet disposed below the drum to provide a space in which the evaporator and the condenser are mounted and having a base flow path defining a part of the circulation flow path. The base flow path may include a circulation fan accommodating portion that provides a space in which the circulation fan is accommodated, and having an intake port opened forward to face the condenser and an exhaust port opened upward to be perpendicular to the intake port.

Implementations according to this aspect may include one or more of the following features. For example, the circulation fan may be configured as a sirocco fan, and a condensate water drain path may be provided at one side of an inner circumferential surface of the circulation fan accommodating portion that surrounds an outer circumference of the circulation fan, so as to drain condensate water introduced by the suction force of the circulation fan to the condenser side.

The condensate water drain path may include a side groove formed on the inner circumferential surface of the circulation fan accommodating portion to collect condensate water scattered by rotation of the circulation fan and flowing along the inner circumferential surface, and a communication hole that provides communication between the side groove and a mounting space of the condenser on the base flow path.

The side groove may be recessed downward from an inclined portion of the inner circumferential surface and extend toward the front.

The side groove may be formed on one side of the inner circumferential surface to which the tangent vector at the lowest point of the circulation fan is directed.

The clothes treatment apparatus may further include a cover member disposed to cover a rear opening of the circulation fan accommodating portion so as to define the exhaust port together with the circulation fan accommodating portion, and a drive motor mounted on an outer surface of the cover member and having a shaft coupled to the circulation fan by penetrating through the cover member.

The cover member may include a cover base disposed to cover the rear opening of the circulation fan accommodating portion, and a sealing portion having a shape bent forward from an outside of the cover base and brought into surface contact with an extended surface extending outward from the inner circumferential surface of the circulation fan accommodating portion. The sealing portion may be pressed against the extended portion when a fastening member penetrates through the cover member to be coupled to the circulation fan accommodating portion.

A part of the cover base may protrude forward than the sealing portion so as to be accommodated in the rear opening of the circulation fan accommodating portion.

The circulation fan may include a circular base portion disposed to face the intake port, a plurality of blades arranged at a predetermined interval along an edge of the base portion and blowing air introduced into the base portion to a side when the circulation fan rotates, and a connecting portion disposed to face the base portion and formed in a ring shape to connect the plurality of blades.

A chamfer portion may be formed at a front edge of the plurality of blades facing the intake port.

The exhaust port may be formed at an upper portion of one side eccentric from a center of the circulation fan.

In order to achieve the fifth aspect according to the present disclosure, there is provided a clothes treatment apparatus including: a drum in which clothes is accommodated; a circulation flow path that defines a path through which air discharged from a front opening of the drum is introduced into a rear opening of the drum after passing through an evaporator and a condenser; a base cabinet including a heat exchange unit disposed below the drum and at which the evaporator and the condenser are disposed, and a circulation fan accommodating portion having an intake port formed at the rear of the condenser so as to define a part of the base flow path; a cover member disposed to cover a rear opening of the circulation fan accommodating portion so as to define an exhaust port open upward together with the circulation fan accommodating portion; a drive motor mounted to an outer surface of the cover member; and a circulation fan coupled to a shaft penetrating through the cover member and disposed in the circulation fan accommodating portion.

The clothes treatment apparatus may include a bushing mounted in a shaft coupling portion of the circulation fan, and a fastening member coupled to a shaft of the drive motor inserted into the bushing by penetrating through a shaft coupling portion of the circulation fan.

The bushing may be made of a metal material to be integrally coupled to the shaft coupling portion by double injection. A groove may be continuously formed at an outer circumferential surface of the busing along its circumference, and a part of the shaft coupling portion may be accommodated in the groove.

At least one cut portion extending along a lengthwise direction and a non-cut portion located at the rear of the cut portion may be provided at a front end of the shaft, and the busing may be provided with a first insertion portion that corresponds to the cut portion and a second insertion portion that corresponds to the not-cut portion.

The non-cut portion may be engaged in a stepped portion between the first insertion portion and the second insertion portion.

The clothes treatment apparatus may further include a bracket mounted on the cover member to cover the drive motor, so as to fix the drive motor.

The cover member may include a cover base disposed to cover a rear opening of the circulation fan accommodating portion, and a sealing portion having a shape bent forward from an outside of the cover base and brought into surface contact with an extended surface extending outward from an inner circumferential surface of the circulation fan accommodating portion. The sealing portion may be pressed against the extended portion when a fastening member penetrates through the cover member to be coupled to the circulation fan accommodating portion.

A part of the cover base may protrude forward than the sealing portion so as to be accommodated in the rear opening of the circulation fan accommodating portion.

The circulation fan may include a circular base portion disposed to face the intake port, a plurality of blade portions arranged at a predetermined interval along an edge of the base portion and configured to laterally blow air introduced into the base portion when the circulation fan rotates, and a connecting portion disposed to face the base portion and formed in a ring shape to connect the plurality of blade portions.

A chamfer portion may be formed at a front edge of the plurality of blade portions facing the intake port.

The exhaust port may be formed at an upper portion of one side eccentric from a center of the circulation fan.

In order to achieve the sixth aspect according to the present disclosure, there is provided a clothes treatment apparatus including: a drum in which clothes is accommodated; a circulation flow path that defines a path through which air discharged from a front opening of the drum is introduced into a rear opening of the drum after passing through an evaporator and a condenser; and a circulation fan located between the condenser on the circulation flow path and the rear opening of the drum. The circulation fan may include: a base portion disposed to face the condenser and having a circular circumference; a plurality of blade portions arranged at a predetermined interval along an edge of the base portion and configured to laterally blow air introduced into the base portion when the circulation fan rotates; and a connecting portion disposed to face the base portion and formed in a ring shape to connect the plurality of blade portions.

Implementations according to this aspect may include one or more of the following features. For example, each of the plurality of blade portions may extend to a predetermined thickness.

The thickness of each of the plurality of blade portions may be 1.5 mm.

A distance from a center of the circulation fan to an inner end of each of the plurality of blade portions may be 50 mm.

A total of 43 blades may be provided for the plurality of blade portions.

An edge of the base portion may be located adjacent to an outer end than the inner end of each of the plurality of blade portions.

The connecting portion may be disposed to cover the outer end of each of the plurality of blade portions.

The connecting portion may be disposed not to overlap the base portion in a thickness direction of the circulation fan.

An angle between the inner end and the outer end of each of the plurality of blade portions with respect to the center of the circulation fan may be 7°.

When a distance from the center of the circulation fan to the inner end of each of the plurality of blade portions denotes an inner diameter, an angle between a tangent vector of a circle having the inner diameter as a radius at the inner end and a tangent vector of the inner end may be 46°.

When a distance from the center of the circulation fan to the outer end of each of the plurality of blades denotes an outer diameter, an angle between a tangent vector of a circle having the outer diameter as a radius at the outer end and a tangent vector of the outer end may be 27°.

In order to achieve the seventh aspect according to the present disclosure, there is provided a clothes treatment apparatus including: a drum in which clothes is accommodated; a drum front supporter that rotatably supports a the drum from a front side thereof; a drum rear supporter rotatably supporting the drum from a rear side thereof and having vent holes communicating with a rear opening of the drum; a base cabinet provided with a guide or guide portion disposed below the drum and into which air discharged from a front opening of the drum is introduced, a heat exchange unit that removes moisture from the air introduced from the guide portion to heat, and a circulation fan accommodating portion in which a circulation fan that sucks the air that has passed through the heat exchange unit to blow; and a rear duct connector that connects an exhaust port of the circulation fan accommodating portion and the vent holes of the drum rear supporter, so as to guide the air blown by the circulation fan to the rear opening of the drum.

Implementations according to this aspect may include one or more of the following features. For example, the rear duct connector may be provided with a first opening open downward on a lower end of the rear duct connector and disposed to face the exhaust port, and a second opening open forward and is disposed to face the vent holes of the drum rear supporter.

The rear duct connector may include a base member defining a rear part of the rear duct connector, and a cover member coupled to the base member to define a front part of the rear duct connector, defining the first opening together with the base member, and having the second opening formed on a front surface thereof.

The base member may include a first portion extending upward from the first opening, and a second portion located at an upper part of the first portion and corresponding to the second opening. The second portion may be wider (or greater) than the first portion.

An inner surface of the base member may be provided with an inner partition wall that extends upward from an inner wall of one side of the base member that corresponds to an upper end of the first portion or from a position adjacent to the inner wall of the one side thereof to be inclined in the same direction as the inner wall of the one side of the base member.

The inner partition wall may be upwardly inclined from the inner wall of the one side of the base member to the inner wall of another side thereof.

A drain hole for preventing water pooling may be provided between a lower end of the inner partition wall and the inner wall of the one side of the rear duct connector.

The drain hole may be formed by the lower end of the inner partition wall being spaced apart from the inner wall of the one side of the base member.

The inner partition wall may extend in a branched manner from the inner wall of the one side of the base member, and the drain hole may penetrate through a connecting portion between the inner wall and the inner partition wall.

An upper end of the inner partition wall may be formed to be rounded in a direction opposite to the extended direction of the inner partition wall.

The base member may be provided with a first sealing groove extending along an edge and a second sealing groove surrounding the first sealing groove, and the cover member may be provided with a first sealing protrusion that is inserted into the first sealing groove and a second sealing protrusion that is inserted into the second sealing groove.

A front surface of the rear duct connector defining the second opening may be in surface contact with a rear surface that defines the vent holes of the drum rear supporter.

A sealing portion made of an elastic material and surrounding the second opening may be provided at the front surface of the rear duct connector, and the sealing portion may be configured to be in close contact with the rear surface of the drum rear supporter to surround the vent holes.

The heat exchange unit and the circulation fan accommodating portion may be disposed at a position eccentric to one side from a center of the base cabinet, and the vent holes of the drum rear supporter may be provided at a position eccentric to one side with respect to a vertical reference line that passes through a center of the drum rear supporter.

The vent holes of the drum rear supporter may be located above a horizontal reference line that passes through the center of the drum rear supporter.

In order to achieve the eight to twelfth aspects according to the present disclosure, a blower fan installed to an output shaft of a drum motor so as to allow air existing in a space between a cabinet and the drum to flow, and an exhaust fan configured to exhaust the air existing in the space between the cabinet and the drum to the outside of a clothes treatment apparatus may be provided.

Implementations according to this aspect may include one or more of the following features. For example, the cabinet may define an outer appearance of the clothes treatment apparatus.

The clothes treatment apparatus may include a drum, and the drum may be configured to accommodate an object to be treated and be rotatably installed inside the cabinet.

The drum motor may be disposed below the drum and generate a driving force for rotating the drum.

The blower fan may be rotated when the drum motor is driven.

The exhaust fan may be mounted on an inner rear wall of the cabinet.

The inner space of the cabinet may be divided into a first space and a second space by the drum, the first space may correspond to a space for accommodating an object to be treated, and the second space may correspond to an annular space formed between the cabinet and the drum. The drum motor, the blower fan, and the exhaust fan may be installed in the second space.

The clothes treatment apparatus may include heat pump cycle devices configured to change temperature and humidity of air to be supplied to the drum, and a duct configured to surround a heat exchanger included in the heat pump cycle devices and connected to the drum so as to form an air circulation path between the heat exchanger and the drum. The drum motor, the blower fan, and the exhaust fan may be installed at an outside of the duct.

The heat exchanger may be installed below the drum to be eccentric to one side, and the duct may extend in an inclined direction toward a lower left or lower right side from the front of the drum so as to guide air discharged from the drum to the heat exchanger. The blower fan may be installed below of the drum to be eccentric to another side.

The blower fan and the duct may be disposed not to overlap each other in a front and rear direction of the clothes treatment apparatus.

The blower fan may be configured to generate wind in a direction in which air is sucked from the drum motor.

A compressor may be installed behind the drum motor based on a direction facing the clothes treatment apparatus from the front thereof. The output shaft protruding toward one side of the drum motor may correspond to a first output shaft, and the drum motor may be provided with a second output shaft protruding to another side thereof. The first output shaft may protrude toward the compressor, and the second output shaft may protrude in a direction opposite to the first output shaft. The blower fan may be configured to generate wind in a direction from the output shaft to the second output shaft.

The blower fan may be configured as an axial fan that generates wind in a direction from the rear to the front of the clothes treatment apparatus.

The front of the blower fan may be blocked by a front part of the cabinet disposed to be spaced apart from the blower fan.

The blower fan may include a hub connected to the output shaft protruding from the drum motor and a plurality of vanes protruding from an outer circumferential surface of the hub and disposed to be spaced apart from one another. The plurality of vanes may be provided in odd numbers.

The clothes treatment apparatus may include a front supporter mounted on the cabinet and having a circular drum support rib that corresponds to a front opening of the drum, and a rear supporter mounted on the cabinet and having a circular drum support rib that corresponds to a rear opening of the drum. The drum may be rotatably supported by the front supporter and the rear supporter.

The clothes treatment apparatus may further include an exhaust port formed on an inner rear wall of the cabinet to exhaust air existing in the space between the cabinet and the drum. The exhaust fan may be installed to face the exhaust port and generate wind to exhaust the air existing in the space between the cabinet and the drum to the outside of the clothes treatment apparatus.

The exhaust fan may be disposed on an upper left or upper right side of the drum.

The blower fan and the exhaust fan may be disposed at opposite sides with respect to the drum in an up and down direction, a left and right direction, and a front and rear direction of the clothes treatment apparatus.

A cross-sectional area of the drum may be 330,000 to 360,000 $mm^2$, and the ratio of the cross-sectional area between 1) a cross-sectional area of the drum and 2) an area of rotation radius of the exhaust fan may be 130:1 to 140:1.

The cross-sectional area of the drum may be 330,000 to 360,000 $mm^2$, and air volume of the exhaust fan may be 0.3 to 0.9 $m^3$/min.

The clothes treatment apparatus may further include a printed circuit board mounted on an inner wall of the cabinet, and a heat dissipation fan mounted adjacent to the printed circuit board. The blower fan and the heat dissipation fan may be disposed at opposite sides with respect to the drum so as to form a circulation flow around the drum.

The blower fan may be disposed below one side of the drum, and the heat dissipation fan may be disposed above another side of the drum.

The heat dissipation fan may be installed at an upper end of the printed circuit board and blow air downward of the cabinet.

The exhaust fan may be located at the rear of the heat dissipation fan based on a direction when the clothes treatment apparatus is viewed from the front thereof.

The embodiments of the present disclosure may provide at least one or more of the following benefits.

First, as the first flow path guides air discharged from the drum to the front of one side of the base cabinet, the second flow path extends toward the rear of the one side of the base cabinet, and the third flow path extends upward from the one side of the base cabinet, a simpler circulation flow path may be implemented.

Here, as the vent holes of the rear supporter are formed on one side of the rear supporter corresponding to the one side of the base cabinet, a structure in which the third flow path extends upward from the one side of the base cabinet may be achieved.

In addition, the circulation fan that sucks air in the front and blows the air upward may be disposed at the rear of the second flow path that extends linearly, enabling a uniform flow of air in the second flow path and the third flow path. Accordingly, a decrease in heat exchange efficiency in the second flow path may be prevented, and flow resistance in the third flow path may be reduced.

Second, the base cabinet may be provided with the base flow path that defines a part of the circulation flow path and in which the evaporator, the condenser, and the circulation are sequentially disposed toward the rear, and the drum motor mounting portion and the compressor mounting portion may be provided at the front and rear of the one side of the base flow path. Accordingly, a design of the base flow path provided at the base cabinet and the layout of various components may be optimized.

Third, as the downwardly extending rib is provided between the evaporator seating portion and the connecting portion of the water cover in a protruding manner, and the upwardly extending rib is provided between the connecting portion and the condenser seating portion in a protruding manner, condensate water on the bottom surface of the circulation flow path may be prevented from scattering rearward by the suction force of the circulation fan.

In addition, the plurality of drain holes formed at the condenser seating portion may be alternately disposed toward the rear, so that even if condensate water is introduced into between a gap between two drain holes, it falls again by the drain hole formed right behind (or next to) them. Thus, drain performance of condensate water in the condenser seating portion may be improved.

Fourth, as the condensate water drain path is provided at one side of an inner circumferential surface of the circulation fan accommodating portion that surrounds an outer circumference of the circulation fan, condensate water may be smoothly drained to the condenser side at the front even if the condensate water is introduced into the circulation fan side.

Fifth, the cover member may be disposed to cover the rear opening of the circulation fan accommodating portion so as to form the exhaust port that is open upward together with the circulation fan accommodating portion, and the drive motor may be installed to an outer surface of the cover member, thereby achieving a flow path structure in which air sucked in the front is blown upward.

Sixth, as the circulation fan has an inner diameter of 45 to 55 mm, a total number of blades is 36 to 43, an occupation angle of the blade portions is 7° to 10°, and a suction (or intake) angle of the blade portions is 42° to 46°, and a discharge angle of the blade portions is 18° to 27°, low noise and high air volume of the circulation fan may be realized.

Seventh, a vortex may occur in the rear connector as a portion in communication with the vent holes of the rear supporter has a wider width. In order to prevent this, the inner partition wall may be provided to guide the flow of air in the corresponding portion, thereby minimizing flow resistance.

Further, the drain hole may be provided between a lower end of the inner partition wall and the inner wall of one side of the rear duct connector, thereby preventing moisture from accumulating.

Meanwhile, according to the present disclosure, the blower fan may be directly connected to the drum motor that rotates the drum so as to cause the blower fan to rotate when the drum motor is driven. Accordingly, while the drum is rotating, the blower fan may also be rotated without additional energy consumption. As the blower fan circulates hot humid air existing in a space between the cabinet and the drum, dew condensation may not occur in the space between the cabinet and the drum.

Moreover, the blower fan may be disposed at the front of the drum motor, and the front of the blower fan may be blocked by the front cover corresponding to the front part of the cabinet. Accordingly, external air may not be sucked in when the blower fan is operated, and thereby to maximize the effect of circulating the air existing in the space between the cabinet and the drum may be maximized.

The exhaust fan and the heat dissipation fan may suppress dew condensation together in addition to rotation of the blower fan. The exhaust fan and the heat dissipation fan may be disposed at the opposite side of the blower fan with respect to the drum in the front and rear direction, the left and right direction, and the up and down direction of the clothes treatment apparatus.

The heat dissipation fan may not only cool the printed circuit board, but also generate a circulation flow of air at the opposite side of the circulation fan. Accordingly, a circulation flow may be formed around the drum by the rotation of the blower fan and the heat dissipation fan. Since dew condensation is caused by stagnation of hot humid air, dew condensation may be suppressed when the blower fan and the heat dissipation fan are rotated.

As the exhaust fan exhausts the air circulation flow formed by the blower fan and the heat dissipation fan to the outside of the clothes treatment apparatus, humidity inside the cabinet may be reduced. In particular, when the exhaust fan is installed, air velocity of the air circulation flow formed by the blower fan and the heat dissipation fan is accelerated, thereby maximizing the effect of suppressing dew condensation.

The present disclosure presents an appropriate size and an appropriate air velocity of the exhaust fan employed in a clothes treatment apparatus in which a drum having a larger size than the related art drum is installed. Therefore, in the clothes treatment apparatus in which a large-sized drum is installed, dew condensation may be suppressed without deteriorating the function of drying performance.

DETAILED DESCRIPTION

Hereinafter, a clothes treatment apparatus according to the present disclosure will be described in detail with reference to the accompanying drawings.

For the sake of brief description with reference to the drawings, the same or equivalent components will be provided with the same reference numbers, and description thereof will not be repeated.

In addition, a structure applied to one embodiment may be equally applied to another embodiment unless the different embodiments are not structurally and functionally inconsistent.

A singular representation may include a plural representation unless it represents a definitely different meaning from the context.

In describing the present disclosure, if a detailed explanation for a related known function or construction is considered to unnecessarily divert the main point of the present disclosure, such explanation has been omitted but would be understood by those skilled in the art.

The accompanying drawings are used to help easily understand the technical idea of the present disclosure and it should be understood that the idea of the present disclosure is not limited by the accompanying drawings. The idea of the present disclosure should be construed to extend to any alterations, equivalents and substitutes besides the accompanying drawings.

Figure 1:
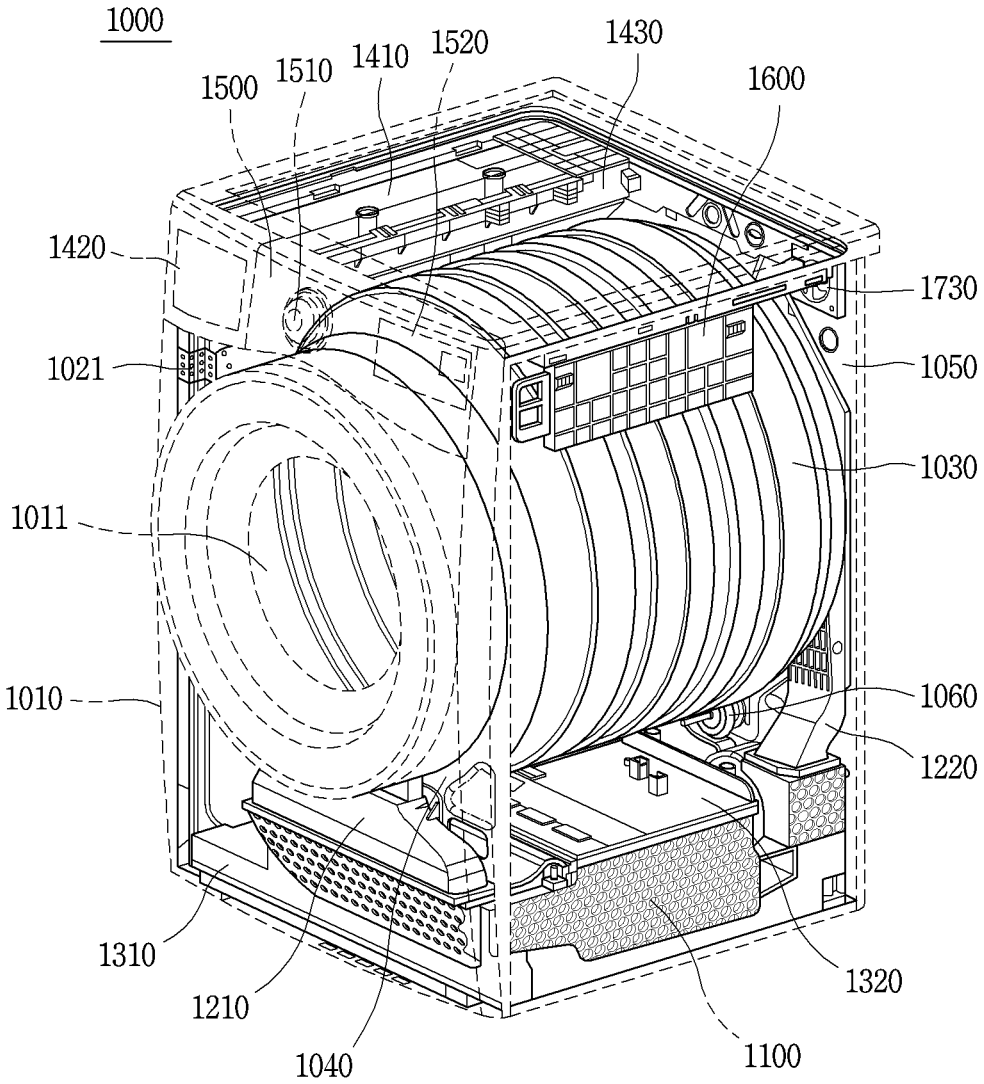
FIG. 1 is a perspective view of a clothes treatment apparatus according to one implementation of the present disclosure.

FIG. 1 is a perspective view illustrating a clothes treatment apparatus (clothes processing apparatus) 1000 in accordance with one implementation of the present disclosure.

A cabinet 1010 may define an outer appearance of the clothes treatment apparatus 1000. The cabinet 1010 may include a plurality of sub cabinets defining front, rear, left, right, upper and lower parts of the clothes treatment apparatus 1000. The sub cabinets may be made of a metal plate, or a synthetic resin material.

A sub-cabinet defining a base of the laundry treatment apparatus 1000 may be referred to as a base cabinet 1310. The base cabinet 1310 is made of a synthetic resin material to provide a space in which various parts or components are mounted. The base cabinet 1310 may itself define a bottom surface of the clothes treatment apparatus 1000, or a base plate made of a metal material may be mounted beneath the base cabinet 1310 to be placed on the bottom surface.

The cabinet 1010 may be defined in combination of a plurality of plates. Each plate may be named in combination of a position and a cover. For example, a plate defining the front part of the clothes treatment apparatus 1000 may be referred to as a front cover, a plate defining the rear part of the clothes treatment apparatus 1000 may be referred to as a rear cover, and plates defining the side parts of the clothes treatment apparatus 1000 may be referred to as side covers.

A clothes inlet (or front opening) 1011 may be provided at the front part of the cabinet 1010. The clothes inlet 100 may communicate with a front opening of a drum 1013 so that an object to be treated, such as clothes and beddings, is put in the drum 1030.

A door 1020 may be configured to open and close the clothes inlet 1011. The door 1020 may be rotatably connected to the cabinet 1010 by a hinge (not shown). The door 1020 may partially be formed of a transparent material. Therefore, even when the door 1020 is closed, the inside of the drum 1030 may be visually exposed through the transparent material.

The drum 1030 may be rotatably disposed in the cabinet 1010. The drum 1030 may be formed in a cylindrical shape with a hollow interior open at front and rear ends. A front opening 1030' of the drum 1030 may communicate with the clothes inlet 1011 to accommodate the object to be treated. The drum 1030 may be disposed to be laid in a front and rear direction of the clothes treatment apparatus 1000 to receive the object to be treated through the clothes inlet 1011. The drum 1030 may be provided with a concave-convex portion on its outer circumferential surface.

A circulation flow path 1200 may be connected to the front opening 1030' and a rear opening 1030" of the drum 1030, so as to allow air to be circulated in a closed loop formed by the inside of the drum 1030 and the circulation flow path 1200. Moist or humid air discharged through the front opening 1030' of the drum 1030 passes through an evaporator 1110 on the circulation flow path 1200 to remove moisture and is then heated while passing through a condenser 1130. This hot dry air is introduced into the drum 1030 through the rear opening 1030" thereof to dry the object to be treated.

The drum 1030 may be rotatably supported by a front supporter 1040 and a rear supporter 1050. The front supporter 1040 may be disposed at a front lower side of the drum 1030, and the rear supporter 1050 may be disposed at a rear side of the drum 1030, so as to support the drum 1030 in a rotatable manner.

Rollers 1060 may be installed on the front supporter 1040 and the rear supporter 1050, respectively. The rollers 1060 may be disposed right beneath the drum 1030 to be in contact with an outer circumferential surface of the drum 1030. The rollers 1060 are configured to be rotatable, and rotate in a direction opposite to a rotation direction of the drum 1030 to assist rotation of the drum 1030. An outer circumferential surface of the roller 1060 in contact with the outer circumferential surface of the drum 1030 may be made of an elastic member (e.g., rubber).

Heat pump cycle devices 1100 for changing temperature and humidity of air to be supplied to the drum 1030 may be installed below the drum 1030. Here, a space below the drum 1030 may indicate a space defined between a lower portion of the drum 1030 and the base cabinet 1310. The heat pump cycle devices 1100 refer to devices constituting a cycle to sequentially evaporate, compress, condense, and expand a refrigerant. When the heat pump cycle devices 1100 are operated, air may become hot and dry while exchanging heat sequentially with the evaporator 1110 and the condenser 1130.

The evaporator 1110 and the condenser 1130 for exchanging heat with air flowing along the circulation flow path 1200 may be provided on the circulation flow path 1200. The base cabinet 1310 may be provided with a base flow path (or base flow path part) 1310' defining a part of the circulation flow path 1200.

The base flow path 1310' may be provided with a heat exchange unit 1312 in which the evaporator 1110 and the condenser 1130 for heat exchange are disposed. A guide or guide portion 1311 that guides air to flow into the heat exchange unit 1312 may be provided at the front of the heat exchange unit 1312, and a circulation fan accommodating portion 1313 in which a circulation fan 1710 that sucks air that has passed through the heat exchange unit 1312 to blow is accommodated may be provided at the rear of the heat exchange unit 1312. That is, the base flow path 1310' includes the guide portion 1311, the heat exchange unit 1312, and the circulation fan accommodating portion 1313, which are sequentially disposed from the front to the rear.

After the evaporator 1110 and the condenser 1130 are installed at the base flow path 1310', a base cover 1320 may be disposed to cover an upper open side of the base flow path 1310'. In addition, after the circulation fan 1710 is installed at the circulation fan accommodating portion 1313, a cover member 1330 is disposed to cover a rear open side of the circulation fan accommodating portion 1313, allowing a flow path connected from an opening 1311' of the guide portion 1311 to an exhaust port 1313" of the circulation fan accommodating portion 1313 is completed or achieved. The flow path may be referred to as a connection duct 1230 (see FIG. 2) in that it connects an outlet duct 1210 and an inlet duct 1220.

A front duct connector 1210 is configured to connect the front opening 1030' of the drum 1030 and the guide portion 1311, and a rear duct connector 1220 is configured to connect the rear opening 1030" of the drum 1030 and the circulation fan accommodating portion 1313. The front duct connector 1210 may also be referred to as an outlet duct since it defines a flow path through which air inside the drum 1030 is discharged. The rear duct connector 1220 may also be referred to as an inlet duct since it defines a flow path through which air is introduced into the drum 1030.

Air that has dried an object to be treated becomes humid, and this humid air is introduced into the heat exchange unit 1312 through the front duct connector 1210 and the guide portion 1311 of the base flow path 1310'. The air is heated after removing moisture in the heat exchange unit 1312, and is then introduced into the drum 1030 by the circulation fan 1710 through the rear duct connector 1220.

Meanwhile, with respect to the heat exchange unit 1312, a flow path defined by the front duct connector 1210 and the guide portion 1311 may be referred to as a "first flow path", and a flow path defined by the circulation fan accommodating portion 1313 and the rear duct connector 1220 may be referred to as a "third flow path". Here, a flow path defined by the heat exchange unit 1312 may be referred to as a "second flow path". That is, air inside the drum 1030 is discharged through the first flow path, and the air is reheated after removing moisture in the second flow path, and then the air is introduced again into the drum 1030 through the third flow path.

The first flow path may form a path or channel through which air discharged from the front opening 1030' of the drum 1030 is introduced, and downwardly extend toward the front of one side of the base cabinet 1310. The second flow path may linearly extend toward the rear of the one side of the base cabinet 1310. The third flow path may extend upward from the one side of the base cabinet 1310, so as to connect the second flow path and vent holes 1050' formed on the rear supporter 1050.

That is, the second flow path and the third flow path are disposed on one side of the base cabinet 1310. Accordingly, a simpler circulation flow path 1200 may be achieved when compared to the conventional circulation flow path in which a direction change is made from one side to another side of the base cabinet.

The third flow path is provided with the circulation fan 1710 disposed to face the second flow path, so as to suck air that has passed through the second flow path and blow the air to the vent holes 1050' of the rear supporter 1050. The third flow path includes an intake port 1313' opened forward to face the second flow path, and an exhaust port 1313" opened upward to be perpendicular to the intake port 1313'. The circulation fan accommodating portion 1313 in which the circulation fan 1710 is accommodated is provided at the third flow path.

As such, the circulation fan 1710 that sucks air in the front and blows the air upward is disposed at the rear of the second flow path that extends linearly, enabling a uniform flow of air in the second flow path and the third flow path. Accordingly, a decrease in heat exchange efficiency in the second flow path may be prevented, and flow resistance in the third flow path may be reduced.

The base cabinet 1310 is provided with the base flow path 1310' that defines parts of the first flow path, the second flow path, and the third flow path. This will be described later.

When air flowing along the circulation flow path 1200 exchanges heat with the evaporator 1110, condensate water is generated. More specifically, when temperature of the air is lowered by the heat exchange performed in the evaporator 1110, an amount of saturated water vapor that the air can contain may decrease. Since the air recovered through the front duct connector 1210 contains moisture exceeding the amount of saturated water vapor, condensate water may inevitably be generated.

A water pump 1440 (see FIG. 4) may be provided inside the clothes treatment apparatus 1000. The water pump 1440 may be installed at the base cabinet 1310. The water pump 1440 may move the condensate water to a water tank 1410. This condensate water may be collected in the water tank 1410.

The water tank 1410 may be disposed at an upper left or upper right side of the drum 1030. In other words, the water tank 1410 may be disposed in an empty space between the upper left side of the drum 1030 and the cabinet 1010, or an empty space between the upper right side of the drum 1030 and the cabinet 1010. In FIG. 1, the water tank 1410 is shown to be disposed at the upper left side of the drum 1030.

A water tank cover 1420 may be disposed at an upper left or upper right end of the front part of the clothes treatment apparatus 1000 so as to correspond to a position of the water tank 1410. The water tank cover 1420 may be formed to be gripped by a hand, and exposed to the front surface of the clothes treatment apparatus 1000. When the water tank cover 1420 is pulled out to empty the condensate water collected in the water tank 1410, the water tank 1410 may be drawn out from a water tank support frame 1430 together with the water tank cover 1420.

The water tank support frame 1430 may support the water tank 1410 inside the cabinet 1010. The water tank support frame 1430 may extend in a direction that the water tank 1410 is inserted or withdrawn, so as to guide the insertion or the withdrawal of the water tank 1410.

An input/output panel 1500 may be disposed at the front or upper surface of the clothes treatment apparatus 1000. In FIG. 1, the input/output panel 1500 is disposed next to the water tank cover 1420. The input/output panel 1500 may include an input unit 1510 for receiving a selection of a clothes treatment course from a user, and an output unit 1520 for visually displaying an operating state of the clothes treatment apparatus 1000.

The input unit 1510 may be configured as a jog dial, but is not limited thereto. The output unit 1520 may be configured to visually display an operating state of the clothes treatment apparatus 1000. The clothes treatment apparatus 1000 may have a separate component for audible display in addition to the visual display.

A control unit (or controller) 1600 may be configured to control the operation of the clothes treatment apparatus 1000 based on a user's input applied through the input unit 1510. The control unit 1600 may include a printed circuit board and elements mounted on the printed circuit board. When the user selects a clothes treatment course through the input unit 1510, the control unit 1600 controls the operation of the clothes treatment apparatus 1000 according to a preset algorithm.

The printed circuit board and the elements mounted on the printed circuit board that constitute the control unit 1600 may be disposed at an upper left or upper right side of the drum 1030. In FIG. 1, it is shown that the printed circuit board is disposed at a side wall of the cabinet 1010 that corresponds to the upper right side of the drum 1030, which is opposite to the water tank 1410. Considering that the condensate water is collected in the water tank 1410, air containing moisture flows in the circulation flow path 1200, and electrical products such as the PCB and the elements are vulnerable to water, the printed circuit board and the elements may be spaced as apart as possible from the water tank 1410 and the circulation flow path 1200.

The heat dissipation fan 1760 may be mounted adjacent to the printed circuit board. For example, the heat dissipation fan 1760 may be installed on a top of the printed circuit board. In addition, the heat dissipation fan 1760 may be installed to face cooling fins (not shown) of the printed circuit board.

The heat dissipation fan 1760 may make wind to cool the printed circuit board or the cooling fins mounted on the printed circuit board. The heat dissipation fan 1760 may generate wind in a direction from top to bottom of the clothes treatment apparatus 1000. The heat dissipation fan 1760 may be configured as an axial fan that generates wind in a direction of a rotating (or rotational) shaft. A circulation flow may be caused by the heat dissipation fan 1760 in an annular space between the cabinet 1010 and the drum 1030.

An inner space of the cabinet 1010 may be divided into a first space I and a second space II based on the drum 1030. The first space I may be a cylindrical space enclosed by the drum 1030, and correspond to a space for accommodating objects to be treated such as clothes and the like. The second space II may be an annular space between the cabinet 1010 and the drum 1030, and correspond to a space in which electric parts and mechanical structures of the clothes treatment apparatus 1000 are disposed. The space between the cabinet 1010 and the drum 1030 refers to the second space II.

In case where the cylindrical drum 1030 is installed inside the cabinet 1010 having a shape close to a hexahedron as a whole, regions in which electric parts, mechanical structures, etc. can be installed between the cabinet 1010 and the drum 1030 may be four corners outside the drum 1030 when the clothes treatment apparatus 1000 is viewed from the front.

The evaporator 1110 and the condenser 1130 corresponding to a heat exchanger, and the connection duct 1230 enclosing the heat exchanger may be disposed to be eccentric to one side below the drum 1030 so as to occupy one of the four corners. A compressor 1120, a drum motor 1800, a blower (or blowing) fan 1820, etc. may be disposed to be eccentric to another side below the drum 1030 so as to occupy another corner of the four corners. The printed circuit board constituting the control unit 1600 may be disposed to be eccentric to one side above the drum 1030 so as to occupy still another corner of the four corners. The water tank 1410 may be disposed to be eccentric to another side above the drum 1030 so as to occupy the last or the remaining corner of the four corners.

By this arrangement, the blower fan 1820, the connection duct 1230, the printed circuit board constituting the control unit 1600, and the water tank 1410 may not overlap one another in the front and rear direction of the clothes treatment apparatus 1000. In addition, this arrangement may provide a condition for maximizing the size of the drum 1030 in the limited cabinet 1010 by efficiently utilizing the inner space of the clothes treatment apparatus 1000.

In particular, the present disclosure relates to a clothes treatment apparatus 1000 having a drum with a larger size than the related art one. For example, a cross-sectional area of the drum 1030, which may be calculated as an area of a circle, may be in the range of 330,000 to 360,000 $mm^2$.

Figure 2:
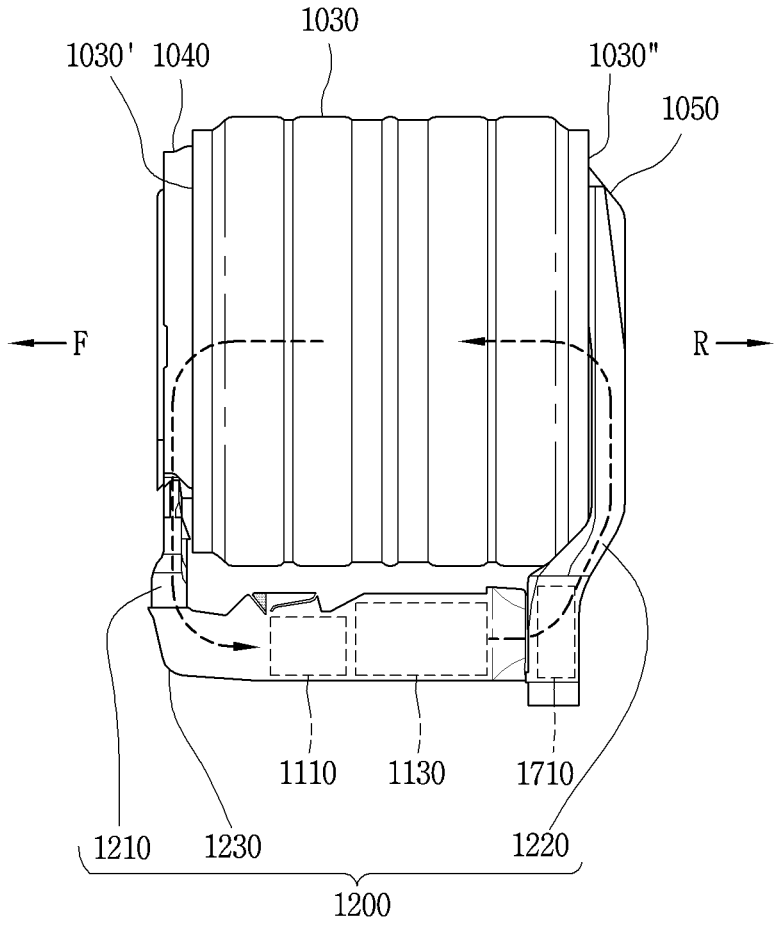
FIG. 2 is a conceptual view illustrating circulation of air through a drum and a circulation flow path in FIG. 1.

FIG. 2 is a conceptual view illustrating circulation of air through the drum 1030 and the circulation flow path 1200 in FIG. 1. In FIG. 2, the left side corresponds to the front F of the drum 1030, and the right side corresponds to the rear R of the drum 1030.

In order to dry an object to be treated (e.g., clothes) in the drum 1030, hot dry air is supplied to the inside of the drum 1030, and the air that has dried the clothes is collected to remove moisture and to be heated, and then the air is supplied to the drum 1030 again. For repeating such series of processes in the condensing type dryer, air should be continuously circulated through the drum 1030. This air circulation is enabled through the drum 1030 and the circulation flow path 1200.

The circulation flow path 1200 may be defined by the inlet duct 1220, the outlet duct 1210, and the connection duct 1230 disposed between the inlet duct 1220 and the outlet duct 1210. Each of the inlet duct 1220, the outlet duct 1210, and the connection duct 1230 may be formed by coupling a plurality of members.

Based on the flow of air, the drum 1030, the outlet duct 1210, the connection duct 1230, and the inlet duct 1220 are sequentially connected, and the inlet duct 1220 is connected back to the drum 1030 so as to define a closed flow path.

The front supporter 1044 may be provided with an opening 1044 that corresponds to the front opening 1030' of the drum in which the object to be treated is put, and a communication hole 1040" in communication with the outlet duct 1210 formed at a lower circumference thereof.

The outlet duct 1210 may extend downward from the front supporter 1040 to the connection duct 1230. Air that has dried the object to be treated in the drum 1030 is recovered to the connection duct 1230 through the outlet duct 1210.

The evaporator 1110 and the condenser 1130 among the heat pump cycle devices 1100 may be installed inside the connection duct 1230. In addition, the circulation fan 1710 for supplying hot dry air to the inlet duct 1220 may also be installed in the connection duct 1230.

Based on the flow of air, the evaporator 1110 is disposed at an upstream side of the condenser 1130, and the circulation fan 1710 is disposed at a downstream side of the condenser 1130. The circulation fan 1710 sucks air from the condenser 1130 and generates wind in a direction for supplying the air to the inlet duct 1220.

The inlet duct 1220 may extend upward from the connection duct 1230 to cover a rear surface of the rear supporter 1050, and communicate with the vent holes 1050' formed on the rear supporter 1050. The rear surface of the rear supporter 1050 refers to a surface that faces the rear of the laundry treatment apparatus 1000. Hot dry air is supplied into the drum 1030 through the vent holes 1050'.

As the drum 1030 and the connection duct 1230 are disposed to be spaced apart from each other in an up and down direction (or vertical direction), the inlet duct 1220 may upwardly extend toward the rear side of the drum 1030 from the connection duct 1230 disposed below the drum 1030. The outlet duct 1210 may also extend in the vertical direction as in the case of the inlet duct 1220, but a vertically extended length of the inlet duct 1220 may be longer than a vertically extended length of the outlet duct 1210 due to the connection structure.

Figure 3:
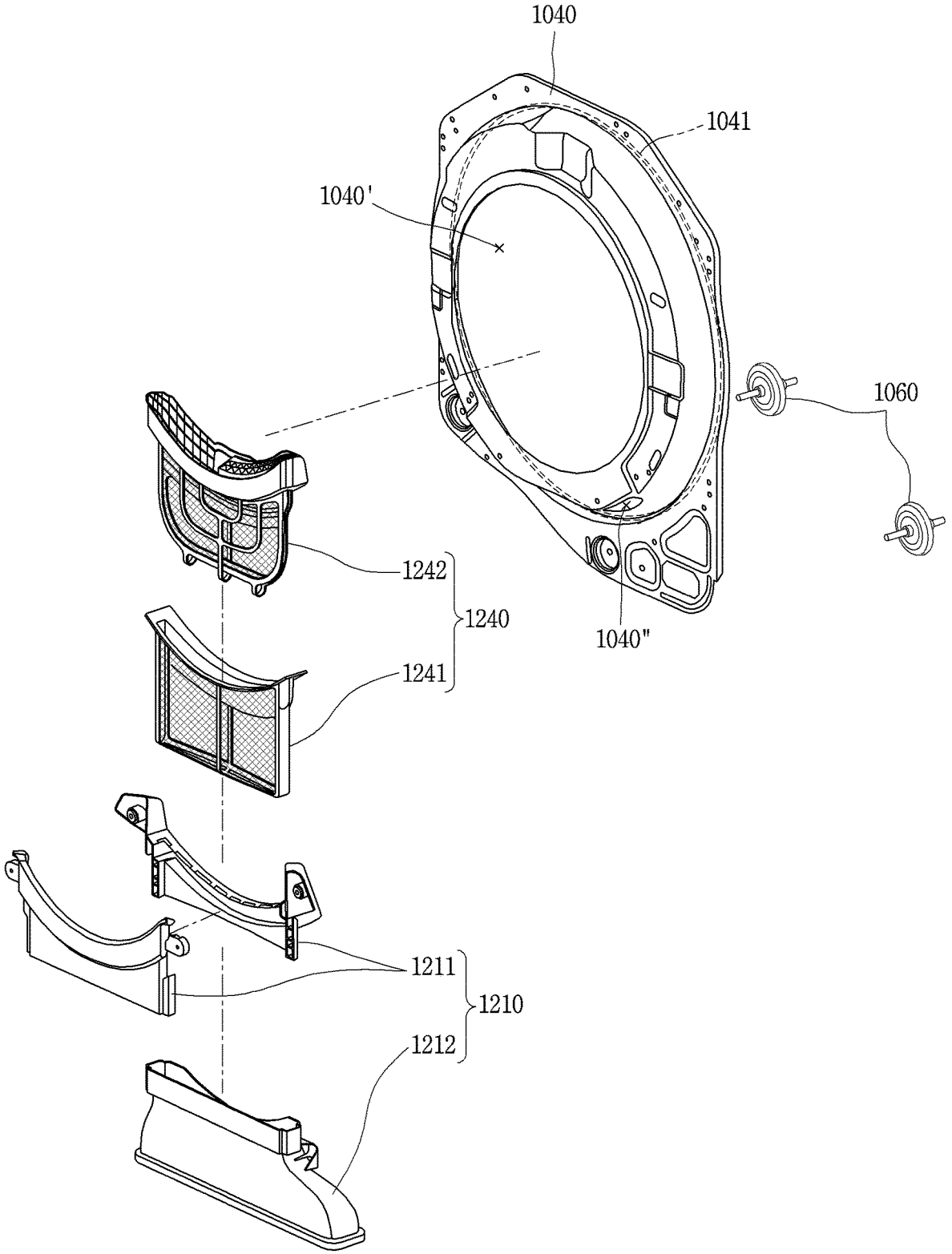
FIG. 3 is a conceptual view illustrating a front structure of the drum in FIG. 1.

FIG. 3 is a conceptual view illustrating a front structure of the drum 1030 in FIG. 1.

A drum support ring 1041 that corresponds to the front opening 1030' of the drum 1030 may be provided on a rear surface of the front supporter 1040 that faces the drum 1030 in a protruding manner. The drum support ring 1041 is inserted into the front opening 1030' of the drum 1030 to rotatably support the drum 1030.

At least two rollers 1060 are rotatably mounted on the front supporter 1040. The rollers 1060 rotatably support the drum 1030 beneath the drum 1030.

In order to prevent air from leaking into a gap between the front opening 1030' of the drum 1030 and the drum support ring 1041, a sealing pad (not shown) may be provided to cover a connecting portion between the drum 1030 and the front supporter 1040. The sealing pad may surround the front opening 1030' of the drum 1030 and the drum support ring 1041. The sealing pad may be made of a felt material.

The front supporter 1040 may be provided with the opening 1044 that corresponds to the front opening 1030' of the drum 1030 and the communication hole 1040" formed at the lower circumference thereof. Air discharged through the front opening 1030' of the drum 1030 flows into the communication hole 1040".

The front supporter 1040 may be provided with the front duct connector 1210 for guiding the air introduced into the communication hole 1040" to flow downward of the drum 1030. The front duct connector 1210 connects the communication hole 1040" and the opening 1311' [opening defined by the base flow path 1310' and a front base cover 1321] formed in the base cabinet 1310.

The front duct connector 1210 may extend downward from the communication hole 1040". In this drawing, the front duct connector 1210 includes a filter guide 1211 and a duct connector 1212. In some implementations, the front duct connector 1210 may be implemented as a single member.

The filter guide 1211 is mounted to the front supporter 1040 to be inserted into the communication hole 1040". The filter guide 1211 may be mounted on a circumferential portion of the front supporter 1040. The filter unit 1240 is detachably coupled to an inside of the filter guide 1211 to filter out lint from air discharged through the front opening 1030' of the drum 1030.

The filter unit 1240 may be configured by a plurality of filters. In this drawing, an inner filter 1242 is inserted into an outer filter 1241, and the outer filter 1241 is inserted into the filter guide 1211 to penetrate through the communication hole 1040". The number of holes in a mesh net per unit area of the outer filter 1241 and the inner filter 1242 may be different. For example, the mesh net of the inner filter 1242 may be denser than the mesh net of the outer filter 1241.

The duct connector 1212 is mounted to the front supporter 1040 and connected to the filter guide 1211. The duct connector 1212 may be mounted on a front surface of the front supporter 1040. A lower end of the filter guide 1211 may be accommodated in the duct connector 1212.

The duct connector 1212 extends downward and is connected to the opening 1311' [opening defined by the base flow path 1310' and the front base cover 1321] formed in the base cabinet 1310. One side of the duct connector 1212 may extend downward to be inclined to the opening 1311' formed on one side of the base cabinet 1310.

Figure 4:
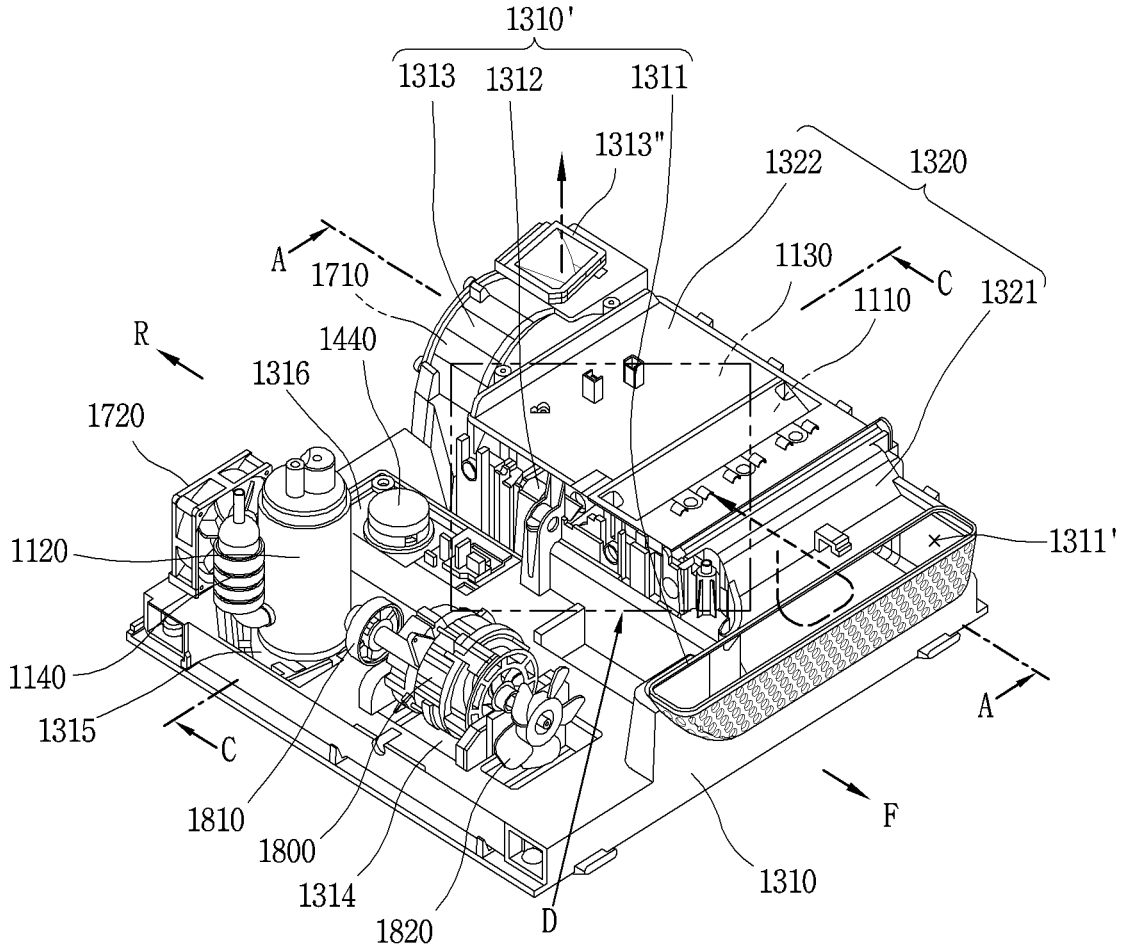
FIG. 4 is a perspective view illustrating a base cabinet and main components mounted on the base cabinet in FIG. 1.
Figure 5:
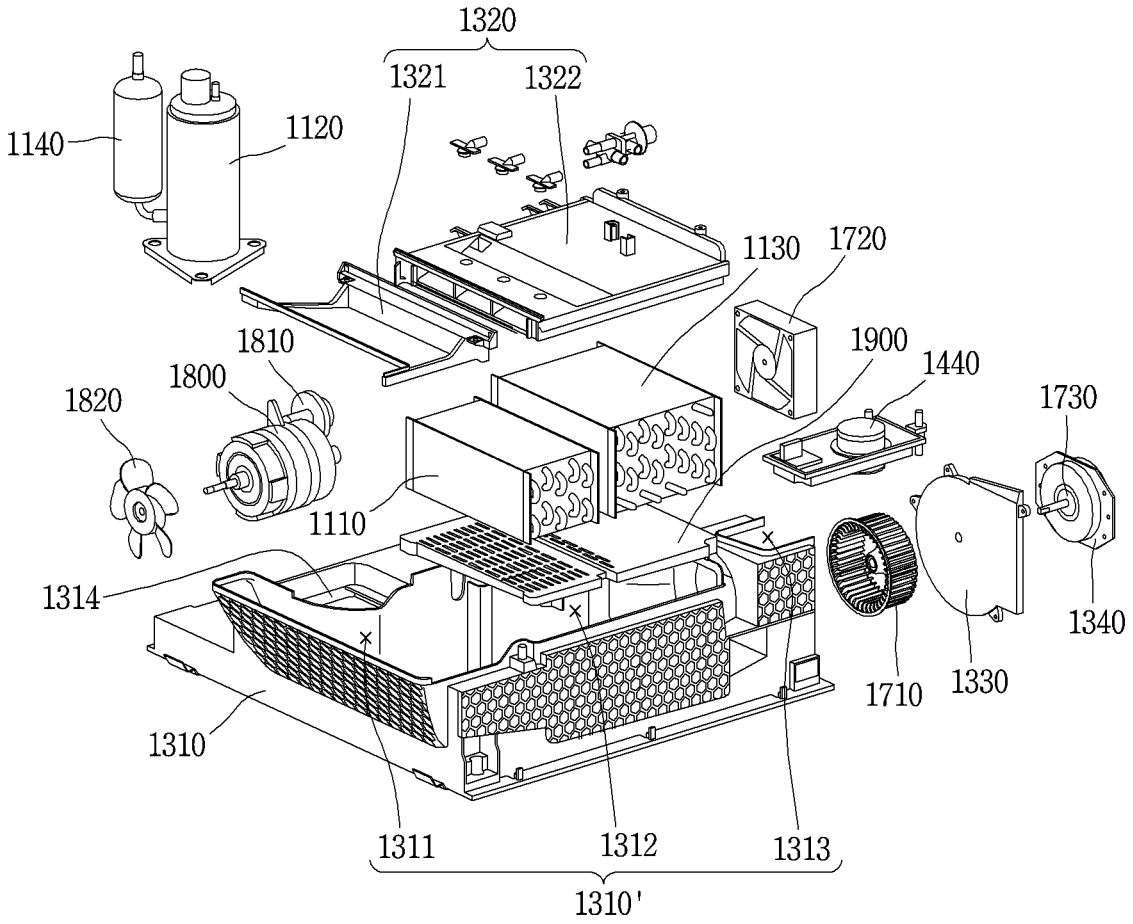
FIG. 5 illustrates the main components in FIG. 4 disassembled from the base cabinet.
Figure 6:
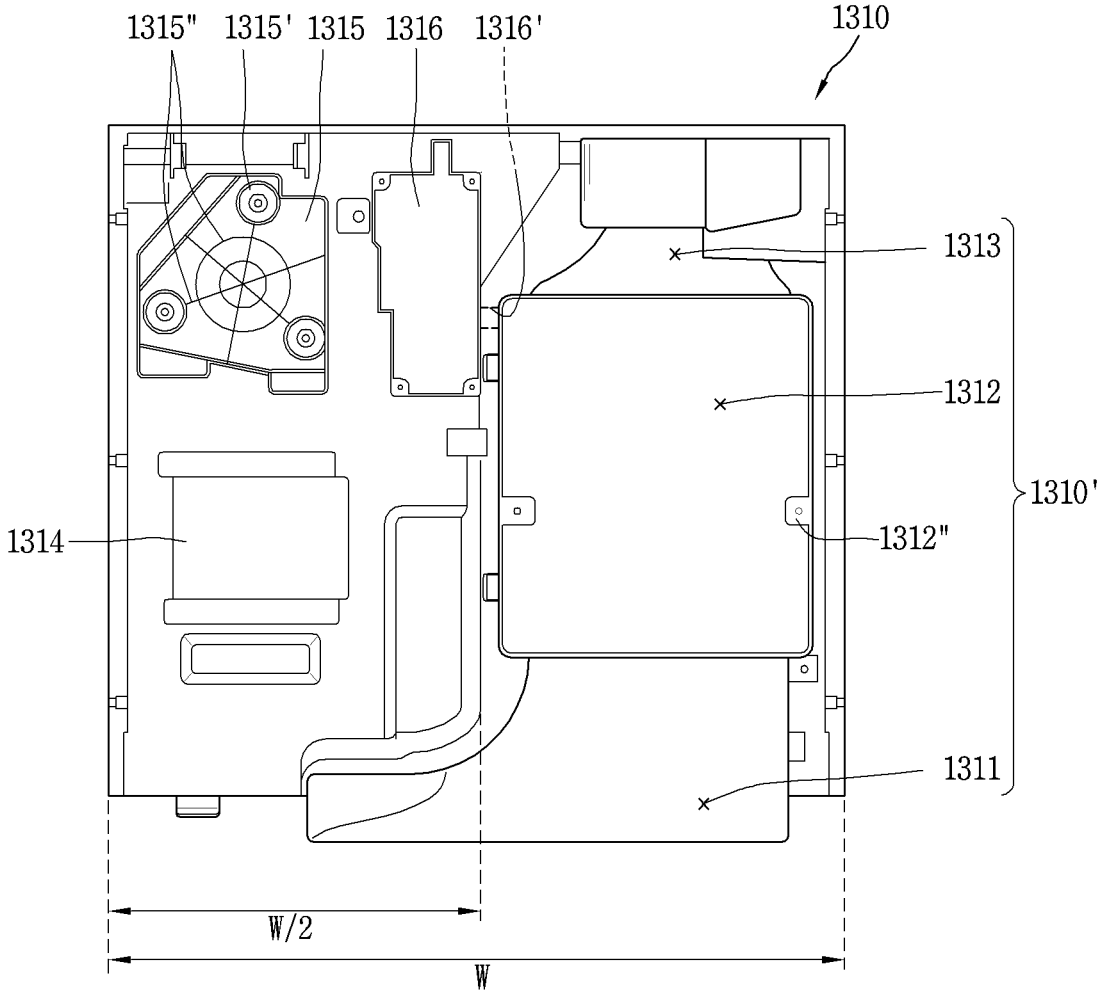
FIG. 6 is a planar view of the base cabinet in FIG. 5.

FIG. 4 is a perspective view illustrating the base cabinet 1310 and main components mounted on the base cabinet 1310 in FIG. 1, and FIG. 5 illustrates the main components in FIG. 4 separated from the base cabinet 1310, and FIG. 6 is a planar view of the base cabinet 1310 in FIG. 5.

Referring to FIGS. 4 to 6, the base cabinet 1310 that provides a space in which various parts or components including the heat pump cycle devices 1100 are mounted is disposed below the drum 1030. A bottom surface of the base cabinet 1310 may define the bottom surface of the clothes treatment apparatus 1000.

The base cabinet 1310 is provided with a drum motor mounting portion (or part) 1314, a compressor mounting portion 1315, the base flow path 1310', and a condensate water collection part 1316. The drum motor mounting portion 1314 and the compressor mounting portion 1315 are disposed at one side of the base flow path 1310'. In this embodiment, the drum motor mounting portion 1314 and the compressor mounting portion 1315 are disposed at a front left and a rear side of the base flow path 1310', respectively.

The drum motor 1800 that generates a driving force for rotating the drum 1030 is mounted on the drum motor mounting portion 1314. A belt (not shown) that allows the driving force of the drum motor 1800 to be transferred to the drum 1030 may be connected to the drum motor 1800. The belt may be disposed to surround an outer circumference of the drum 1030.

A pulley 1810 and a spring (not shown) may be used to adjust tension applied to the belt.

The pulley 1810 may be configured to apply a specific or predetermined tension to the belt. The pulley 1810 is configured to be rotatable with respect to the drum motor mounting portion 1314 or a bracket (not shown) mounted on the drum motor mounting portion 1314.

In order to adjust the tension of the belt, the drum motor 1800 may be configured to rotate centered on one axis within a predetermined angle range and to be returned to an initial position by elasticity of the spring. To this end, the drum motor 1800 may be configured to rotate centered on one axis with respect to the drum motor mounting portion 1314, and the spring may be connected to the drum motor mounting portion 1314 and the drum motor 1800.

The blower fan 1820 may be mounted to a shaft of the drum motor 1800. In this embodiment, the belt is connected to a shaft provided on one side of the drum motor 1800, and the blower fan 1820 is mounted to a shaft provided on another side of the drum motor 1800. The shafts provided on both sides of the drum motor 1800 are rotated in the same direction and at the same speed.

Providing two shafts for one drive motor 1730 may be more advantageous in terms of improving power consumption of the clothes treatment apparatus 1000. Power consumption may be reduced by half than the case in which a drive motor 1730 for rotating the drum 1030 and a drive motor 1730 for rotating the blower fan 1820 are provided.

In particular, a time point at which the blower fan 1820 is required to rotate is the same as a time point at which the drum 1030 rotates. This is because hot and dry air is supplied to the drum 1030 while the drum 1030 is rotating, and hot and humid air may leak from the drum 1030. Therefore, there is no such case where rotation of any one of the drum 1030 or the blower fan 1820 is only required.

In this embodiment, the blower fan 1820 is configured as an axial fan to blow air toward the front of the cabinet 1010. However, the present disclosure is not limited thereto. For example, the blower fan 1820 may be implemented as a sirocco fan.

The blower fan 1820 is rotated when the drum motor 1800 is driven, so as to blow air in an inner space between the cabinet 1010 and the drum 1030. Accordingly, air slightly leaking into a gap between the drum 1030 and the front supporter 1040, and a gap between the drum 1030 and the rear supporter 1050 flows from the inner space by the blower fan 1820. Thus, dew condensation caused by air stagnation may be reduced.

Meanwhile, a heat dissipation fan may be mounted on a circuit board constituting the control unit. The heat dissipation fan forms a circulation flow for circulating air in the inner space between the cabinet 1010 and the drum 1030 together with the blower fan 1820 while dissipating elements or devices mounted on the circuit board. The heat dissipation fan may be located at an upper side of the base flow path 1310' and configured to blow air downward, that is, toward the base flow path 1310'.

Based on a center of the drum 1030, the heat dissipation fan may be disposed at an opposite side of the blower fan 1820, so as to define a circulation flow surrounding the drum 1030 together with the blower fan 1820. For example, the blower fan 1820 may be disposed at a lower left part of the drum 1030, and the heat dissipation fan may be disposed at an upper right of the drum 1030.

An exhaust fan 1750 is installed at the cabinet 1010 to discharge air in the space between the cabinet 1010 and the drum 1030 to the outside. That is, air leaking from the drum 1030 is discharged to the outside while continuously flowing by the blower fan 1820 and the heat dissipation fan (not shown). The exhaust fan 1750 may be located at the rear of the heat dissipation fan. In this embodiment, the exhaust fan 1750 is installed at a rear wall of the cabinet 1010 located at the rear of the heat dissipation fan.

The compressor 1120 that generates compressed air for heat exchange is mounted on the compressor mounting portion 1315. The compressor 1120 is one element constituting the heat pump cycle devices 1100, but does not directly exchange heat with air. Thus, the compressor 1120 does not need to be installed in the base flow path 1310'. Rather, if the compressor 1120 is installed in the base flow path 1310', it may interfere with the flow of air. Therefore, the compressor 1120 may be, preferably, installed outside the base flow path 1310'.

A refrigerant is evaporated (liquid→gaseous) while absorbing heat in the evaporator 1110 and becomes a low-temperature and low-pressure gaseous state to be sucked into the compressor 1120. A gas-liquid separator 1140 is installed at an upstream side of the compressor 1120 based on the flow of refrigerant. The gas-liquid separator 1140 separates a refrigerant introduced in the compressor 1120 into a gas phase and a liquid phase so that only a gaseous refrigerant is introduced into the compressor 1120. Accordingly, a trouble (breakdown) or a decrease in efficiency due to a liquid refrigerant flowing into the compressor 112 may be prevented.

A fixing rib 1315' for fixing the compressor 1120 is provided at the compressor mounting portion 1315, at least three points thereof. In order to reduce vibration, the fixing rib 1315' may extend to a rear surface of the compressor mounting portion 1315 by penetrating therethrough. The fixing rib 1315' extending to the rear surface of the compressor mounting portion 1315 does not touch a bottom surface thereof.

A support rib 1315" for supporting the compressor 1120 may be provided at the compressor mounting portion 1315. The support rib 1315" may be configured by a combination of a portion radially extending from a center of a virtual polygon formed by connecting the plurality of fixing ribs 1315' and portions forming a concentric circle with respect to the center.

A compressor cooling fan 1720 may be installed adjacent to the compressor 1120. The compressor cooling fan 1720 is configured to generate wind toward the compressor 1120 or suck air around the compressor 1120 to blow. A temperature of the compressor 1120 may be reduced by the compressor cooling fan 1720. This may result in enhancing compression efficiency. In this embodiment, the compressor cooling fan 1720 is installed at the rear wall of the cabinet 1010 located at the rear side of the compressor 1120.

The base flow path 1310' defines a part of the circulation flow path 1200. Based on the flow of air, the base flow path 1310' is divided into the guide portion 1311, the heat exchange unit 1312, and the circulation fan accommodating portion 1313. The evaporator 1110 and the condenser 1130 are disposed at the heat exchange unit 1312, and the circulation fan 1710 is disposed at the circulation fan accommodating portion 1313 to face the condenser 1130.

The guide portion 1311 corresponds to a portion into which air discharged from the front opening 1030' of the drum 1030 is introduced. The guide portion 1311 is provided with an opening open upward, and the opening is in communication with the front duct connector 1210. A direction of air flowing downward through the front duct connector 1210 is changed from the guide portion 1311 to the rear of the base cabinet 1310 so as to be introduced into the heat exchange unit 1312.

The heat exchange unit 1312 corresponds to a portion in which the evaporator 1110 that removes moisture from air introduced from the guide portion 1311 and the condenser 1130 that heats the air with moisture removed are installed. The heat exchange unit 1312 may linearly extend from the front to the rear of the base cabinet 1310.

A refrigerant compressed by the compressor 1120 becomes a high-temperature and high-pressure state to flow into the condenser 1130. In the condenser 1130, the refrigerant is liquefied by releasing heat. The liquefied high-pressure refrigerant is depressurized in an expander (not shown). Then, the liquid refrigerant with low temperature and low pressure flows into the evaporator 1110.

The circulation fan accommodating portion 1313 corresponds to a portion in which the circulation fan 1710 that sucks and blows air that has passed through the heat exchanger 1312 is accommodated. The circulation fan 1710 is disposed such that the rotating shaft faces the condenser 1130 and the evaporator 1110 and configured as a sirocco fan that laterally blows air in the front, namely, heated air after passing through the condenser 1130.

The hot dry air that has passed through the condenser 1130 is supplied to the drum 1030 through the rear duct connector 1220 by passing through an accommodating portion of the blower fan 1820. The hot and dry air supplied to the drum 1030 evaporates moisture from an object to be treated and becomes hot and humid air. The hot and humid air is recovered through the front duct connector 1210, and exchanges heat with a refrigerant in the evaporator 1110 to become low-temperature air. Here, as the temperature of the air is decreased, the amount of saturated water vapor in the air is reduced, and moisture contained in the air is condensed. Then, the low-temperature and dry air exchanges heat with a refrigerant in the condenser 1130 to become high-temperature and dry air to be supplied to the drum 1030 again.

The evaporator 1110, the condenser 1130, and the circulation fan 1710 mounted on the base flow path 1310' are eccentric to one side from a center of the base cabinet 1310. That is, in the base flow path 1310, a flow path after the guide portion 1311 extends rearward from a position eccentric to one side from the center of the base cabinet 1310.

The condensate water collection part 1316 is provided between the base flow path 1310' and the compressor mounting portion 1315. The condensate water collection part 1316 may communicate with the base flow path 1310' to define a space to which condensate water generated in the evaporator 1110 is recovered. In this embodiment, the condensate water collection part 1316 is configured to communicate with the heat exchange unit 1312.

The water pump 1440 is installed in the condensate water collection part 1316. The water pump 1440 is configured to transfer condensate water collected in the condensate water collection part 1316 to the water tank 1410. The condensate water transferred to the water tank 1410 may be transferred by the water pump 1440 to be used for cleaning the evaporator 1110.

The condensate water collection part 1316 may be formed as a partitional wall protruding from one surface of the base cabinet 1310, or may be recessed from one surface of the base cabinet 1310 as illustrated in this embodiment.

A communication hole 1316' that provides communication between the heat exchange unit 1312 and the condensate water collection part 1316 may be formed at one rear end of the condenser 1130. Condensate water generated in the evaporator 1110 falls or drops to a bottom surface of the heat exchange unit 1312 and is then introduced into the condensate water collection part 1316 through the communication hole 1316'. The heat exchange unit 1312 may be inclined toward the communication hole 1316' so that the condensate water is moved to a communication hole **1313*a*"** by gravity.

Figure 7:
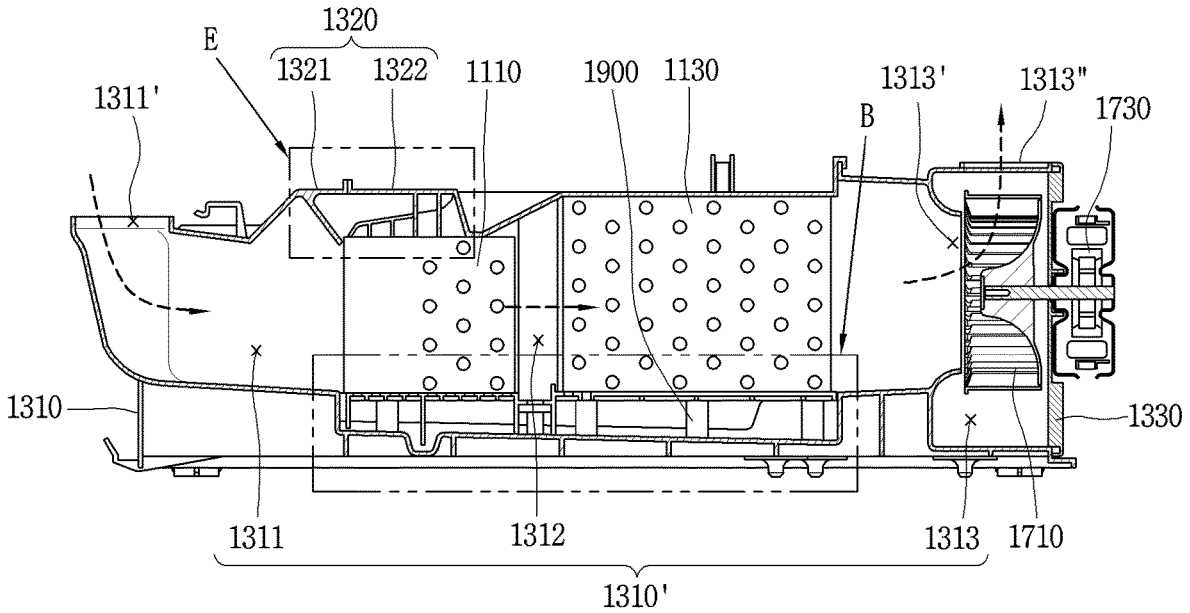
FIG. 7 is a cross-sectional view taken along line "A-A" of FIG. 4.
Figure 8:
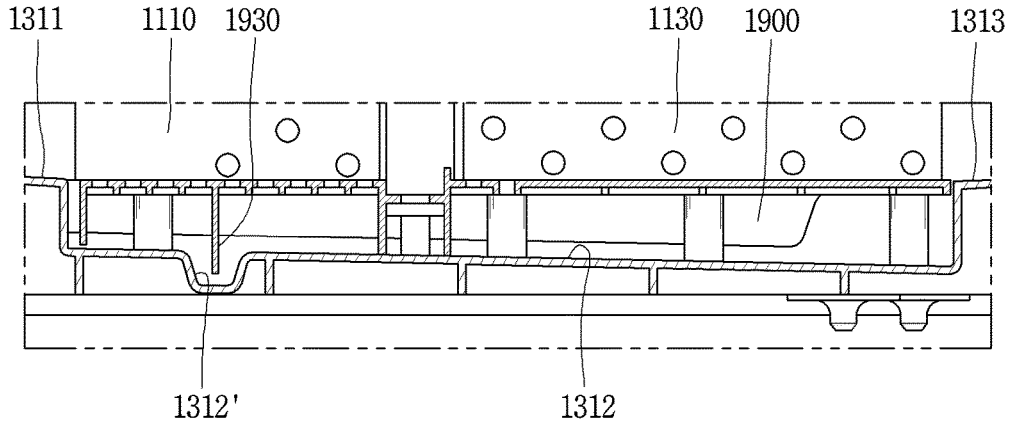
FIG. 8 is an enlarged view of an area "B" of FIG. 7.
Figure 9:
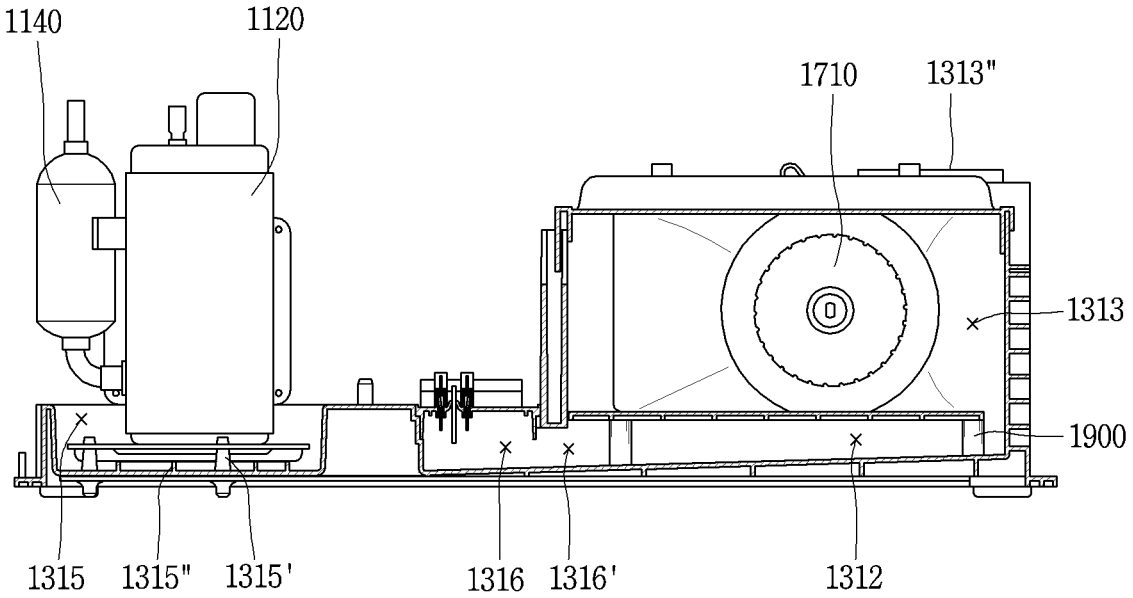
FIG. 9 is a cross-sectional view taken along line "C-C" of FIG. 4.

FIG. 7 is a cross-sectional view taken along line "A-A" of FIG. 4, FIG. 8 is an enlarged view of an area "B" of FIG. 7, and FIG. 9 is a cross-sectional view taken along line "C-C" of FIG. 4.

Referring to FIGS. 7 and 8, a water cover 1900 is mounted on the bottom surface of the heat exchange unit 1312. The water cover 1900 provides a space in which the evaporator 1110 and the condenser 1130 are disposed to be spaced apart from the bottom surface. A detailed structure of the water cover 1900 will be described hereinafter.

The bottom surface of the heat exchange unit 1312 is inclined downward to the rear. In addition, a bottom surface of the base flow path 1310' on which the condenser 1130 is disposed is inclined downward to one side of the condenser 1130 in which the communication hole 1316' is formed. Due to this inclined structure, condensate water that has fallen to the bottom surface of the heat exchange unit 1312 on which the evaporator 1110 is disposed flows toward the bottom surface of the heat exchange unit 1312 in which the condenser 1130 is disposed, and is then introduced into the condensate water collection part 1316 through the communication hole 1316'.

A U trap is provided beneath the evaporator 1110. The U trap includes a trap groove 1312' formed on the bottom surface of the heat exchange unit 1312 at which the evaporator 1110 is disposed, and a trap film 1930 extending downward from the water cover 1900 and inserted into the trap groove 1312'.

The trap groove 1312' has a shape recessed from the surrounding bottom surface. The trap groove 1312' extends from one side to another side of the heat exchange unit 1312 of the evaporator 1110 in a width direction.

The trap film 1930 extends from one side to another side of the water cover 1900 in a width direction, so as to cross the base flow path 1310'.

An end of the trap film 1930 is inserted into the trap groove 1312' and is located lower than the surrounding bottom surface. However, the end of the trap film 1930 does not touch a bottom surface of the trap groove 1312'. Accordingly, a 'U'-shaped space is formed in the trap groove 1312' by the end of the trap film 1930.

Condensate water generated in the evaporator 1110 falls to the bottom surface and flows rearward by the above-described inclined structure. Here, part (or some) of the condensate water flows into the trap groove 1312' so that the trap groove 1312' is filled with the condensate water.

The end of the trap film 1930 extending to an inside of the trap groove 1312' is immersed in the condensate water collected in the trap groove 1312'. Accordingly, a space between a lower part of the evaporator 1110 and the bottom surface of the base flow path 1310' is completely blocked by the condensate water collected in the trap film 1930 and the trap groove 1312'.

This U trap may prevent air leakage into the lower part of the evaporator 1110. That is, the U trap seals a flow path formed beneath the evaporator 1110, so as to allow most of the air flowing into the heat exchange unit 1312 after passing through the guide portion 1311 to be involved in heat exchange with the evaporator 1110. Accordingly, condensation efficiency of air passing through the evaporator 1110 may be increased.

Figure 10:
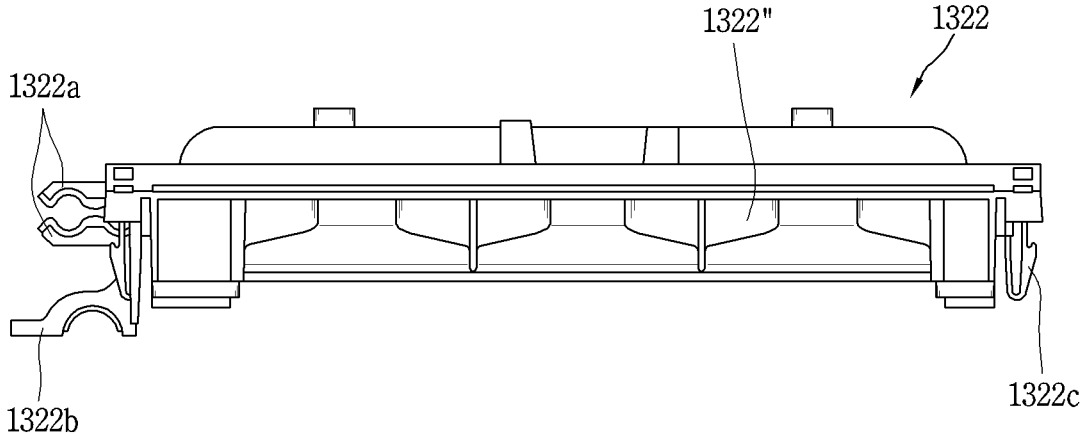
FIG. 10 is a front view of a rear cover in FIG. 5.
Figure 11:
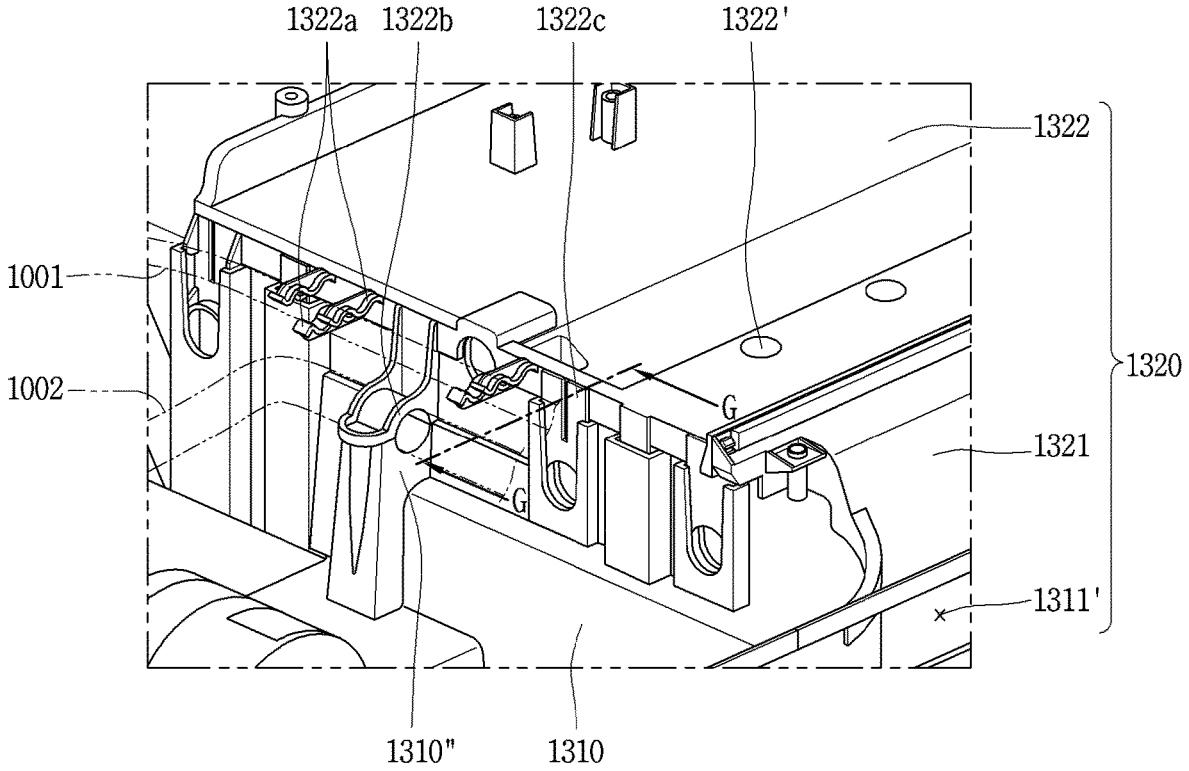
FIG. 11 is an enlarged view of an area "D" of FIG. 4.

FIG. 10 is a front view of the rear cover 1070 in FIG. 5, and FIG. 11 is an enlarged view of an area "D" of FIG. 4.

Referring to FIGS. 10 and 11, the base cover 1320 is mounted on the base cabinet 1310 to cover the base flow path 1310'. The base cover 1320 may include the front base cover 1321 and the rear base cover 1322.

The rear base cover 1322 is disposed to cover the evaporator 1110 and the condenser 1130 mounted on the base flow path 1310', and the front base cover 1321 is provided to cover the base flow path 1310' at the front of the rear base cover 1322.

The front base cover 1321 forms an opening 1311' open upward together with the base flow path 1310'. The opening 1311' communicates with the front duct connector 1210 extending downward so as to guide air discharged from the front opening 1030' of the drum 1030 to flow downward.

As the front base cover 1321 and the rear base cover 1322 are coupled to the base flow path 1310', an air flow path from the opening 1311' to the exhaust port 1313" is completed or achieved. The air flow path may also be referred to as the connection duct 1230 (see FIG. 2).

The rear base cover 1322 is provided with an inlet hole 1322' into which condensate water of the condensate water collection part 1316 is introduced, and a nozzle (or nozzle portion) 1322" that sprays the condensate water introduced through the inlet hole 1322'. The nozzle 1322" is open toward the front of the base flow path 1310'.

In the front base cover 1321, a guide (or guide part) 1321' is disposed to face the nozzle 1322" and is inclined toward the evaporator 1110. The guide 1321' changes a direction of condensate water sprayed from the nozzle 1322" so as to be directed to the evaporator 1110. The guide 1321' may be inclined toward an upper front end of the evaporator 1110.

Figure 12:
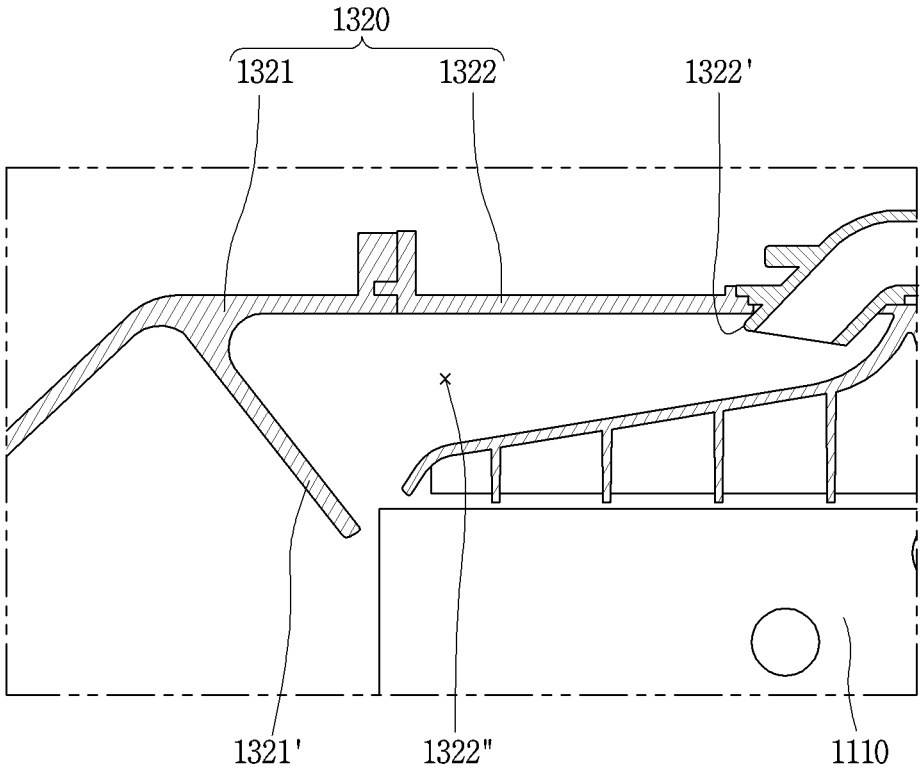
FIG. 12 is an enlarged view of an area "E" of FIG. 7.

FIG. 12 is an enlarged view of an area "E" of FIG. 7.

Referring to FIG. 12, the rear base cover 1322 may be provided with a harness fixing portion 1322*a* that allows a wiring 1001 to be neatly or properly arranged. In this embodiment, the harness fixing portion 1322*a* protrudes from one surface of the rear base cover 1322.

The harness fixing portion 1322*a* is provided in plurality to be spaced apart from each other along one surface. The plurality of harness fixing portions 1322*a* may be alternately disposed in a vertical direction along one surface so that any one of the plurality of harness fixing portions 1322*a* supports the wiring 1001 from below, and the other one covers the wiring 1001 from above.

One surface of the harness fixing portion 1322*a* may be formed in a concave-convex (凹凸) shape. In detail, an upper surface of the harness fixing portion 1322*a* that supports the wiring 1001 from below may be formed in a concave-convex shape, and a lower surface of the harness fixing portion 1322*a* that covers the wiring 1001 may be formed in a concave-convex shape. When the harness fixing portion 1322*a* has this shape, a part of the wiring 1001 is accommodated in a relatively recessed portion, so that lateral movement of the wiring 1001 may be limited or restricted.

In addition, a structure for fixing a pipe 1002 that constitutes a heat pump system may be achieved by coupling between the base flow path 1310' and the rear base cover 1322. The pipe 1002 may be a pipe that connects the compressor 1120 and the condenser 1130, or may be a pipe that connects the evaporator 1110 and the compressor 1120.

More specifically, in the structure for fixing the pipe 1002, a pipe accommodating portion 1310" with a semicircular shape may be formed at one side of the base flow path 1310', and a pipe cover portion 1322*b* with a semicircular shape may be provided at the rear base cover 1322. When the rear base cover 1322 is mounted on the base flow path 1310', the pipe cover portion 1322*b* is disposed to cover the pipe accommodating portion 1310", so as to define a circular opening together with the pipe accommodating portion 1310".

A part of the pipe 1002 constituting the heat pump system is seated or placed on the pipe accommodating portion 1310", and its position is fixed by being covered by the pipe cover portion 1322*b*. That is, the pipe accommodating portion 1310" and the pipe cover portion 1322*b* are configured to surround a part of the pipe 1002.

Figure 13:
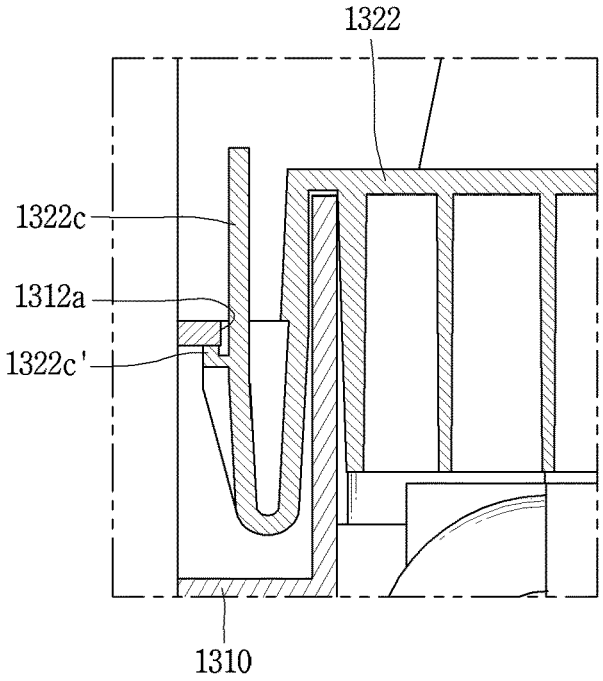
FIG. 13 is a cross-sectional view taken along line "G-G" of FIG. 11.

FIG. 13 is a cross-sectional view taken along line "G-G" of FIG. 11.

Referring to FIG. 13, the rear base cover 1322 may be coupled to the base flow path 1310' by a screw and a hook. Since the coupling structure through the screw is obvious to those skilled in the art, a description thereof will be omitted.

The rear base cover 1322 may be provided with a hook 1322*c* having elasticity. A plurality of hooks 1322*c* may be provided at both side surfaces of the rear base cover 1322. In this embodiment, the hook 1322*c* is shown to be formed in a 'U' shape to be elastically deformable inward.

An insertion groove 1312*a* into which a part of the hook 1322*c* is inserted is formed in the base flow path 1310'. The insertion groove 1312*a* extends in the vertical direction.

The hook 1322*c* is elastically deformed inward to be inserted into the insertion groove 1312*a* by a predetermined depth. When the hook 1322*c* is elastically deformed outward by the restoring force, a protrusion 1322*c'* formed on the hook 1322*c* is engaged (or caught) in the insertion groove 1312*a*. Accordingly, the hook 1322*c* is fixed while being inserted into the insertion groove 1312*a*.

Figure 14:
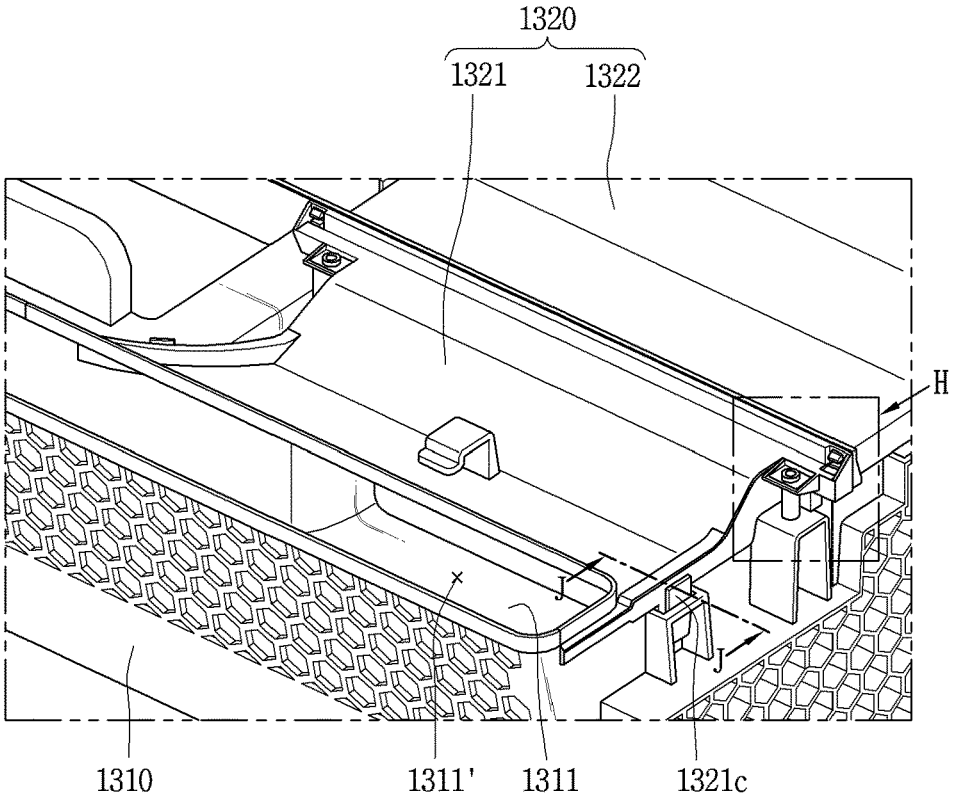
FIG. 14 illustrates a front base cover in FIG. 4, viewed from a different direction.
Figure 15:
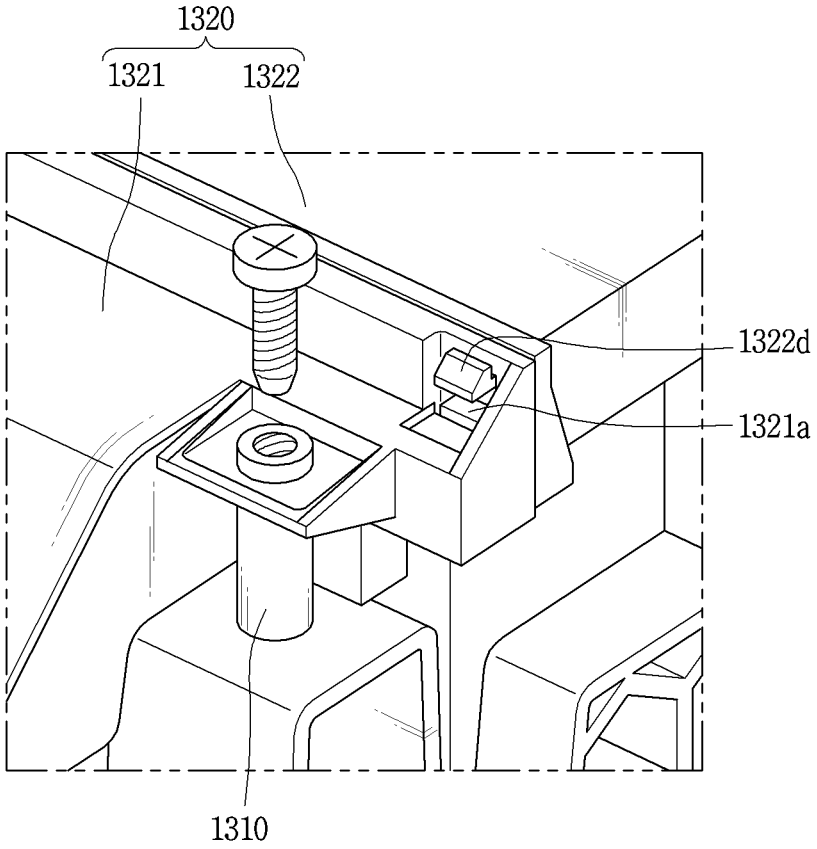
FIG. 15 is an enlarged view of an area "H" of FIG. 14.
Figure 16:
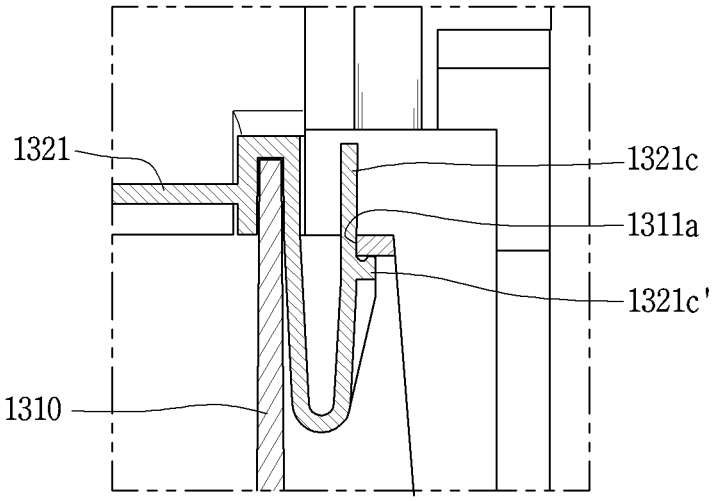
FIG. 16 is a cross-sectional view taken along line "J-J" of FIG. 14.

FIG. 14 illustrates the front base cover 1321 in FIG. 4, viewed from different direction, FIG. 15 is an enlarged view of an area "H" of FIG. 14, and FIG. 16 is a cross-sectional view taken along line "J-J" of FIG. 14.

Referring to FIGS. 14 to 16, the front base cover 1321 may be coupled to the base flow path 1310' by a screw or hook. Since the coupling structure through the screw is obvious to those skilled in the art, a description thereof will be omitted.

The front base cover 1321 may be provided with a hook 1321*c* having elasticity. The hook 1321*c* may be provided at both sides of the front base cover 1321. In this embodiment, the hook 1321*c* is shown to be formed in a 'U' shape to be elastically deformable inward.

An insertion groove 1311*a* into which a part of the hook 1321*c* is inserted is formed in the base flow path 1310'. The insertion groove 1311*a* extends in the vertical direction.

The hook 1321*c* is elastically deformed inward to be inserted into the insertion groove 1311*a* by a predetermined depth. When the hook 1321*c* is elastically deformed outward by the restoring force, a protrusion 1321*c'* formed on the hook 1321*c* is engaged in the insertion groove 1311*a*. Accordingly, the hook 1321*c* is fixed while being inserted into the insertion groove 1311*a*.

In addition, the front base cover 1321 is coupled to the rear base cover 1322. They may be coupled to each other by a hook. In this embodiment, the rear base cover 1322 is provided with an engaging hook 1322*d* protruding forward, and the front base cover 1321 is provided with an engaging hole 1321*a* through which the engaging hook 1322*d* is inserted and engaged.

Figure 17:
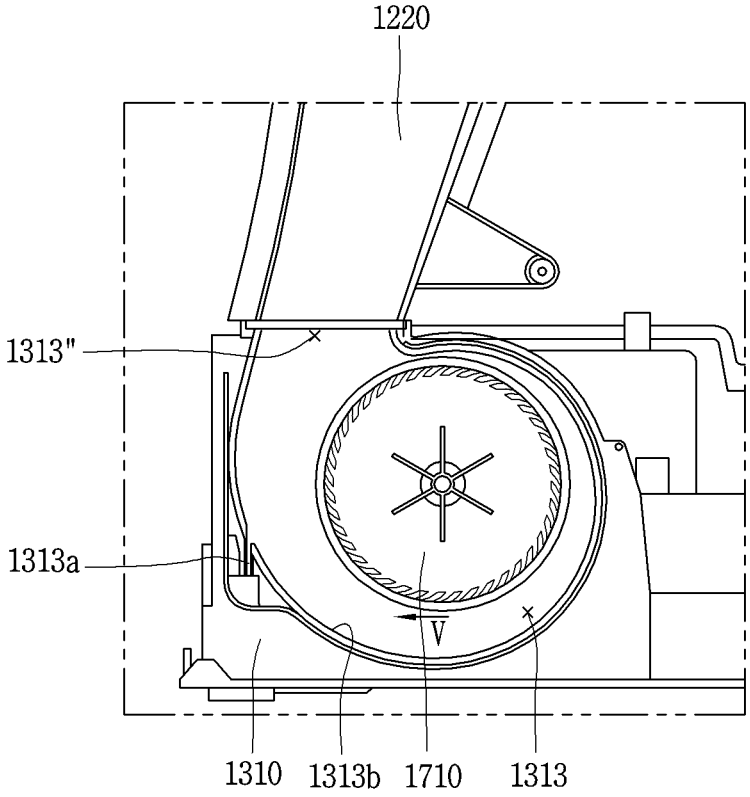
FIG. 17 is a rear view of a circulation fan accommodating portion in FIG. 5.
Figure 18:
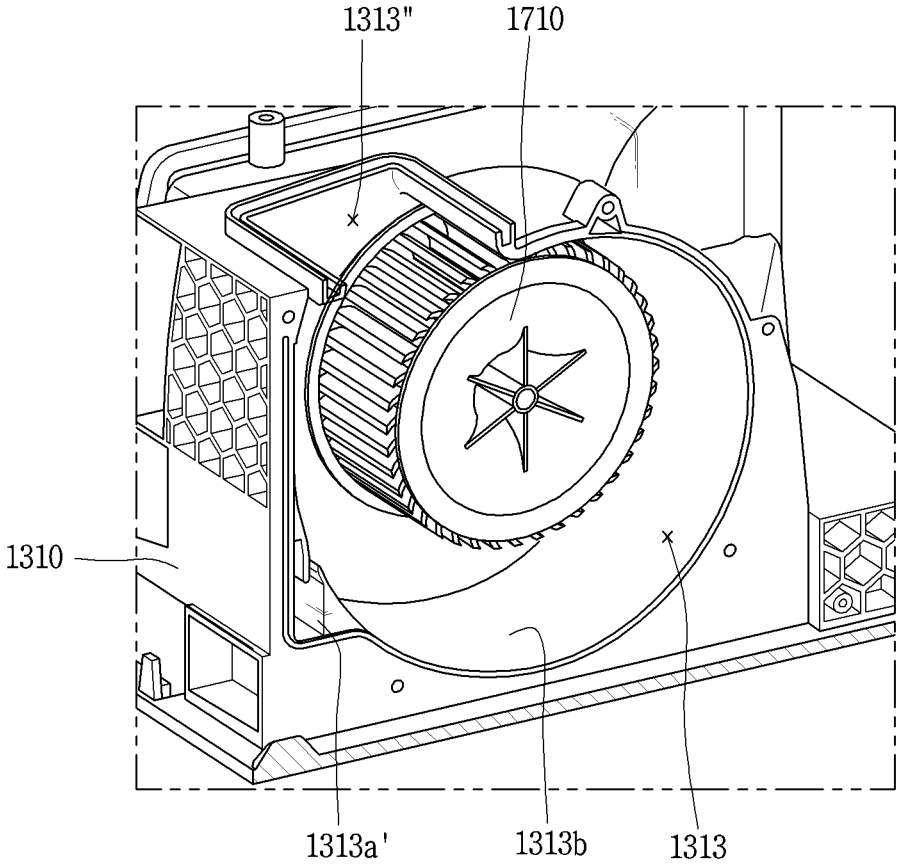
FIG. 18 is a perspective view of the circulation fan accommodating portion in FIG. 5, viewed from the rear.
Figure 19:
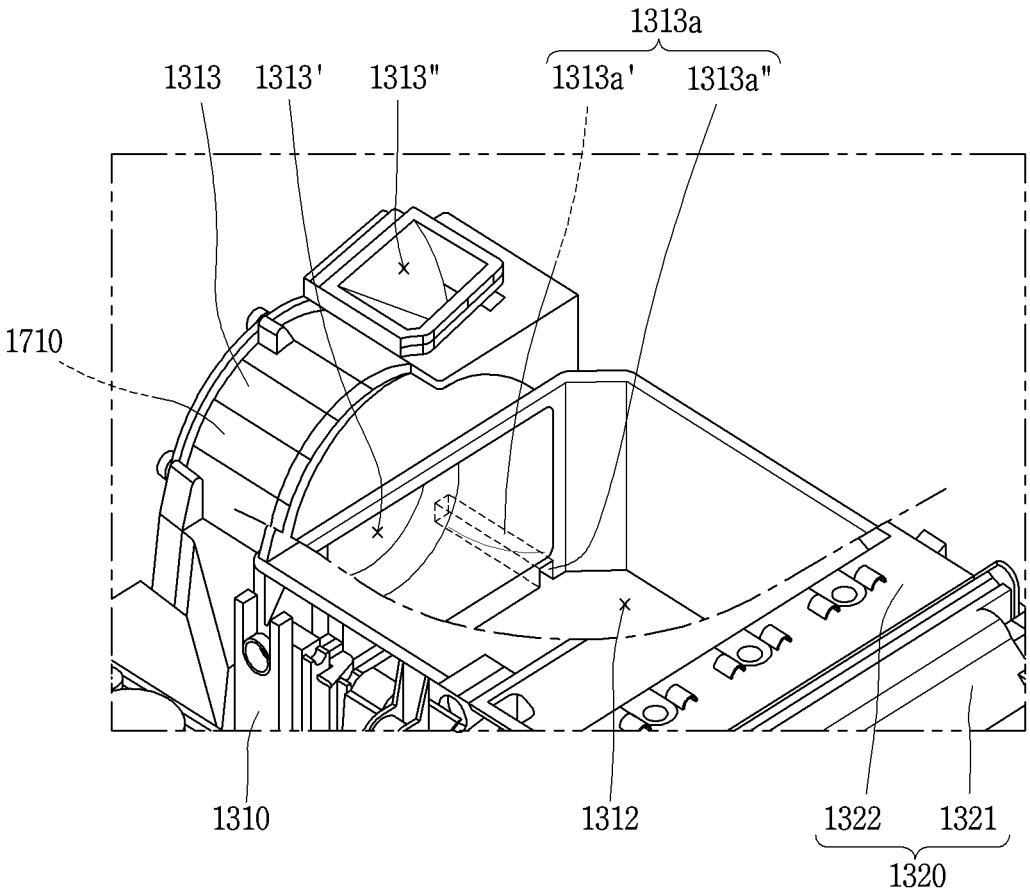
FIG. 19 is a perspective view of the circulation fan accommodating portion in FIG. 4, viewed from the front.

FIG. 17 is a rear view of the circulation fan accommodating portion 1313 in FIG. 5, FIG. 18 is a perspective view of the circulation fan accommodating portion 1313 in FIG. 5, viewed from the rear, and FIG. 19 is a perspective view of the circulation fan accommodating portion 1313, viewed from the front.

Referring to FIGS. 17 to 19, the circulation fan 1710 is disposed between the condenser 1130 on the circulation flow path 1200 and the rear opening 1030" of the drum 1030. To this end, the circulation fan accommodating portion 1313 is provided at the base flow path 1310' in which the base cabinet 1310 is provided.

The circulation fan accommodating portion 1313 is located at the rear of the heat exchanger 1312 and provides a space for accommodating the circulation fan 1710. That is, the circulation fan 1710 is disposed at the rear of the condenser 1130 so as to suck and blow air heated by the condenser 1130.

The circulation fan accommodating portion 1313 includes an intake port 1313' opened forward to face the condenser 1130, and the exhaust port 1313" opened upward to be perpendicular to the intake port 1313'. The exhaust port 1313" is provided at one upper portion eccentric from a center of the circulation fan 1710.

Condensate water on the bottom surface of the heat exchange unit 1312 may be scattered or blown by a strong suction force of the circulation fan 1710. In this case, the condensate water may be introduced into the circulation fan 1710. If the introduced condensate water is not drained, driving reliability of the circulation fan 1710 is adversely affected. Thus, a structure that allows the condensate water introduced into the circulation fan 1710 to be smoothly drained should be provided.

A condensate water drain path 1313*a* is provided at one side of an inner circumferential surface 1313*b* of the circulation fan accommodating portion 1313 that surrounds an outer circumference of the circulation fan 1710, so as to allow condensate water introduced by the suction force of the circulation fan 1710 to be drained to the condenser 1130 side. The condensate water drain path 1313*a* communicates with the heat exchange unit 1312.

The condensate water drain path 1313*a* includes a side groove 1313*a'* and the communication hole 1313*a"*.

The side groove 1313*a'* is formed on the inner circumferential surface 1313*b* of the circulation fan accommodating portion 1313. The side groove 1313*a'* is recessed downward from an inclined portion of the inner circumferential surface 1313*b* of the circulation fan accommodating portion 1313, and extends toward the front. The side groove 1313*a'* may form a space in which a specific amount of condensate water is collected.

The circulation fan 1710 is configured as a sirocco fan that laterally blows air introduced from the front. Accordingly, condensate water introduced by the suction force is also discharged laterally. Further, condensate water that has dropped on the inner circumferential surface 1313*b* of the circulation fan accommodating portion 1313 is scattered laterally when the circulation fan 1710 is driven.

By considering this, the side groove 1313*a'* is formed on one side of the inner circumferential surface to which the tangent vector at the lowest point of the circulation fan 1710 is directed. When describing based on FIG. 18 in which the circulation fan accommodating portion 1313 is viewed from the rear, the circulation fan 1710 is configured to rotate in a clockwise direction (counterclockwise direction when viewed from the front), and a direction that the tangent vector faces at the lowest point of the circulation fan 1710 is the left. That is, when the circulation fan 1710 is driven, condensate water flows or moves to the left. Therefore, the side groove 1313*a'* is provided on a left inner circumferential surface.

At the lowest point of the circulation fan 1710, blades of the circulation fan 1710 are disposed to face the left side.

The side groove 1313*a'* is formed on a portion inclined to a left side from a lower end of the inner circumferential surface. That is, both sides of the side groove 1313*a'* are inclined in the same direction. Accordingly, the side groove 1313*a'* may collect condensate water scattered as the circulation fan 1710 rotates and flowing down along the inclined portion on the left side of the inner circumferential surface.

The communication hole 1313*a"* is formed on a front end of the side groove 1313*a'*, namely, in a partition wall that partitions the circulation fan accommodating portion 1313 and the heat exchange unit 1312. The communication hole 1313*a"* may be configured to provide a communication between the side groove 1313*a'* and the heat exchange unit 1312, namely, a space to which the condenser 1130 is mounted. Accordingly, condensate water collected through the side groove 1313*a'* is discharged to the condenser 1130 side through the communication hole 1313*a"*. The condensate water discharged to the condenser 1130 side is recovered to the condensate water collection part 1316.

Figure 20:
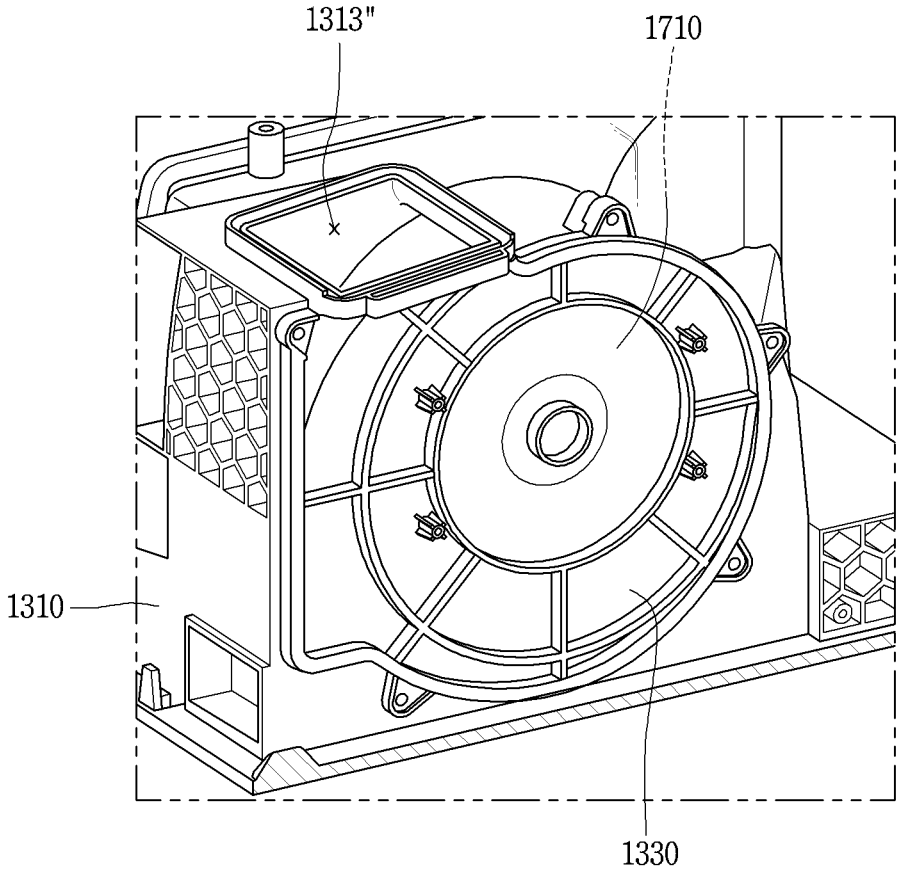
FIG. 20 illustrates a state in which a cover member is installed to cover a rear opening of the circulation fan accommodating portion in FIG. 18.
Figure 21:
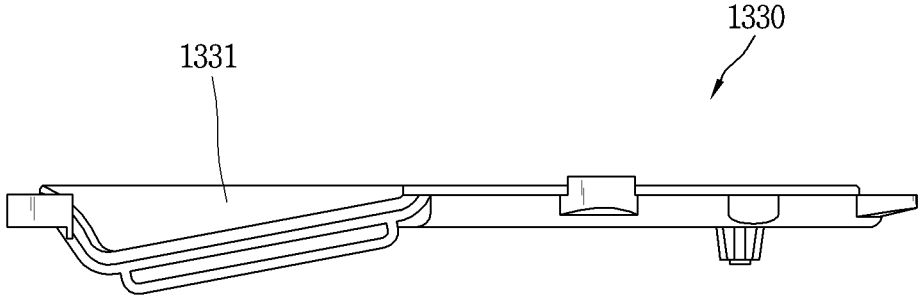
FIG. 21 is a planar view of the cover member in FIG. 20.

FIG. 20 illustrates a state in which the cover member 1330 is mounted in a manner of covering a rear opening 1030" of the circulation fan accommodating portion 1313 in FIG. 18 and FIG. 21 is a planar view of the cover member 1330 in FIG. 20.

Referring to FIGS. 20 and 21, the circulation fan accommodating portion 1313 is open rearward so as to allow the circulation fan 1710 to be accommodated therein through the rear opening 1030". The cover member 1330 is coupled to the circulation fan accommodating portion 1313 to cover the rear opening 1030", so as to cover the circulation fan 1710. By this arrangement, the cover member 1330 is disposed to face the intake port 1313' with the circulation fan 1710 interposed therebetween. The cover member 1330 may be coupled to the circulation fan accommodating portion 1313 by a screw or hook.

The cover member 1330 defines the exhaust port 1313" together with the circulation fan accommodating portion 1313. The exhaust port 1313" is open upward and connected to the rear duct connector 1220. An inclined portion 1331 inclined in a direction the same as an inclined inner surface of the rear duct connector 1220 may be provided at one surface of the cover member 1330 defining the exhaust port 1313" together with the circulation fan accommodating portion 1313. Air discharged through the exhaust port 1313" by the inclined portion 1331 may naturally flow into the rear duct connector 1220.

Figure 22:
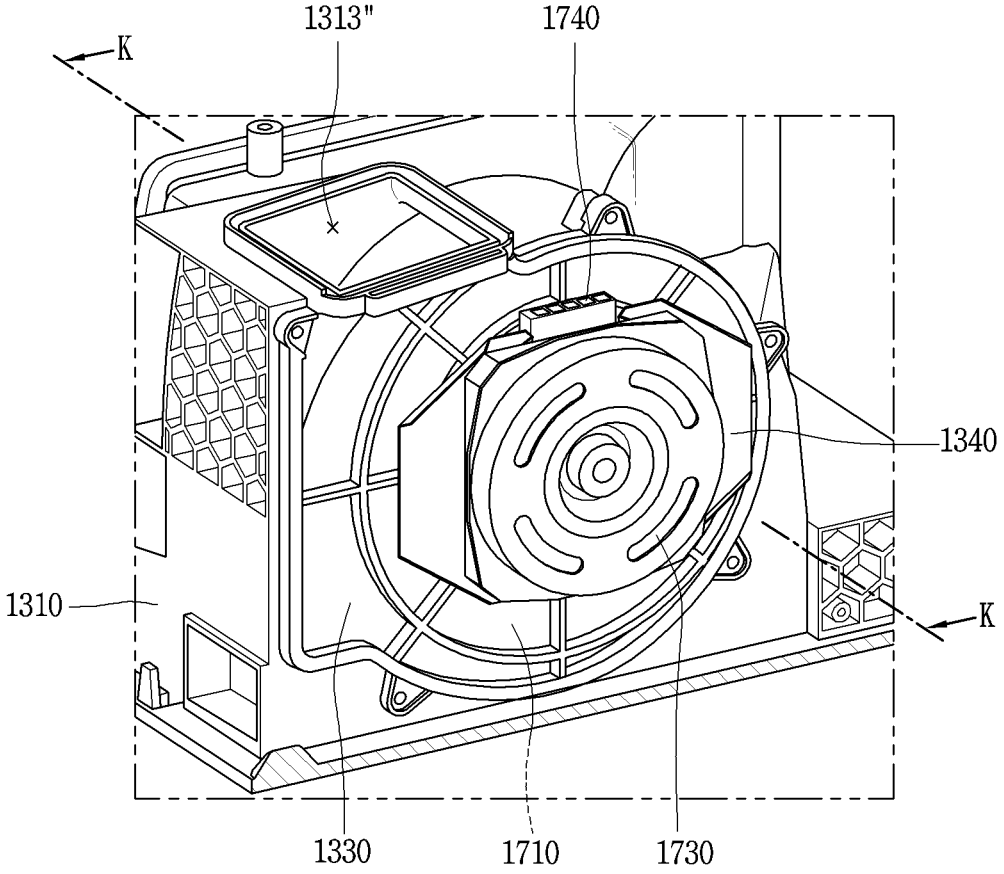
FIG. 22 illustrates a state in which a drive motor and a cover bracket are mounted on the cover member in FIG. 20.
Figure 23:
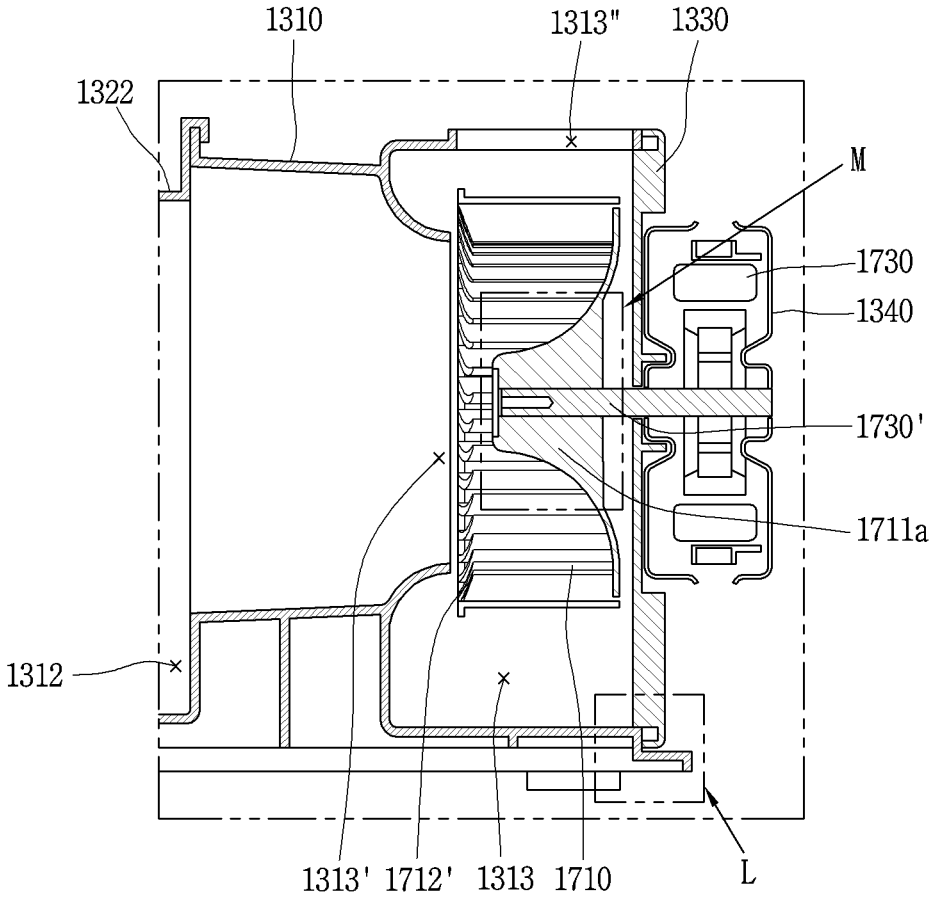
FIG. 23 is a cross-sectional view taken along line "K-K" of FIG. 22.

FIG. 22 illustrates a state in which the drive motor 1730 and a cover bracket 1340 are mounted on the cover member 1330 in FIG. 20, and FIG. 23 is a cross-sectional view taken along line "K-K" of FIG. 22.

Referring to FIGS. 22 and 23, the drive motor 1730 is mounted on an outer surface of the cover member 1330. A shaft 1730' of the drive motor 1730 is coupled to the circulation fan 1710 by penetrating through the cover member 1330.

The cover bracket 1340 is mounted on the cover member 1330 to cover the drive motor 1730, so as to fix the drive motor 1730 to the outer surface of the cover member 1330. The cover bracket 1340 may be coupled to the cover member 1330 by a screw or hook.

The drive motor 1730 is electrically connected to a power supply unit (not shown). To this end, a connector 1740 for electrical connection with the power supply unit may be connected to the drive motor 1730. The connector 1740 is configured to be connected to a mating connector 1740 exposed to the outside and connected to the power supply unit. In this embodiment, the connector 1740 is exposed between the cover member 1330 and the cover bracket 1340.

Figure 24:
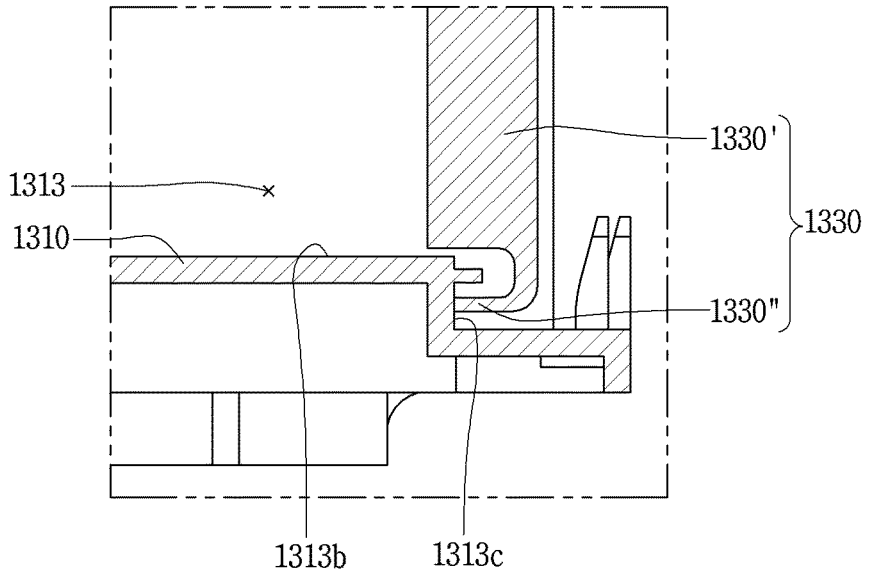
FIG. 24 is an enlarged view of an area "L" of FIG. 23.

FIG. 24 is an enlarged view of an area "L" of FIG. 23.

Referring to FIG. 24, the cover member 1330 has a coupling structure that seals the rear opening 1030" of the circulation fan accommodating portion 1313. To this end, the cover member 1330 includes a cover base 1330' and a sealing portion 1330".

The cover base 1330' is disposed to cover the rear opening 1030" of the circulation fan accommodating portion 1313. A part of the cover base 1330' may protrude forward than the sealing portion 1330", so as to be accommodated in the rear opening 1030" of the circulation fan accommodating portion 1313.

The sealing portion 1330" that is in surface contact with one surface of the circulation fan accommodating portion 1313 is provided along a periphery of the cover base 1330'. The sealing portion 1330" has a shape bent forward from an outside of the cover base 1330'. The sealing portion 1330 covers an extended surface that extends outward from the inner circumferential surface 1313*b* of the circulation fan accommodating portion 1313.

When the cover member 1330 is coupled to the circulation fan accommodating portion 1313, the sealing portion 1330" is pressed against the extended surface. For example, when a fastening member is coupled to the circulation fan accommodating portion 1313 by penetrating through the cover member 1330, the sealing portion 1330" is pressed against the extended surface to be brought into surface contact. Accordingly, leakage of condensate water introduced into the circulation fan accommodating portion 1313 through a gap between the circulation fan accommodating portion 1313 and the cover member 1330 may be suppressed.

Figure 25:
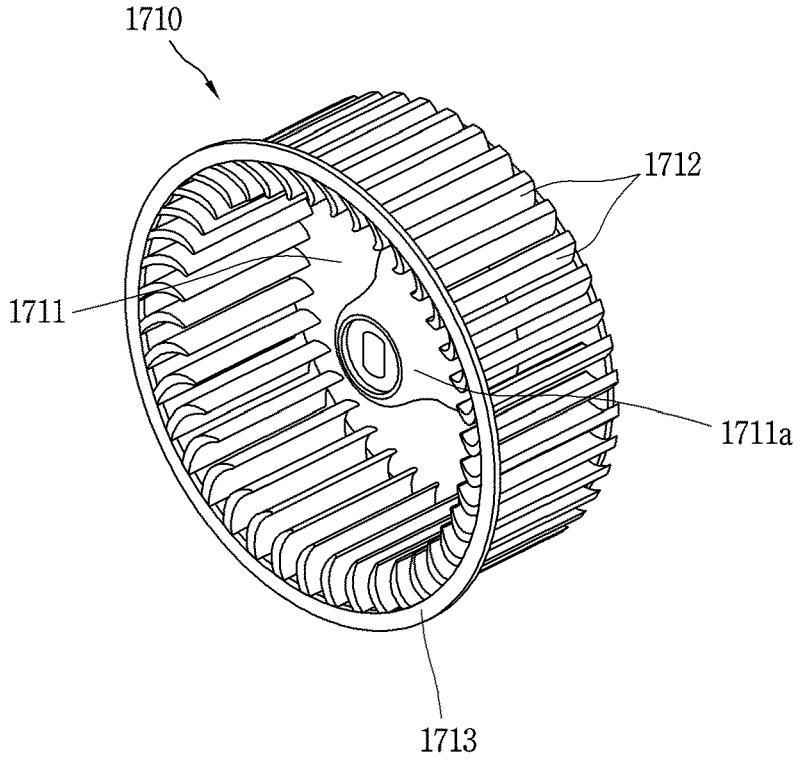
FIG. 25 is a perspective view of a circulation fan in FIG. 18, viewed from the front.
Figure 26:
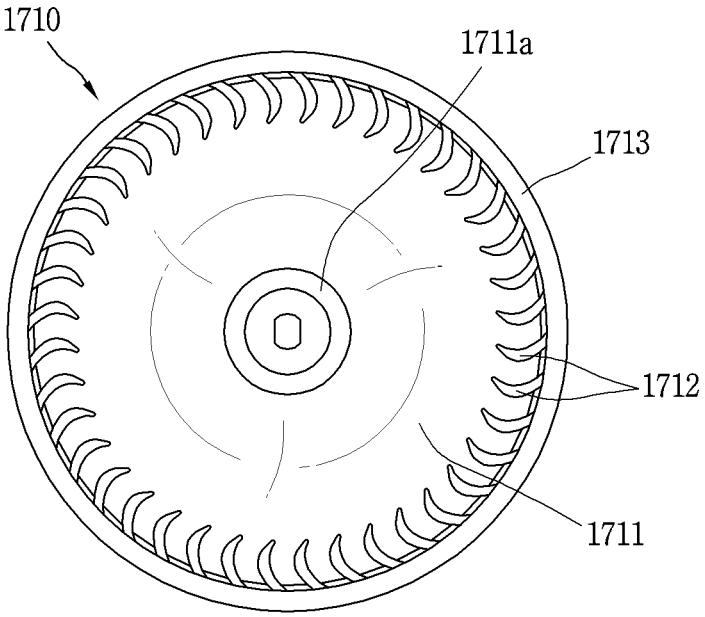
FIG. 26 is a front view of the circulation fan illustrated in FIG. 25.

FIG. 25 is a perspective view of the circulation fan 1710 in FIG. 18, viewed from the front, and FIG. 26 is a front view of the circulation fan 1710 in FIG. 25.

Referring to FIGS. 25 and 26, the circulation fan 1710 is configured as a sirocco fan that laterally blows air introduced from the front. The circulation fan 1710 is made of a synthetic resin material. The circulation fan 1710 includes a base portion 1711, a plurality of blade portions 1712, and a connection ring portion 1713.

The base portion 1711 is formed in a circular shape and is disposed to face the condenser 1130. A shaft coupling portion 1711*a* into which the shaft 1730' of the drive motor 1730 is inserted is provided at a central part of the base portion 1711.

The plurality of blade portions 1712 is arranged along an edge of the base portion 1711 at a predetermined interval or distance. The plurality of blade portions 1712 is configured to laterally blow air introduced into the base portion 1711 when the circulation fan 1710 rotates.

The blade portions 1712 protrude outward from an inside of the base portion 1711. That is, one end of the blade portion 1712 is located inside the base portion 1711, and another end of the blade portion 1712 is located outside the base portion 1711. The one end may be referred to as an inner end of the blade portion 1712 and the another end may be referred to as an outer end of the blade portion 1712.

A circular edge of the base portion 1711 may be located adjacent to the respective outer ends of the plurality of blade portions 1712 than the respective inner ends thereof. In other words, a length from the edge of the base portion 1711 to the inner end of the blade portion 1712 may be longer (greater) than a length from the edge of the base portion 1711 to the outer end of the blade portion 1712.

A distance from the center of the circulation fan 1710 to the respective inner ends of the plurality of blade portions 1712 is defined as an inner diameter of the circulation fan 1710, and a distance from the center of the circulation fan 1710 to the respective outer ends of the plurality of blade portions 1712 is defined as an outer diameter of the circulation fan 1710.

The blade portion 1712 has a shape that is bent at least at one point. The one point may be located in the base portion 1711.

The blade portion 1712 may be inclined to a rotational direction of the circulation fan 1710. In other words, the blade portion 1712 may be inclined to a direction that the tangent vector of a circle drawn by the circulation fan 1710 is directed.

Each of the plurality of blade portions 1712 may have a thickness that gradually decreases toward the inner end and the outer end. Alternatively, each of the plurality of blade portions 1712 may extend to a predetermined thickness. For example, the blade portion 1712 may extend while maintaining a thickness of 1.5 mm.

Referring back to FIG. 23, a chamfer (or chamfered) portion 1712' may be provided at a front edge of the plurality of blade portions 1712 facing the intake port 1313'. That is, as the chamfer portion 1712' inclined rearward is located immediately behind the intake port 1313', interference with the intake port 1313' may be prevented even if the circulation fan 1710 slightly moves forward while driving.

The connection ring portion 1713 is disposed to face the base portion 1711 and has a ring shape connecting the plurality of blade portions 1712. The connection ring portion 1713 may cover the respective outer ends of the plurality of blade portions 1712. The connection ring portion 1713 may be disposed not to overlap the base portion 1711 in a thickness direction of the circulation fan 1710.

Figure 27:
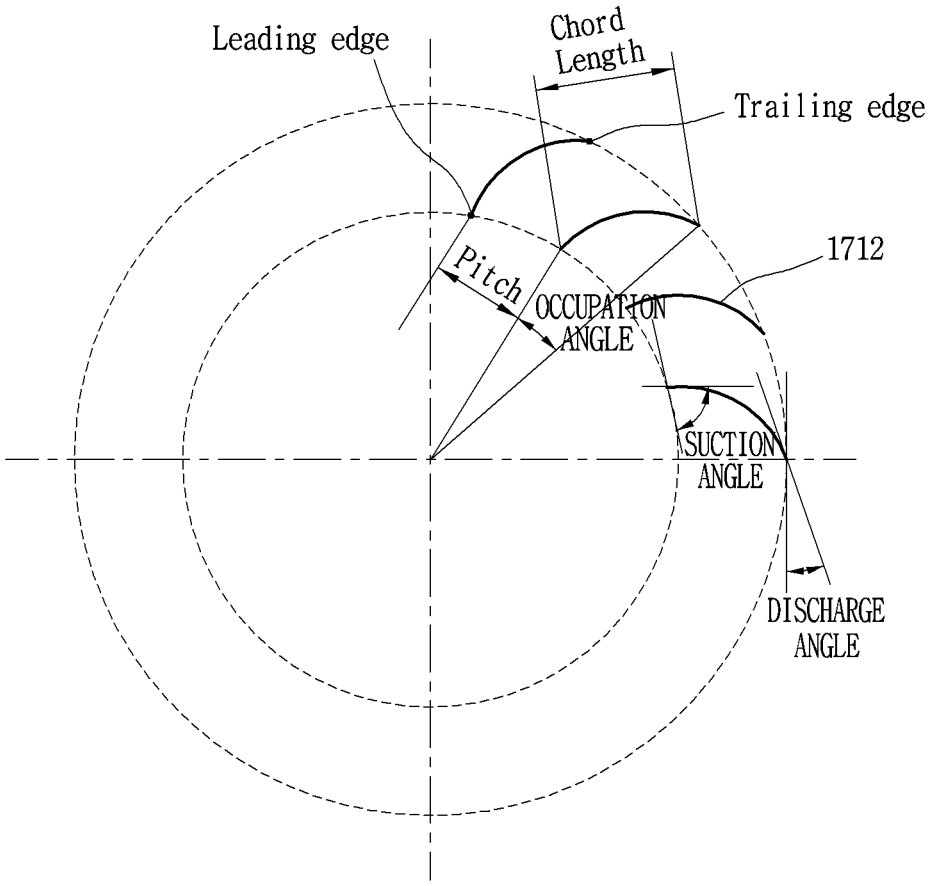
FIG. 27 is a conceptual view for explaining design requirements for blades of the circulation fan.

FIG. 27 is a conceptual view for explaining design requirements for blades of the circulation fan 1710.

Referring to FIG. 27, the inner diameter of the circulation fan 1710 may be, preferably, 45 to 55 mm. When the inner diameter of the circulation fan 1710 is less than 45 mm, an air volume is reduced. On the other hand, when the inner diameter of the circulation fan 1710 exceeds 55 mm, an excessive load is applied to the drive motor 1730. In this embodiment, the inner diameter of the circulation fan 1710 is set to 50 mm.

A total number of the plurality of blade portions 1712 may be 36 to 43. When the total number of the plurality of blade portions 1712 is 36 to 43, the air volume is decreased. In this embodiment, a total of 43 blades are provided for the plurality of blade portions 1712.

An angle formed by a virtual line that connects the center of the circulation fan 1710 and the inner end of the blade portion 1712, and a virtual line that connects the center of the circulation fan 1710 and the outer end of the blade portion 1712 is defined as an "occupation angle". The occupation angle may be, preferably, 7° to 10°. When the occupation angle is less than 7°, the air volume is reduced. On the other hand, when the occupation angle exceeds 10°, an excessive load is applied to the drive motor 1730, thereby generating noise in the circulation fan 1710. In this embodiment, the occupation angle is set to 7°.

At the inner end of the blade portion 1712, an angle between a tangent vector of a circle having an inner diameter (distance from the center of the circulation fan 1710 to the inner end of the blade portion 1712) as a radius and a tangent vector of the inner end is defined as a "suction angle". The suction angle may be, preferably, 42° to 46°. When the suction angle is less than 42°, a suction air volume is decreased. In contrast, when the suction angle exceeds 46°, an excessive load is applied to the drive motor 1730, and thus noise is generated in the circulation fan 1710. In this embodiment, the suction angle is set to 46°.

At the outer end of the blade portion 1712, an angle between a tangent vector of a circle having an outer diameter (distance from the center of the circulation fan 1710 to the outer end of the blade portion 1712) as a radius and a tangent vector of the outer end is defined as a "discharge angle". The discharge angle may be, preferably, 18° to 27°. When the discharge angle is less than 18°, resistance received by the blade portion 1712 increases and thereby to reduce efficiency of the circulation fan 1710. On the other hand, when the discharge angle exceeds 27°, a discharge air volume is decreased. In this embodiment, the discharge angle is set to 27°.

Figure 28:
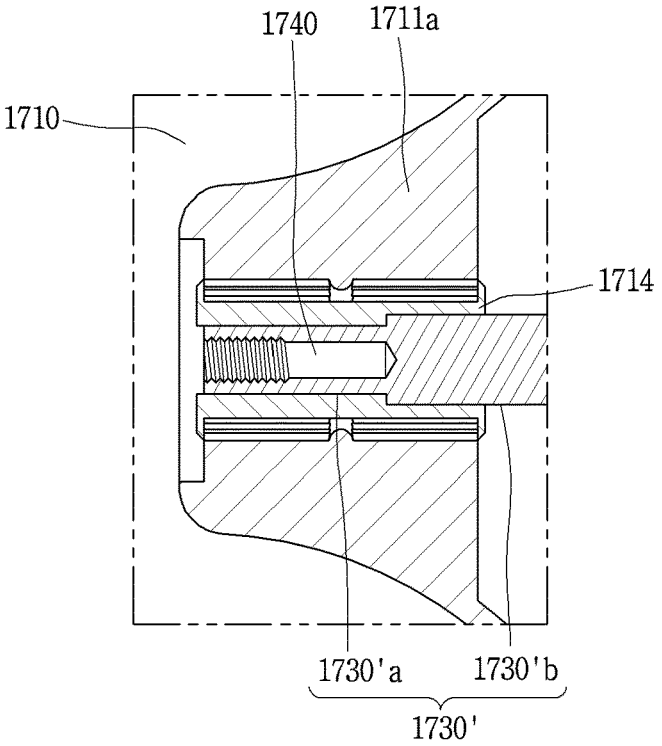
FIG. 28 is an enlarged view illustrating an area "M" of FIG. 23.
Figure 29:
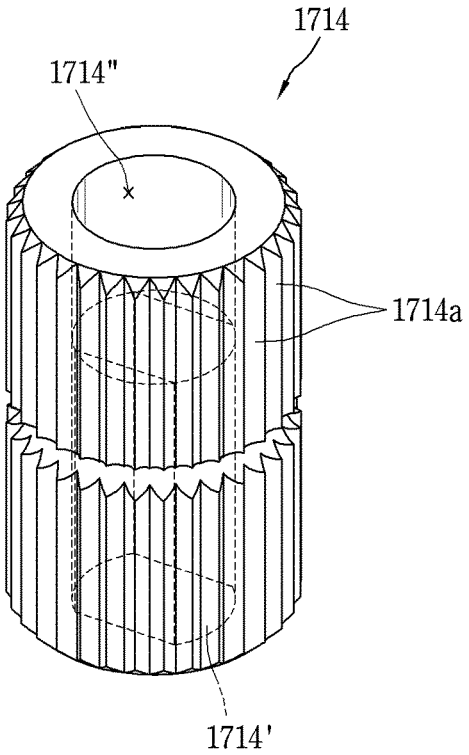
FIG. 29 is a perspective view of busing in FIG. 28.

FIG. 28 is an enlarged view illustrating an area "M" of FIG. 23, and FIG. 29 is a perspective view of busing 1714 in FIG. 28.

Referring to FIGS. 28 and 29, the circulation fan 1710 is provided with the shaft coupling portion 1711*a* to which the shaft 1730' of the drive motor 1730 is coupled. The shaft coupling portion 1711*a* may be formed at the central part of the base portion 1711 and have a shape protruding along the thickness direction of the circulation fan 1710.

The bushing 1714 for secure coupling with the shaft 1730' of the drive motor 1730 is mounted in the shaft coupling portion 1711*a*. The bushing 1714 is made of a metal material, so as to be integrally coupled to the shaft coupling portion 1711*a* made of a synthetic resin by double injection.

A groove 1714*a* is provided at an outer circumferential surface of the busing 1714 to be continuously formed along a circumference thereof, and a part of the shaft coupling portion 1711*a* is accommodated in the groove 1714*a* while the shaft coupling portion 1711*a*, which has melted by double injection, is hardening.

The busing 1714 is provided therein with a first insertion portion 1714' and a second insertion portion 1714" having different shapes. In this embodiment, the first insertion portion 1714' has a non-circular cross-section, and the second insertion portion 1714" has a circular cross-section. The first insertion portion 1714' may have a shape in which a part of the second insertion portion 1714" is filled. Accordingly, a stepped portion is formed between the first insertion portion 1714' and the second insertion portion 1714".

A cut portion 1730'*a* that corresponds to the first insertion portion 1714' and a non-cut portion 1730'*b* that corresponds to the second insertion portion 1714" are provided at a front end of the shaft 1730' of the drive motor 1730. The cut portion 1730'*a* defines the front end of the shaft 1730', and the non-cut portion 1730'*b* is located at the rear of the cut portion 1730'*a*.

In the cut portion 1730'*a*, at least one cut surface may extend along a lengthwise direction. In the cut portion 1730'*a* of this embodiment, two cut surfaces parallel to each other extend along the lengthwise direction.

The cut portion 1730'*a* is inserted into the first insertion portion 1714', and the non-cut portion 1730'*b* is inserted into the second insertion portion 1714". During the process of insertion, the non-cut portion 1730'*b* may be engaged in the stepped portion between the first insertion portion 1714' and the second insertion portion 1714".

As the cut potion 1730'*a* of the shaft 1730' has a non-circular cross section, and the first insertion portion 1714' has a shape corresponding to the cut portion 1730'*a*, a driving force of the drive motor 1730 is transmitted to the circulation fan 1710 through the cut portion 1730'*a* and the first insertion portion 1714'. That is, a slip does not occur in the cutting portion 1730'*a* and the first insertion portion 1714'. Thus, the cut portion 1730'*a* should have a sufficient length for allowing the driving force of the drive motor 1730 to be transferred. In this embodiment, the cut portion 1730'*a* is 15.5 mm, and a total length of the cut portion 1730'*a* and the non-cut portion 1730'*b* that are inserted into the bushing 1714 is 22.5 mm.

A fastening member 1740 is coupled to the shaft 1730' of the drive motor 1730 inserted into the bushing 1714 by penetrating through the shaft coupling portion 1711*a* of the circulation fan 1710. The fastening member 1740 is coupled to the cut portion 1730'*a* by a screw. The fastening member 1740 may be configured to completely penetrate through the cut portion 1730'*a*.

Figure 30:
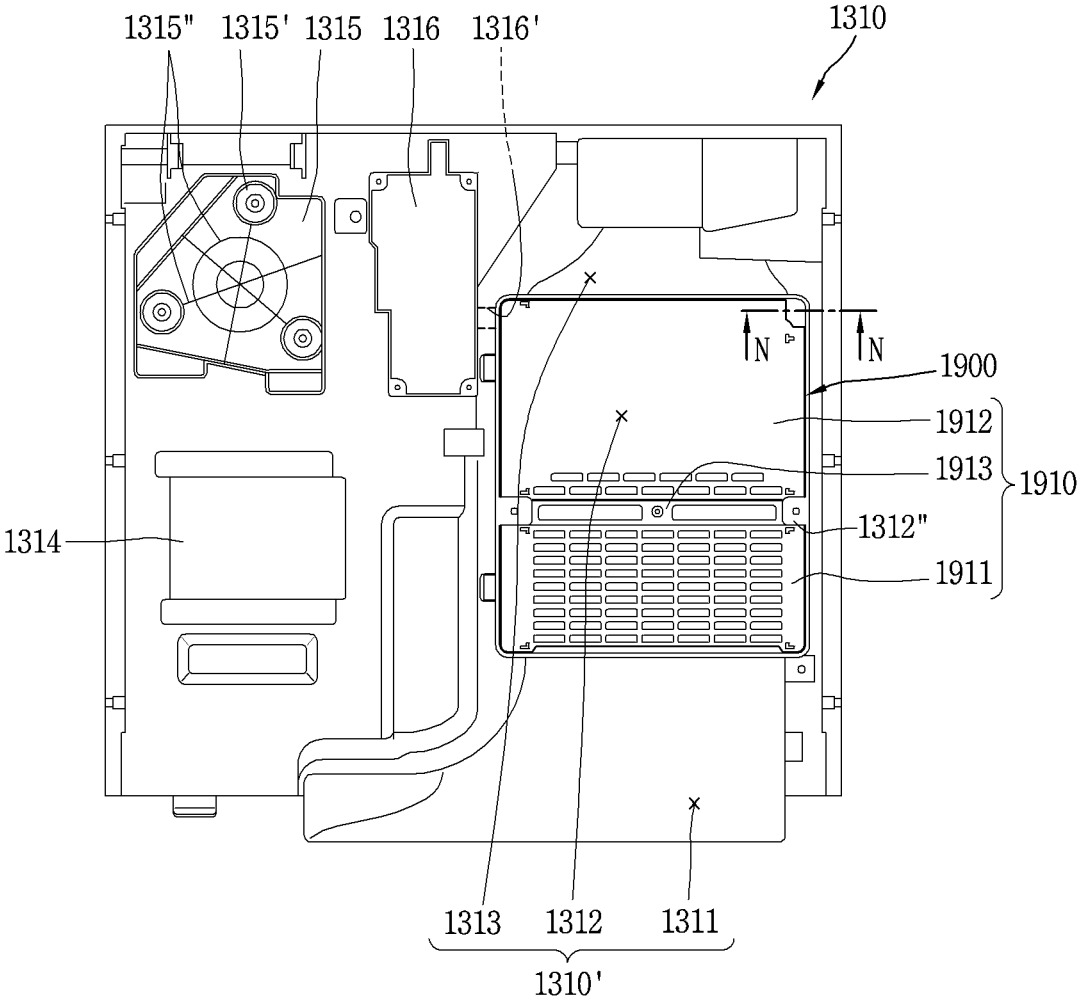
FIG. 30 is a conceptual view illustrating a state in which the water cover is mounted on the base cabinet in FIG. 6.

FIG. 30 is a conceptual view illustrating a state in which the water cover 1900 is mounted on the base cabinet 1310 in FIG. 6.

Referring to FIG. 30, the circulation flow path 1200 forms a passage through which air discharged from the front opening 1030' of the drum 1030 is introduced into the rear opening 1030" of the drum 1030 after heat exchange. The base cabinet 1310 is disposed below the drum 1030 to provide a space in which various components are mounted and defines a part of the circulation flow path 1200.

The base flow path 1310' is divided into the guide portion 1311, the heat exchange unit 1312, and the circulation fan accommodating portion 1313. The guide portion 1311 corresponds to a portion into which air discharged from the front opening 1030' of the drum 1030 is introduced, the heat exchange unit 1312 is a portion in which the evaporator 1110 that removes moisture from air introduced from the guide portion 1311 and the condenser 1130 that heats the air with moisture removed are installed, and the circulation fan accommodating portion 1313 is a portion in which the circulation fan 1710 that sucks air that has passed through the heat exchange unit 1312 to blow is accommodated.

The water cover 1900 is mounted on the bottom surface of the heat exchange unit 1312 of the base flow path 1310'. The water cover 1900 provides a space in which the evaporator 1110 and the condenser 1130 are seated and allows the evaporator 1110 and the condenser 1130 to be spaced apart from the bottom surface. That is, the water cover 1900 causes condensate water generated in the evaporator 1110 and dropped on the bottom surface of the heat exchange unit 1312 to reach the evaporator 1110 and the condenser 1130. In addition, the water cover 1900 is configured to suppress condensate water on the bottom surface of the heat exchange unit 1312 from being scattered by the suction force of the circulation fan 1710 and being introduced into the condenser 1130 to a specific degree or level.

Hereinafter, a detailed structure of the water cover 1900 will be described.

Figure 31:
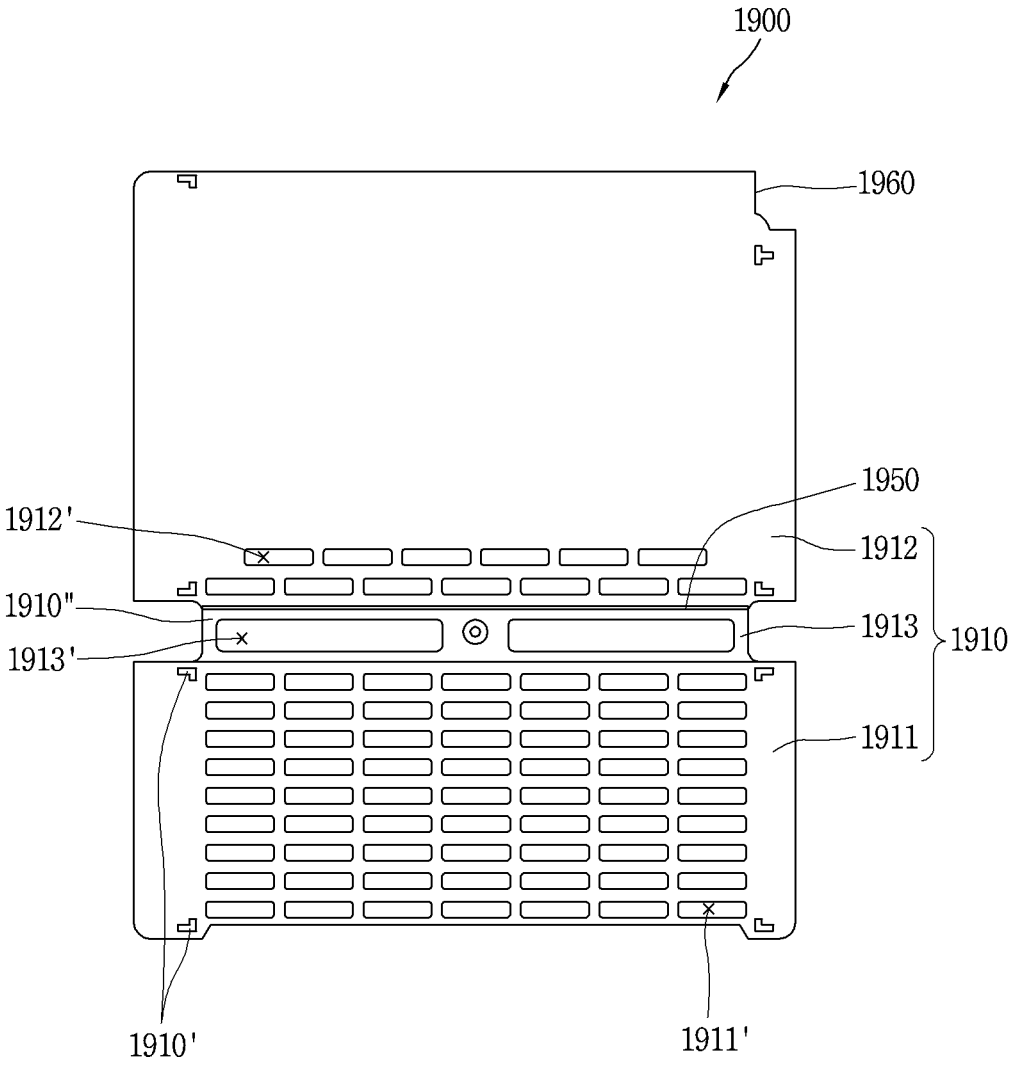
FIG. 31 is a planar view of the water cover in FIG. 30.
Figure 32:
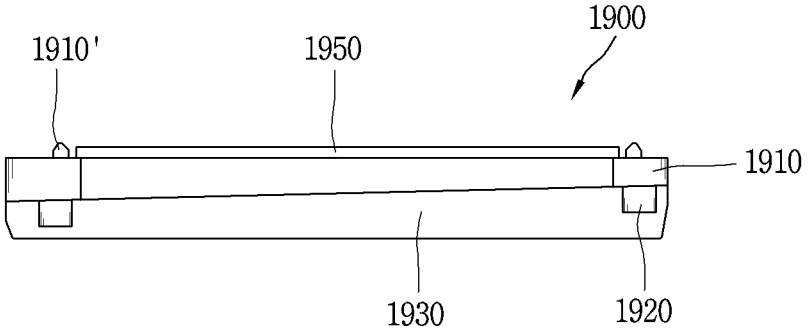
FIG. 32 is a front view of the water cover in FIG. 31.
Figure 33:
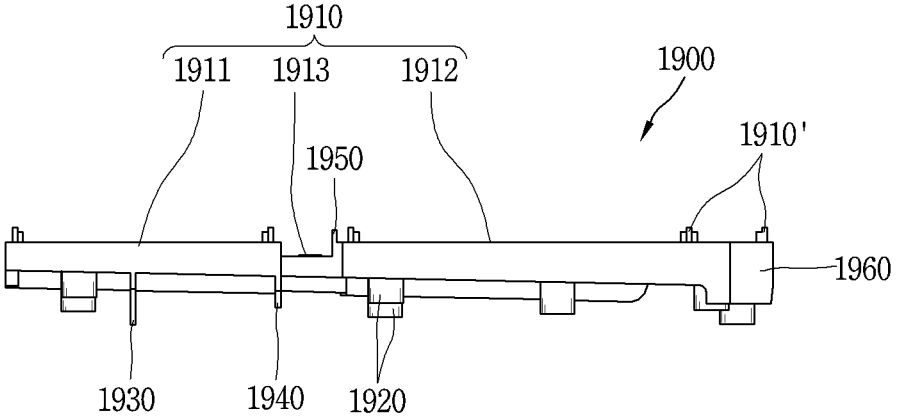
FIG. 33 is a right lateral view of the water cover in FIG. 31.

FIG. 31 is a planar view of the water cover 1900 in FIG. 30, FIG. 32 is a front view of the water cover 1900 in FIG. 31, and FIG. 33 is a right lateral view of the water cover 1900 in FIG. 31.

Referring to FIGS. 31 to 33, the water cover 1900 includes a seating part 1910 and a support portion 1920.

The seating part 1910 provides a space in which the evaporator 1110 and the condenser 1130 are seated. The seating part 1910 is formed flat and provided with fixing ribs 1910' for limiting installation positions of the evaporator 1110 and the condenser 1130 on an upper surface thereof. The fixing ribs 1910' are formed in a '¬' or 'T' shape, so as to be engaged in respective corners of the evaporator 1110 and the condenser 1130.

A plurality of drain holes 1911', 1912', and 1913' for draining condensate water generated in the evaporator 1110 is formed in the seating part 1910. A shape of each of the plurality of drain holes 1911', 1912', and 1913', and arrangement of the plurality of drain holes 1911', 1912' and 1913' may vary.

The support portion 1920 extends downward from the seating part 1910 to be supported on the bottom surface of the heat exchange unit 1312. The support portion 1920 protrudes from a plurality of points of a rear surface of the seating part 1910.

The bottom surface of the heat exchange unit 1312 is inclined downward to the rear side. In addition, the bottom surface of the base flow path 1310' on which the condenser 1130 is disposed is inclined downward to one side of the condenser 1130 on which the communication hole 1313*a*" is formed. Owing to this inclined structure, condensate water that has fallen to the bottom surface of the heat exchange unit 1312 on which the evaporator 1110 is disposed may flow to the bottom surface of the heat exchange unit 1312 on which the condenser 1130 is disposed, and may be then introduced into the condensate water collection part 1316 through the communication hole 1313*a*"

Even in a structure in which the bottom surface of the heat exchange unit 1312 is inclined, the seating part 1910 is designed to maintain a horizontal level (horizontality). To this end, the support portion 1920 provided beneath a condenser seating portion 1912 along a lengthwise direction of the seating part 1910 is longer (greater) than the support portion 1920 provided beneath an evaporator seating portion 1911. In addition, the support portion 1920 provided at one side of the seating part 1910 along its width direction is longer than the support portion 1920 provided at another side of the seating part 1910.

The seating part 1910 may include the evaporator seating portion 1911, the condenser seating portion 1912, and a connecting (or connection) portion 1913. The evaporator seating portion 1911, the condenser seating portion 1912, and the connecting portion 1913 are sequentially disposed from the front to the rear of the heat exchanger portion 1312.

The evaporator seating portion 1911 provides a space on which the evaporator 1110 is seated. The fixing rib 1910' may be provided on an upper surface of the evaporator seating portion 1911 in a protruding manner.

The condenser seating portion 1912 provides a space on which the condenser 1130 is seated. The fixing rib 1910' may be provided on an upper surface of the condenser seating portion 1912 in a protruding manner. The upper surface of the condenser seating portion 1912 may form the same plane as the upper surface of the evaporator seating portion 1911.

The connecting portion 1913 connects the evaporator seating portion 1911 and the condenser seating portion 1912. An upper surface of the connecting portion 1913 may be located below the upper surface of the evaporator seating portion 1911 and the upper surface of the condenser seating portion 1912. The connecting portion 1913 has a width narrower (or smaller) than the evaporator seating portion 1911 and the condenser seating portion 1912, so as to form an accommodation groove 1910" recessed inward from at least one side of the water cover 1900.

A protruding portion 1312" (see FIG. 30) that corresponds to the accommodation groove 1910" is provided on left and right walls of the heat exchange unit 1312. That is, when the water cover 1900 is installed on the heat exchange unit 1312, the protruding portion 1312" is inserted into the accommodation groove 1910", allowing an installation position to be correctly or properly guided. The evaporator 1110 is disposed at the front of the protruding portion 1312", and the condenser 1130 is disposed at the rear of the protruding portion 1312".

The plurality of drainage holes 1911', 1912', and 1913' may be provided on a front end of the evaporator seating portion 1911, the connecting portion 1913, and the condenser seating portion 1912, respectively. That is, the plurality of drainage holes 1911', 1912', and 1913' may be arranged from a front end of the evaporator seating portion 1911 to a front end of the condenser seating portion 1912.

The plurality of drain holes 1911', 1912', and 1913' is arranged along a widthwise direction and a lengthwise direction of the seating part 1910.

In detail, a plurality of drain holes 1911' formed on the evaporator seating portion 1911 is continuously disposed at a predetermined interval along a widthwise direction and a lengthwise direction of the evaporator seating portion 1911. That is, the plurality of drain holes 1911' formed in the evaporator seating portion 1911 is arranged in rows and columns.

The plurality of drain holes 1911' formed in the evaporator seating portion 1911 may have a long hole shape extending in one direction (e.g., in the widthwise direction or the lengthwise direction of the evaporator seating portion 1911.

The plurality of drain holes 1911' arranged along the lengthwise direction of the evaporator seating portion 1911 may be disposed to completely overlap with each other along the lengthwise direction, or disposed to only partially overlap with each other, namely, alternately disposed along the lengthwise direction.

A plurality of drain holes 1913' formed on the connecting portion 1913 may be greater than the drain holes 1911' formed on the evaporator seating portion 1911 and the drain holes 1912' formed on the condenser seating portion 1912. In this embodiment, each of the plurality of drain holes 1913' formed on the connecting portion 1913 extends long along a widthwise direction of the connecting portion 1913.

However, the present disclosure is not limited thereto. The plurality of drain holes 1913' formed on the connecting portion 1913 may have the same or similar size as the plurality of drain holes 1911' and 1912' formed in the evaporator seating portion 1911 and the condenser seating portion 1912, respectively, and have the same or similar arrangement.

The plurality of drain holes 1912' formed at the front end of the condenser seating portion 1912 may be continuously arranged at a predetermined interval along widthwise and lengthwise directions of the condenser seating portion 1912.

Along the lengthwise direction of the condenser seating portion 1912, one drain hole 1912' may be disposed to partially overlap another drain hole 1912" that is located immediately behind thereof. That is, the plurality of drain holes 1912' may be alternately disposed along the lengthwise direction of the condenser seating portion 1912.

With this arrangement, even if condensate water moves upward of the condenser seating portion 1912 and flows between two adjacent drain holes 1912', the condensate water is dropped back to a lower side of the condenser seating portion 1912 through the drain hole 1912' located immediately behind. Accordingly, draining performance of condensate water in the condenser seating portion 1912 may be improved.

However, the present disclosure is not limited thereto. The plurality of drain holes 1912' arranged along the lengthwise direction of the condenser seating portion 1912 may be disposed to completely overlap with each other along the lengthwise direction.

In order to prevent an upward backflow of condensate water on the bottom surface of the circulation flow path 1200 and scattering of the condensate water toward the condenser 1130 side by the suction force of the circulation fan 1710 to a specific degree or level, the water cover 1900 includes the following structure.

First, in order to suppress condensate water from flowing upward of the seating part 1910 through the drain holes 1911', 1912', and 1913', a downwardly extending rib 1940 that protrudes downward along the widthwise direction of the seating part 1910 is provided between the evaporator seating portion 1911 and the evaporator seating portion 1911. In this embodiment, the downwardly extending rib 1940 protrudes downward from a lower surface of a front end of the connecting portion 1913.

Next, an upwardly extending rib 1950 that protrudes upward along the widthwise direction of the seating part 1910 is provided between the connecting portion 1913 and the seating part 1910 to prevent condensate water from being introduced into the condenser seating portion 1912. In this embodiment, the upwardly extending rib 1950 protrudes upward from an upper surface of a rear end of the connecting portion 1913.

Figure 34:
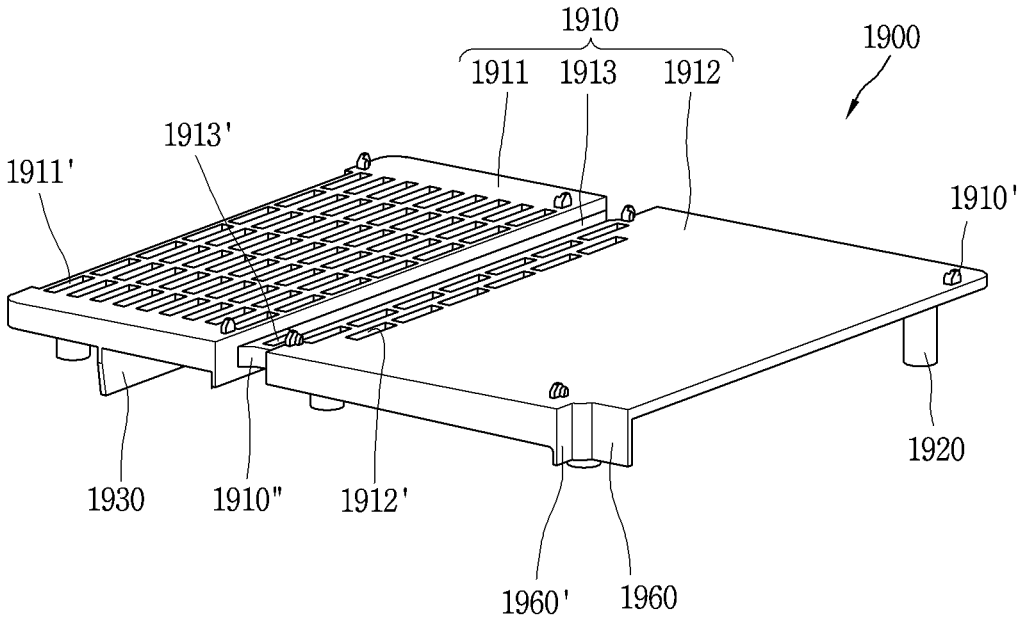
FIG. 34 is a perspective view of the water cover in FIG. 31.
Figure 35:
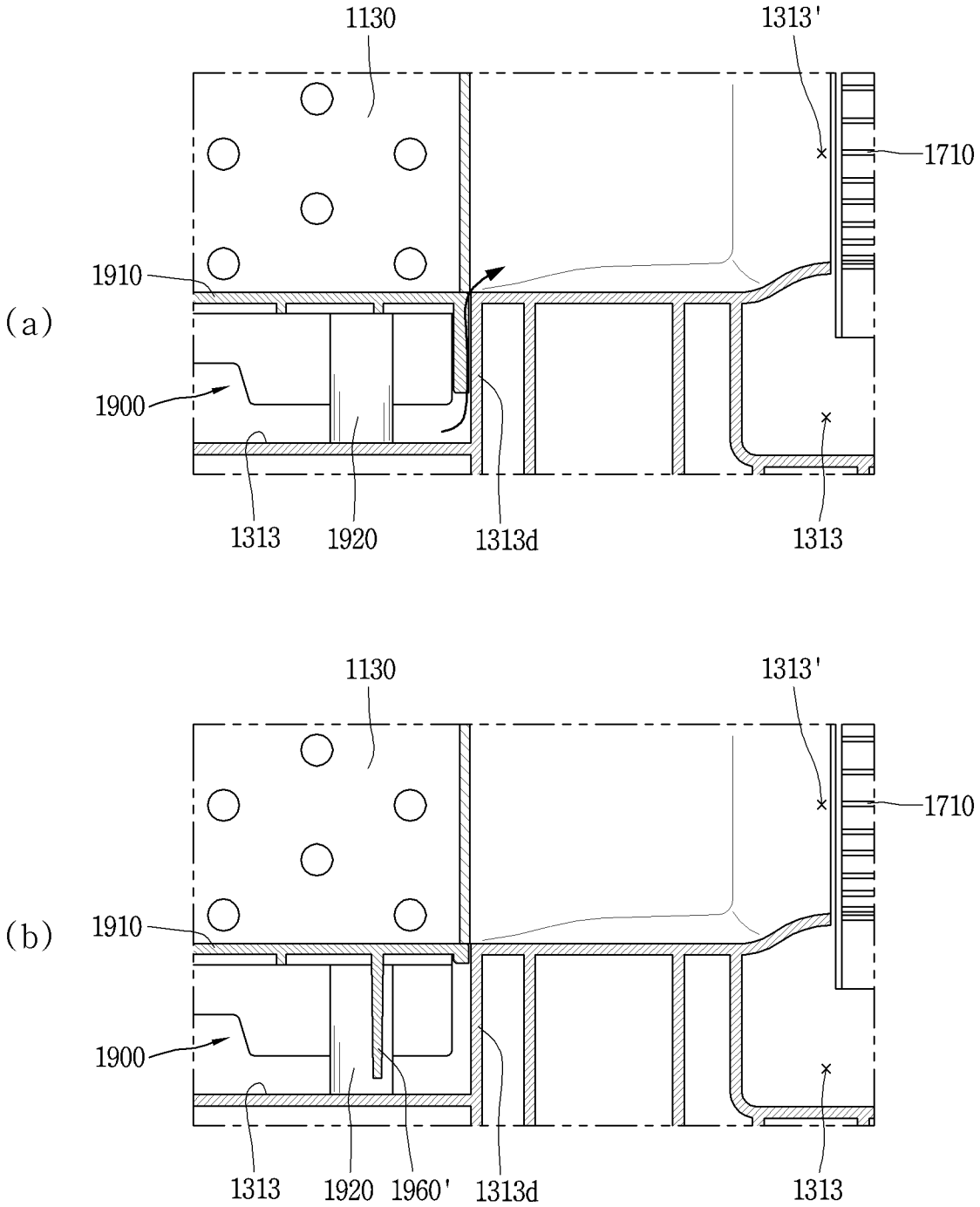
FIG. 35 is a cross-sectional view taken along line "N-N" of FIG. 30, (a) of FIG. 35 is a view for explaining a structural problem before a design change, and (b) of FIG. 35 illustrates a view in which the problem of (a) of FIG. 35 is solved by employing the water cover of FIG. 34.

FIG. 34 is a perspective view of the water cover 1900 in FIG. 31, and FIG. 35 is a cross-sectional view taken along line "N-N" of FIG. 30. (a) of FIG. 35 is a view for explaining a structural problem before a design change, and (b) of FIG. 35 is a view in which the water cover 1900 of FIG. 34 is employed to solve the problem of (a) of FIG. 35.

Referring to FIGS. 34 and 35, the circulation fan accommodating portion 1313 is provided at a position stepped upward from a rear end of the heat exchange unit 1312. More specifically, a bottom surface defining the intake port 1313' of the circulation fan accommodating portion 1313 is located higher than the bottom surface of the heat exchange unit 1312, so that a rear wall having a predetermined height is formed at the rear end of the heat exchange unit 1312. That is, the bottom surface of the heat exchange unit 1312 on which the water cover 1900 is mounted and the bottom surface defining the intake port 1313' of the circulation fan accommodating portion 1313 are connected by the rear wall extending in the vertical direction.

As illustrated in (a) of FIG. 35, when an edge of the rear end of the water cover 1900 is formed thick, a side surface of the edge and the rear wall formed at the rear end of the heat exchange unit 1312 are disposed to face each other. Accordingly, a small gap extends long between the side surface and the rear wall.

In this case, condensate water on the bottom surface of the heat exchange unit 1312 may be sucked up into the gap due to capillary action (or capillary effect). Thereafter, the condensate water may be introduced into the circulation fan accommodating portion 1313 by the suction force of the circulation fan 1710.

In order to prevent this, a recessed portion 1960 is provided at the edge of the rear end of the water cover 1900. As the recessed portion 1960 is provided, a surface 1960' facing the rear wall formed at the rear end of the heat exchange unit 1312 is moved forward. That is, the gap that causes the condensate water to be sucked up by the capillary action is removed. Accordingly, condensate water flowing into the circulation fan accommodating portion 1313 may be reduced.

Figure 36:
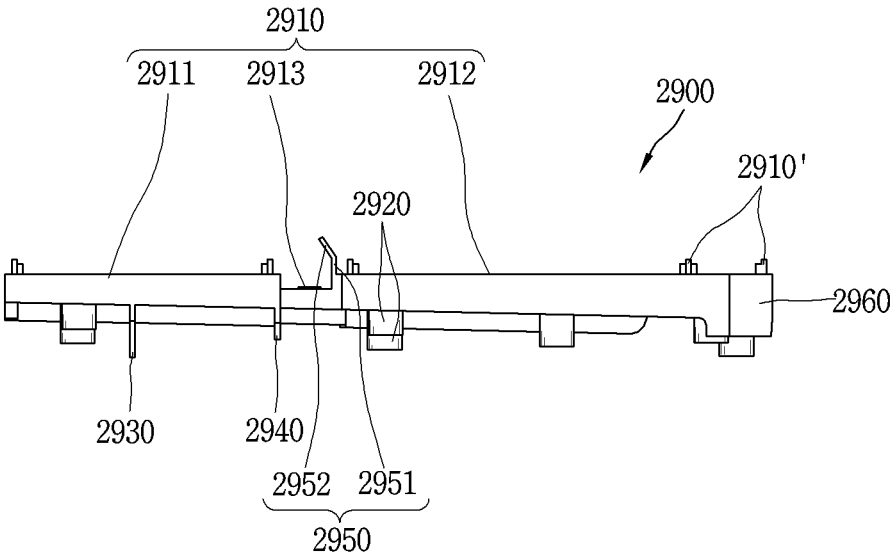
FIG. 36 is a right lateral view of a modified example of the water cover in FIG. 33.

FIG. 36 is a right lateral view of a modified example of the water cover 1900 in FIG. 33.

Referring to FIG. 36, a downwardly extending rib 2940 that protrudes downward along a widthwise direction of a seating part 2910 is provided between an evaporator seating portion 2911 and a connecting portion 2913, and an upwardly extending rib 2950 that protrudes upward along the widthwise direction of the seating part 2910 is provided between the connecting portion 2913 and the seating part 2910. The downwardly extending rib 2940 may be provided at a front end of the connecting portion 2913, and the upwardly extending rib 2950 may be formed at a rear end of the connecting portion 2913.

The upwardly extending rib 2950 includes a portion that is inclined toward the front.

In this modified example, the upwardly extending rib 2950 has a shape that is bent forward from at least one point thereof. In detail, the upwardly extending rib 2950 includes a first portion 2951 extending upward from an upper surface of a water cover 2900 and a second portion 2952 extending forward by being bent at an upper end of the first portion 2951. The first portion 2951 may extend vertically upward from an upper surface of the water cover 2900. The second portion 2952 extends in a direction crossing the front of the first portion 2951. The second portion 2952 is disposed to be inclined forward with respect to the first portion 2951 within the range of an obtuse angle.

Figure 37:
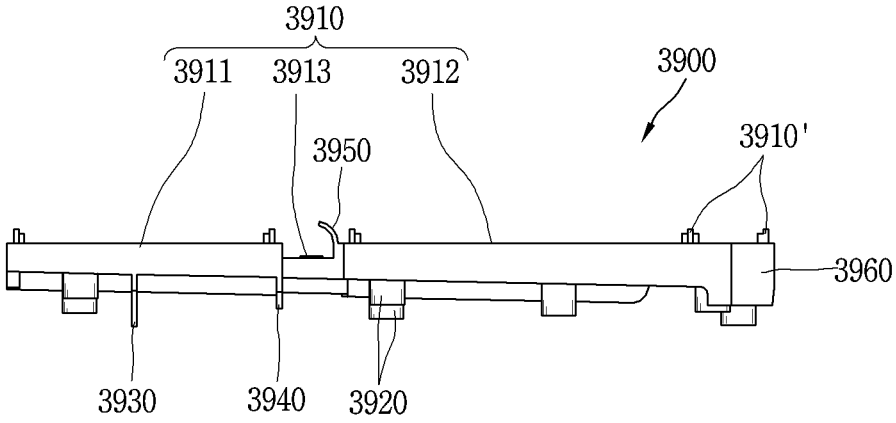
FIG. 37 is a right lateral view of another modified example of the water cover in FIG. 33.

FIG. 37 is a right lateral view of another modified example of the water cover 1900 in FIG. 33.

Referring to FIG. 37, a downwardly extending rib 3940 that protrudes downward along a widthwise direction of a seating part 3910 is provided between an evaporator seating portion 3911 and a connecting portion 3913, and an upwardly extending rib 3950 that protrudes along the widthwise direction of the seating part 3910 is provided between the connecting portion 3913 and the seating part 3910. The downwardly extending rib 3940 may be provided at a front end of the connecting portion 3913, and the upwardly extending rib 3950 may be provided at a rear end of the connecting portion 3913.

The upwardly extending rib 3950 is formed to be rounded toward the front. The upwardly extending rib 3950 may be formed such that its height gradually increases toward the front.

As illustrated in FIGS. 36 and 37, when the upwardly extending ribs 2950 and 3950 are inclined forward, the upwardly extending ribs 2950 and 3950 block condensate water scattered backward by the suction force of the circulation fan 1710 in a more forward position. Accordingly, the upwardly extending ribs 2950 and 3950 of the modified examples may provide an effect of an increased height even having the same height as the upwardly extending rib 1950 of the previous embodiment.

Figure 38:
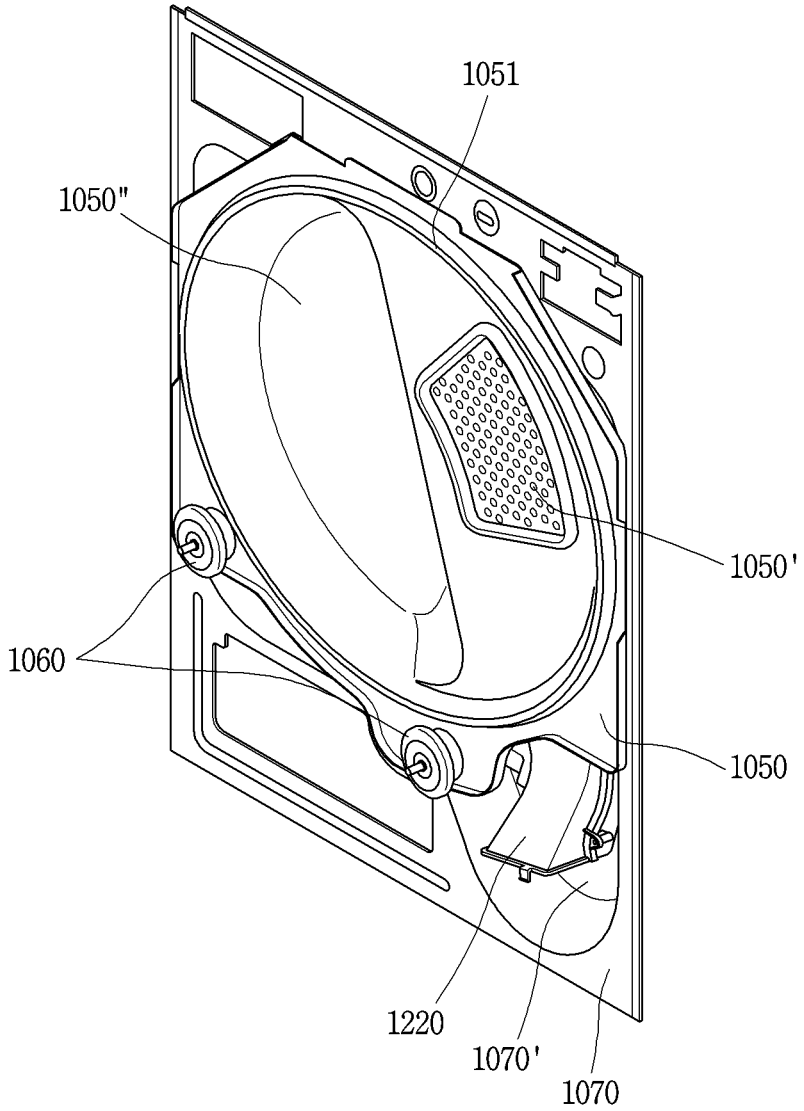
FIG. 38 is a conceptual view illustrating a rear structure of the drum illustrated in FIG. 1.
Figure 39:
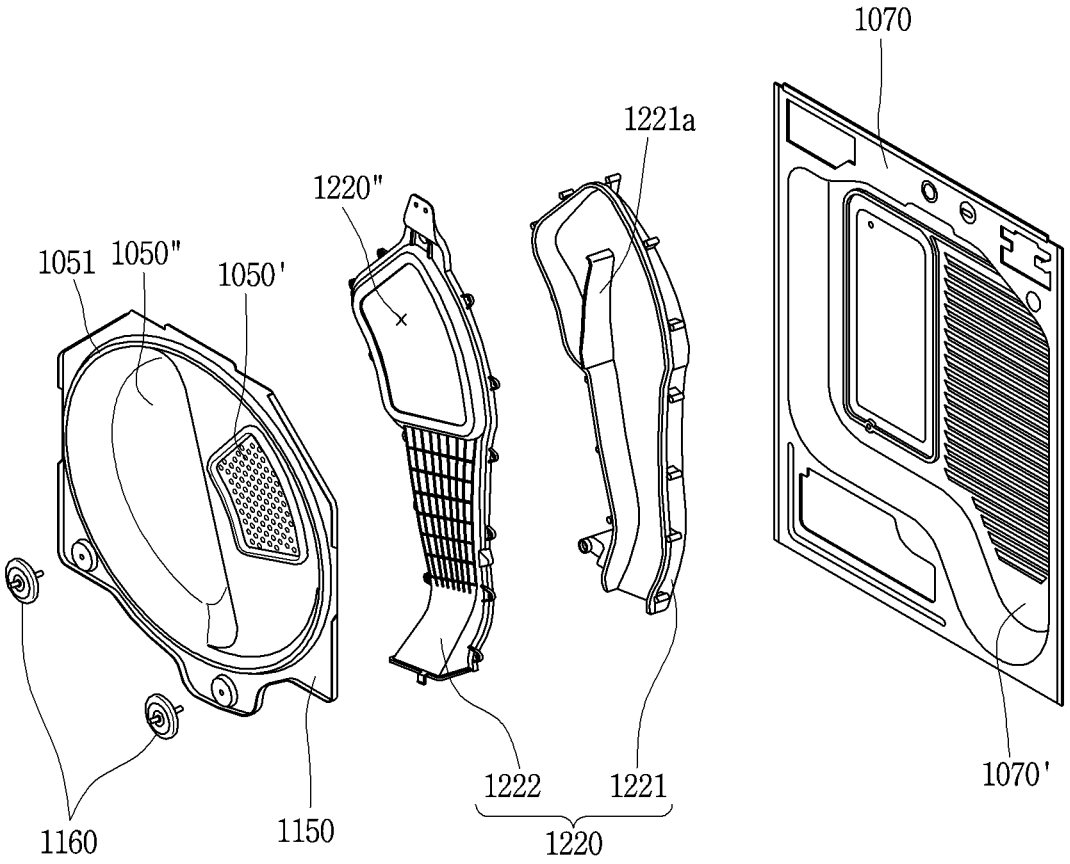
FIG. 39 is a conceptual view illustrating the main components at the rear of the drum in FIG. 38 by separating therefrom.
Figure 40:
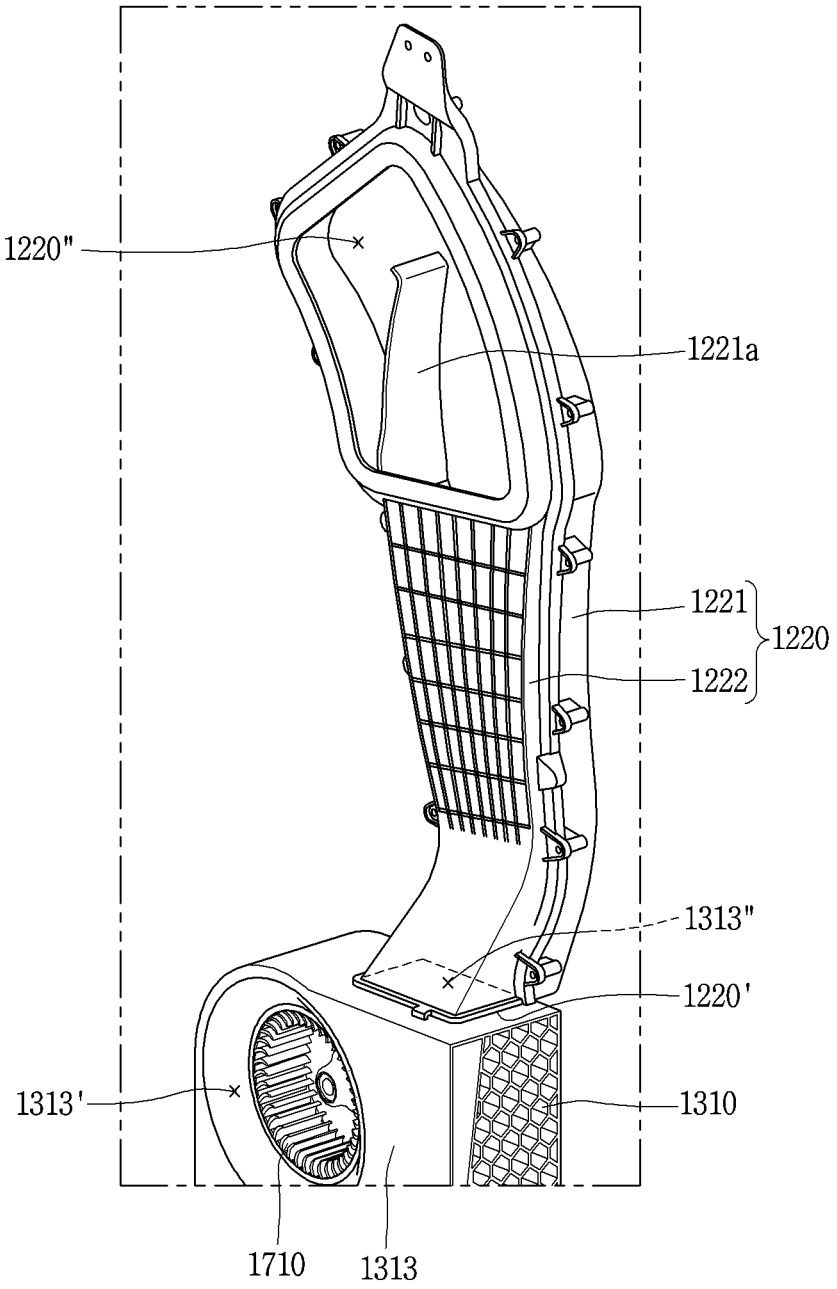
FIG. 40 is a conceptual view illustrating a state in which a rear duct connector in FIG. 38 is mounted on a circulation fan mounting portion.
Figure 41:
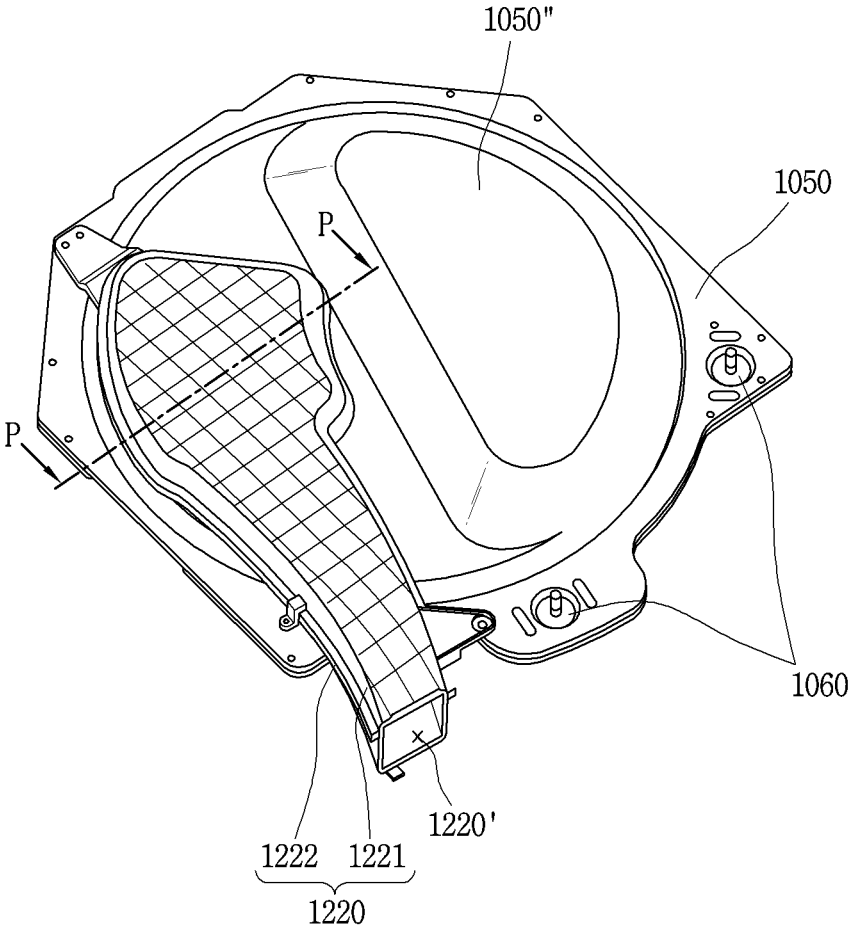
FIG. 41 is a conceptual view illustrating a state in which the rear duct connector in FIG. 38 is coupled to a rear supporter.

FIG. 38 is a conceptual view illustrating a rear structure of the drum 1030 in FIG. 1, FIG. 39 is a conceptual view illustrating the main components provided at the rear of the drum 1030 by separating from the drum 1030 in FIG. 38, and FIG. 40 is a conceptual view illustrating a state in which the rear duct connector 1220 is mounted on a circulation fan mounting portion, and FIG. 41 is a conceptual view illustrating a state in which the rear duct connector 1220 in FIG. 38 is coupled to the rear supporter 1050.

Referring to FIGS. 38 to 41, a drum support ring 1051 is provided on a front surface of the rear supporter 1050 facing the drum 1030 in a protruding manner, so as to correspond to the rear opening 1030" of the drum 1030. The drum support ring 1051 is inserted into the rear opening 1030" of the drum 1030 to rotatably support the drum 1030.

At least two rollers 1060 are rotatably mounted on the rear supporter 1050. The rollers 1060 rotatably support the drum 1030 beneath the drum 1030.

In order to prevent air from leaking into a gap between the rear opening 1030" of the drum 1030 and the drum support ring 1051, a sealing pad (not shown) may be provided to cover a connecting portion therebetween. The sealing pad is designed to cover and surround the rear opening 1030" of the drum 1030 and the drum support ring 1051. The sealing pad may be made of a felt material.

The rear supporter 1050 is provided with the vent holes 1050' corresponding to the rear opening 1030" of the drum 1030. The vent holes 1050' may be provided at a position eccentric to one side with respect to a vertical reference line that passes through a center of the rear supporter 1050. In addition, the vent holes 1050' may be located above a horizontal reference line that passes through the center of the rear supporter 1050.

The rear supporter 1050 is provided with the rear duct connector 1220 that connects the vent holes 1050' and the exhaust port 1313" of the circulation fan accommodating portion 1313 that are vertically spaced apart from each other. The rear duct connector 1220 extends upward so as to guide air blown by the circulation fan 1710 to the vent holes 1050' of the rear supporter 1050.

The rear duct connector 1220 may be coupled to the rear surface of the rear supporter 1050 and the circulation fan accommodating portion 1313 by a screw or hook. In this embodiment, the rear duct connector 1220 is coupled to the circulation fan accommodating portion 1313 by a hook and coupled to the rear surface of the rear supporter 1050 by a screw.

A protruding portion (rearwardly protruding portion) 1050" protruding rearward may be formed in a portion of the rear supporter 1050 where the rear duct connector 1220 is not disposed. Accordingly, the front surface of the rear supporter 1050 may have a shape that is relatively recessed toward the rear. Therefore, the drum 1030 may have more inner space.

The rear duct connector 1220 is provided with a first opening 1220' in communication with the exhaust port 1313" of the circulation fan accommodating portion 1313 and a second opening 1220" in communication with the vent holes 1050' of the rear supporter 1050. The first opening 1220' is opened downward at a lower end of the rear duct connector 1220 to face the exhaust port 1313". The second opening 1220" is located above the first opening 1220' and is opened forward to face the vent holes 1050' of the rear supporter 1050.

An inner partition wall 1221*a* for reducing vortex and resistance of air flowing in the rear duct is provided inside the rear duct connector 1220. This will be described hereinafter.

The rear duct connector 1220 may include a base member 1221 forming a rear part (or surface) and a cover member 1222 forming a front part (or surface). The cover member 1222 may be coupled to the base member 1221 by a screw or hook.

The first opening 1220' may be defined by coupling between the base member 1221 and the cover member 1222. In this embodiment, when the cover member 1222 is coupled to the base member 1221, an inner surface of the cover member 1222 defines one side of the first opening 1220'.

The second opening 1220" may be formed on a front surface of the cover member 1222. The base member 1221 may be provided with the inner partition wall 1221*a*, and a part of the inner partition wall 1221*a* is exposed to the front through the second opening 1220".

The rear cover 1070 is disposed to cover the rear duct connector 1220. An inner surface of the rear cover 1070 includes a recessed portion 1070' recessed toward an outer surface thereof. The protruding portion 1050" of the rear supporter 1050 and the rear duct connector 1220 are accommodated in the recessed portion 1070'. The rear supporter 1050 is mounted to the rear cover 1070.

Figure 42:
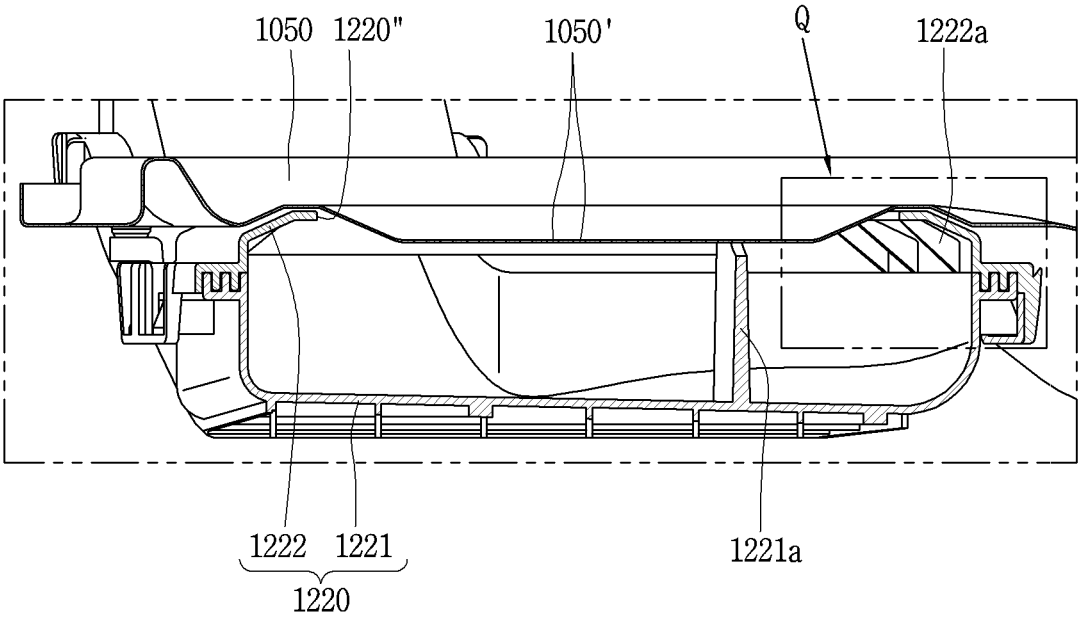
FIG. 42 is a cross-sectional view taken along line "P-P" of FIG. 41.
Figure 43:
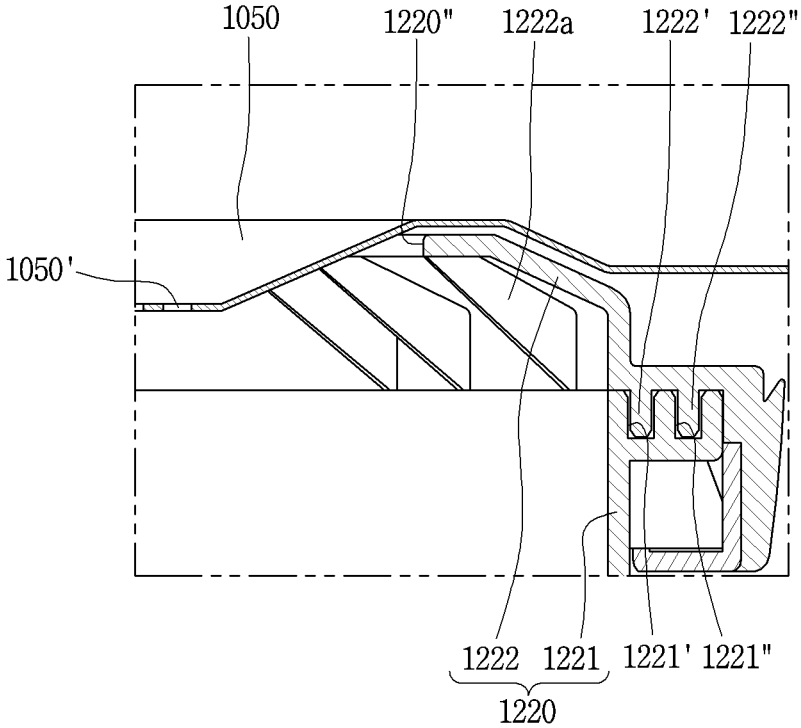
FIG. 43 illustrates an enlarged area of "Q" of FIG. 42.

FIG. 42 is a cross-sectional view taken along line "P-P" of FIG. 41, and FIG. 43 is a view illustrating an enlarged area of "Q" of FIG. 42.

Referring to FIGS. 42 and 43, the rear duct connector 1220 has a double sealing structure that prevents air from leaking through a gap between the base member 1221 and the cover member 1222. In detail, the base member 1221 is provided with a first sealing groove 1221' extending along an edge and a second sealing groove 122" surrounding the first sealing groove 1221', and the cover member 1222 is provided with a first sealing protrusion 1222' inserted into the first sealing groove 1221' and a second sealing protrusion 1222" inserted into the second sealing groove 1221". The first sealing protrusion 1222' extends along an edge of the cover member 1222, and the second sealing protrusion 1222" surrounds the first sealing protrusion 1222'.

A front surface of the rear duct connector 1220 defining the second opening 1220" may be in surface contact with a rear surface defining the vent holes 1050' of the rear supporter 1050. Alternatively, a sealing portion made of an elastic material surrounding the second opening 1220" is provided at the front surface of the rear duct connector 1220, and the sealing portion is configured to be in close contact with the rear surface of the rear supporter 1050 to surround the vent holes 1050'.

Figure 44:
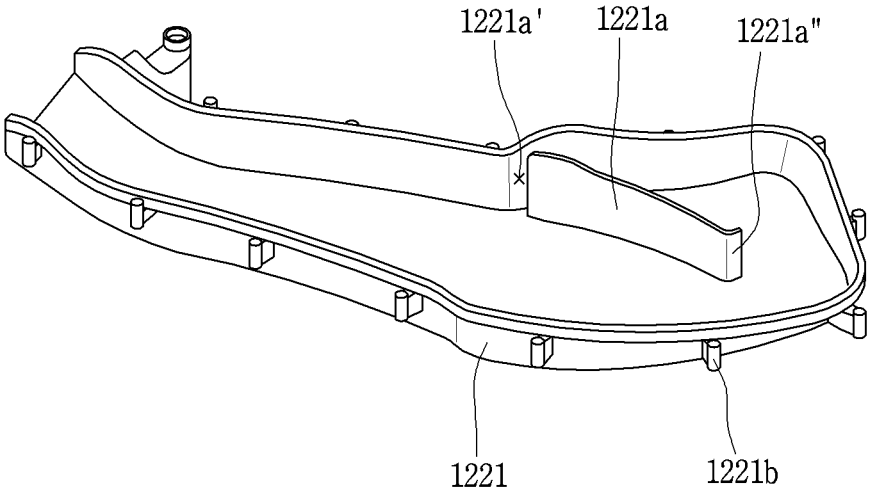
FIG. 44 illustrates an interior of a base member in FIG. 39.
Figure 45:
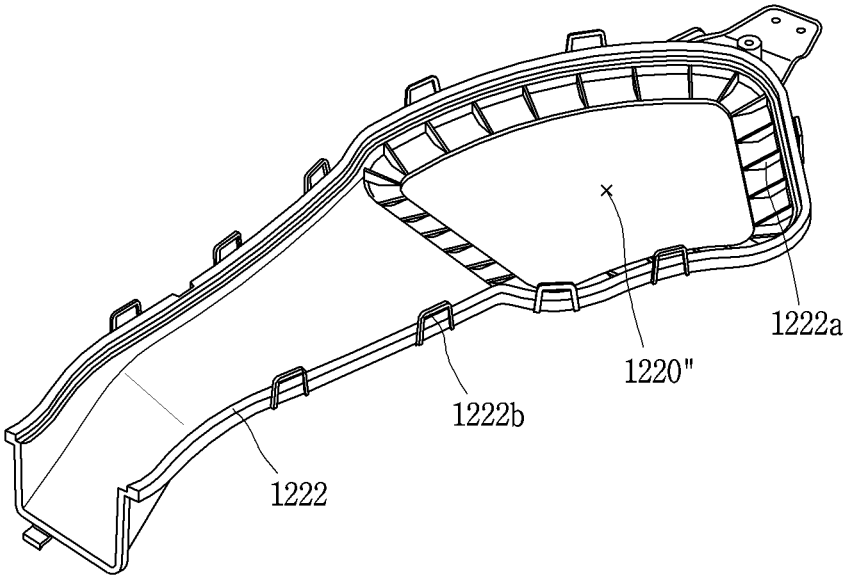
FIG. 45 illustrates an interior of the cover member in FIG. 39.
Figure 46:
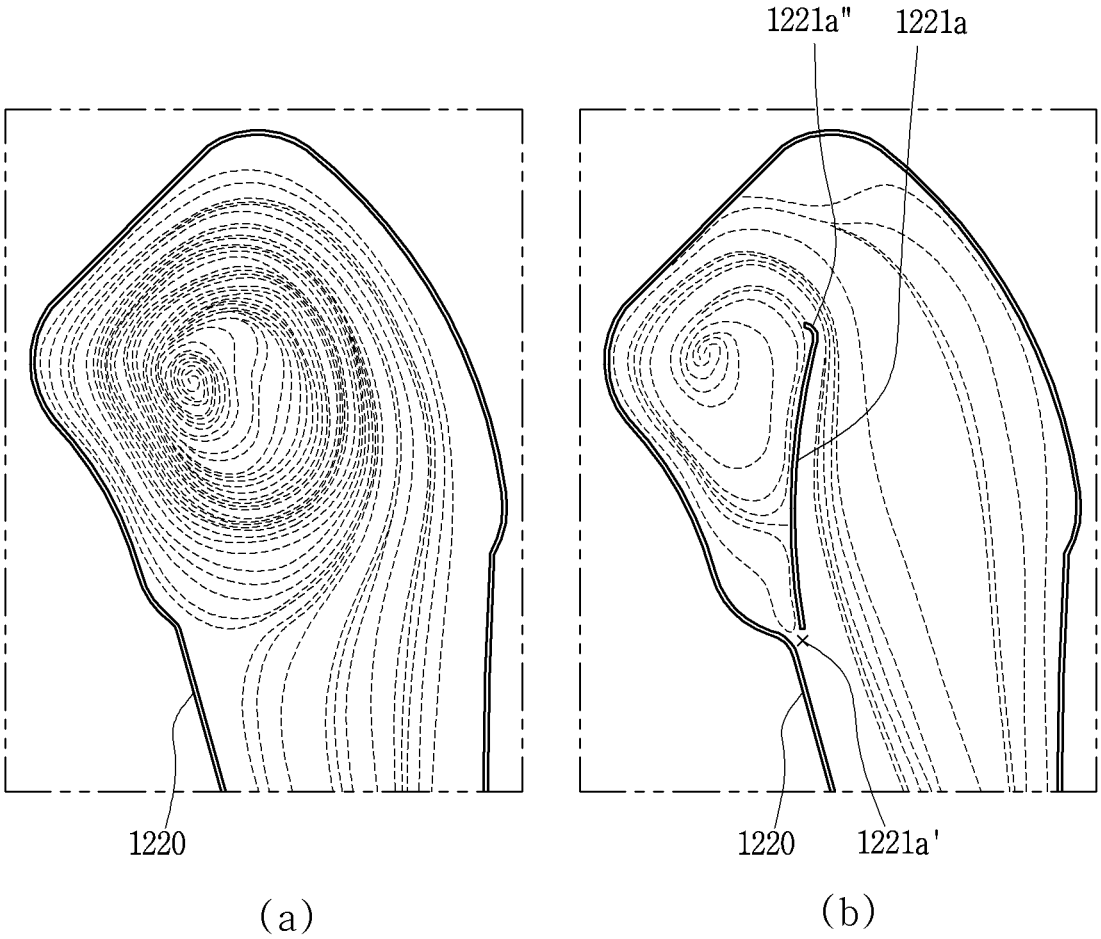
FIG. 46 is a conceptual view for explaining effects of an inner partition wall in FIG. 39.

FIG. 44 illustrates an interior of the base member 1221 in FIG. 39, FIG. 45 illustrates an interior of the cover member 1222 in FIG. 39, and FIG. 46 is conceptual view for explaining effects of the inner partition wall 1221*a* in FIG. 39.

Referring to FIGS. 44 to 46, the base member 1221 may be divided into a first portion extending upward from the first opening 1220', and a second portion located at an upper part of the first portion and corresponding to the second opening 1220". Since the second portion is wider than the first portion, a vortex may occur when air flows from the narrow first portion to the wide second portion, thereby generating flow resistance.

In order to prevent this, the base member 1221 is provided with the inner partition wall 1221*a* that guides the flow of air such that the air may flow more naturally from the first portion to the second portion. A part of the inner partition wall 1221*a* is exposed to the front through the second opening 1220". When the cover member 1222 is coupled to the base member 1221, the inner partition wall 1221*a* is brought into contact with the inner surface of the cover member 1222, or is disposed adjacent to the inner surface of the cover member 1222.

The inner partition wall 1221*a* extends upward from an inner wall of one side of the base member 1221. More specifically, as the second portion has a greater width than the first portion, the inner wall of the one side of the base member 1221 extends outward at a point corresponding to the upper end of the first portion. That is, the inner partition wall 1221*a* extends upward in a position at the inner wall of the one side of the base member 1221 where such a change in shape occurs, or adjacent thereto.

The inner partition wall 1221*a* is inclined in the same direction as the inner wall of the one side, so as to guide air to flow naturally from the first portion to the second portion. The inner partition wall 1221*a* may be disposed to be inclined upward from the inner wall of the one side of the base member 1221 toward the inner wall of another side.

Meanwhile, condensate water may be introduced into the rear duct connector 1220 due to wind generated by the circulation fan 1710. However, unlike air, condensate water cannot overcome gravity and falls.

In order to smoothly drain the condensate water, a drain hole 1221*a'* for preventing water pooling may be provided between the inner wall of the one side of the base member 1221 and the inner partition wall 1221*a*. In this embodiment, it is shown that a lower end of the inner partition wall 1221*a* is spaced apart from the inner wall of the one side of the base member 1221 to form the drain hole 1221*a'*.

However, the present disclosure is not limited thereto. The inner partition wall 1221*a* may extend in a branched manner from the inner wall of the one side of the base member 1221, and the drain hole 1221*a'* may be formed at the lower end of the inner partition wall 1221*a* to allow the condensate water to be drained.

Meanwhile, a round portion 1221*a"* rounded toward one side may be formed on an upper end of the inner partition wall 1221*a*. In this embodiment, it is shown that the round portion 1221*a"* is formed to be rounded in a direction opposite to an extended direction of the inner partition wall 1221*a*. Accordingly, air may naturally flow to the opposite direction from the upper end of the inner partition wall 1221*a*, allowing the vortex and flow resistance to be reduced.

Ribs 1222*a* defining the second opening 1220" are disposed at an inner surface of the cover member 1222 to be spaced apart at a predetermined interval, so as to reinforce strength around the second opening 1220". The ribs 1222*a* may extend toward the second opening 1220". In this embodiment, the ribs 1222*a* are disposed perpendicular to one side defining the second opening 1220".

Engaging hooks 1221*b* are provided at the base member 1221, and engaging holes 1222*b* in which the respective engaging hooks 1221*b* are engaged are formed at the cover member 1222. The engaging hooks 1221*b* may be spaced apart from one another by a predetermined interval along a periphery of the base member 1221. The cover member 1222 may be coupled to the base member 1221 by the hook coupling between the engaging hook 1221*b* and the engaging hole 1222*b*.

Figure 47:
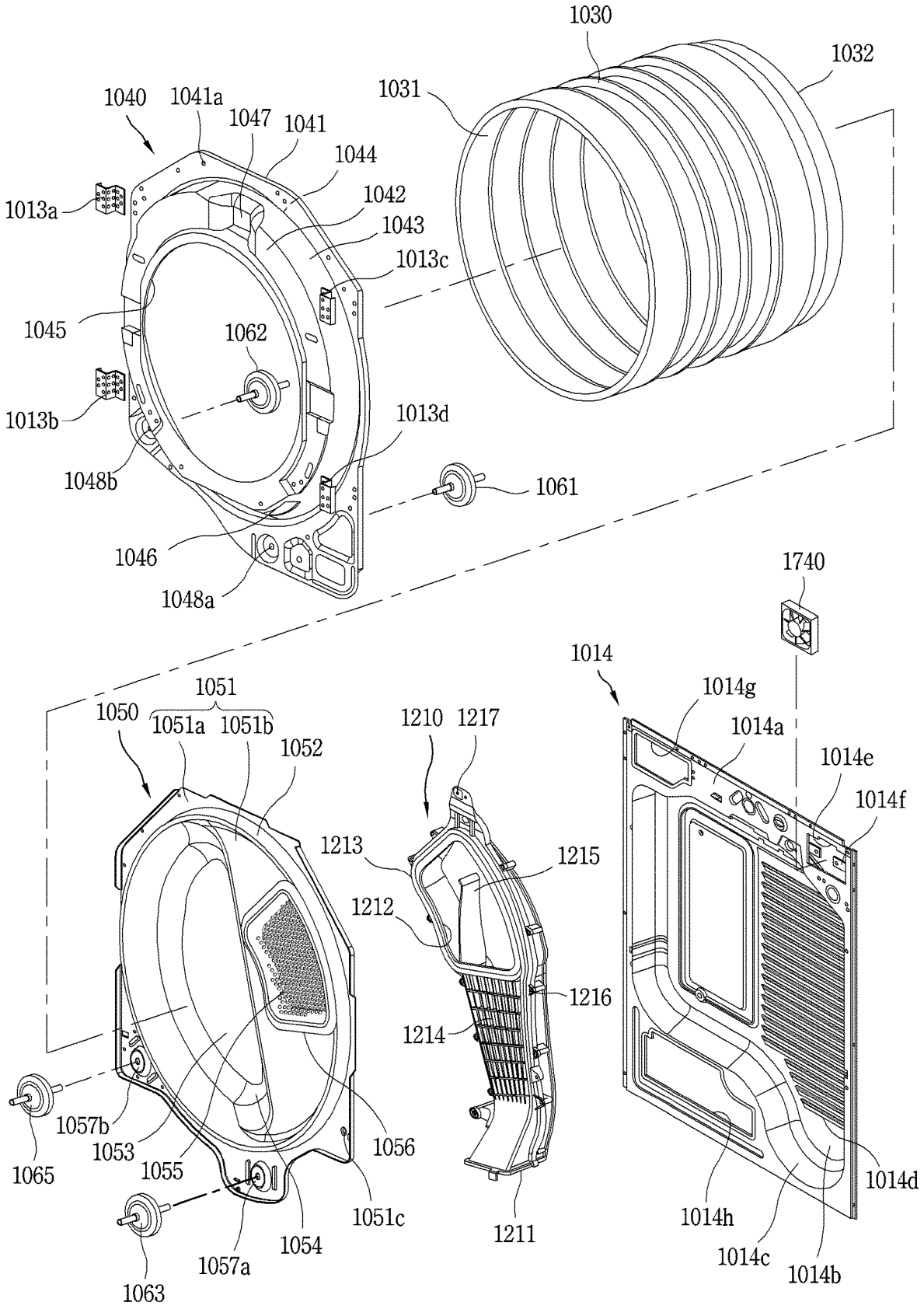
FIG. 47 is an exploded perspective view of a front supporter, a drum, a rear supporter, an inlet duct, and a rear cover.
Figure 48:
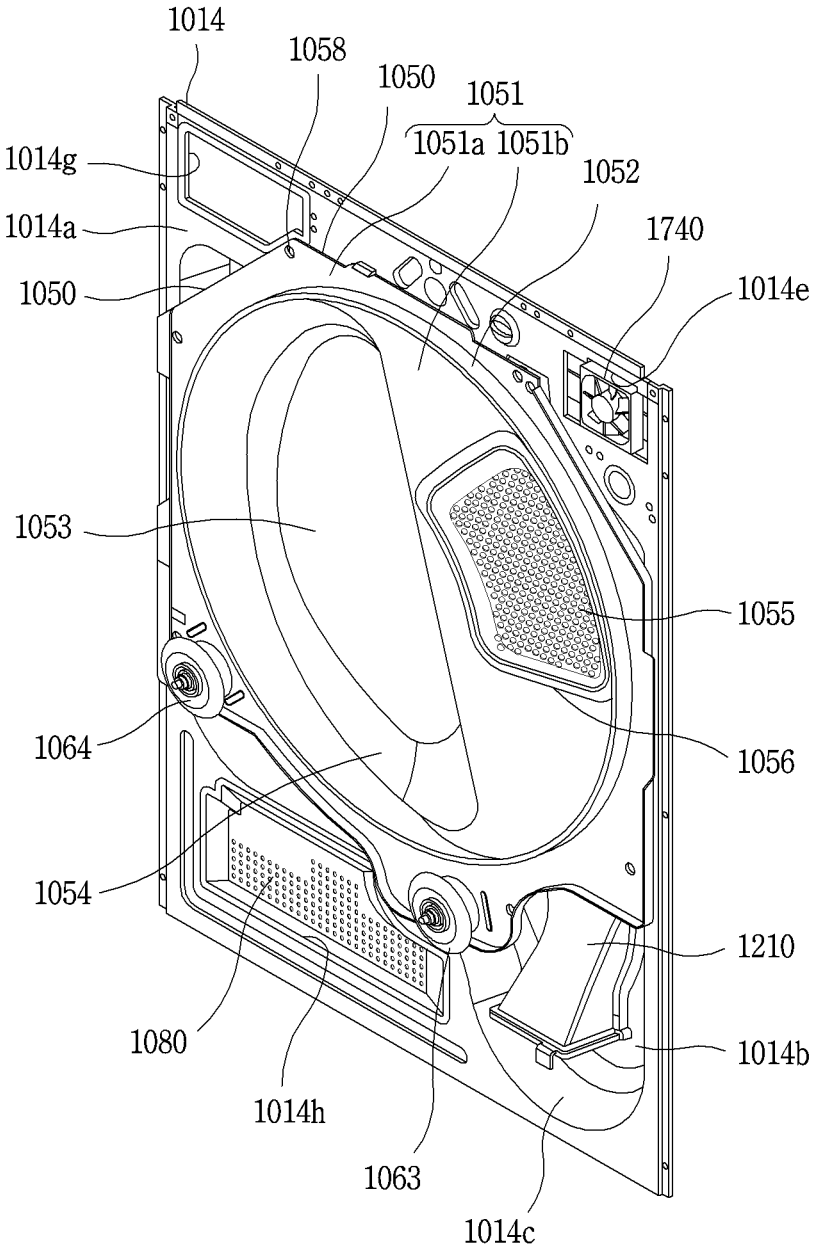
FIG. 48 is a perspective view illustrating a structure in which an inlet duct and a rear cover are coupled to a rear supporter, and an exhaust fan.

FIG. 47 is an exploded perspective view of the front supporter 1040, the drum 1030, the rear supporter 1050, the inlet duct 1220, and the rear cover 1070. FIG. 48 is a perspective view illustrating a structure in which the inlet duct 1220 and the rear cover 1070 are coupled to the rear supporter 1050, and the exhaust fan 1750.

As described in FIG. 1, the front supporter 1040 is connected to a pillar provided at the front part of the cabinet 1010 by a connecting member 1021. The connecting member 1021 may be provided in plurality as illustrated in FIG. 47. The connecting members 1021 may be disposed to be spaced apart from one another in the up, down, left, and right direction of the front supporter 1040. A plurality of screws (not shown) may be inserted into the connecting member 1021.

The front supporter 1040 includes a front base portion 1040', a protruding portion (forwardly protruding portion) 1042, a connecting portion 1043, the drum support ring 1041, the front opening 1044, a filter mounting portion 1045, a sensor mounting portion 1046, and roller mounting portions 1047*a* and 1047*b*. Hereinafter, these constituent components will be described in order.

The front base portion 1040' has a flat plate shape. The front base portion 1040' is disposed to face a front surface of the cabinet 1010. The front base portion 1040' is coupled to the front surface of the cabinet 1010 or a pillar 1012 by the connecting member 1021.

A plurality of screw fastening holes 1040*a* may be formed at the front base portion 1040'. The screw fastening holes 1040*a* are for providing connection between the front base portion 1040' and other components, and thus a screw or the like may be inserted into the screw fastening holes 1040*a*.

The protruding portion 1042 protrudes toward the front of the clothes treatment apparatus 1000 from the front base portion 1040'. The protruding portion 1042 is located at the front of the front base portion 1040' in the front and rear direction of the clothes treatment apparatus 1000.

The connecting portion 1043 is configured to surround a circumference of the protruding portion 1042. The connecting portion 1043 extends to be inclined toward the front base portion 1040' from a circular edge of the protruding portion 1042 and is connected to the front base portion 1040'. The front base portion 1040', the connecting portion 1043, and the protruding portion 1042 have a stepped shape in the front and rear direction of clothes treatment apparatus 1000.

The drum support ring 1041 is provided at a boundary between the front base portion 1040' and the connecting portion 1043. The drum support ring 1041 protrudes toward the drum 1030 located at the rear of the front supporter 1040 from the circular boundary between the front base portion 1040' and the connecting portion 1043. The drum support ring 1041 protrudes along a circumference of a predetermined size that corresponds to a circumference of the cylindrical drum 1030.

An edge of the front opening 1030' of the drum 1030 is placed onto the drum support ring 1041. As the circumferences of the drum 1030 and the drum support ring 1041 correspond to each other, the drum 1030 may be rotated relative to the drum support ring 1041.

The front opening 1044 is formed at the protruding portion 1042. The front opening 1044 of the front supporter 1040 is disposed to face the front opening 1011 of the cabinet 1010. Accordingly, when a user opens the door 1020, an object to be treated may be put into the drum 1030 through the front opening 1011 of the cabinet 1010 and the front opening 1044 of the front supporter 1040.

The filter mounting portion 1045 that allows the filter 1070 to be mounted and accommodated is provided at a lower part of the connecting portion 1043. The lower part of the connecting portion 1043 means a lower side of the front opening 1044. The filter mounting portion 1045 is implemented as a hole on which the filter 1070 is placed. When the filter 1070 is inserted from the top to the bottom toward the filter mounting portion 1045, the filter 1070 is mounted to the filter mounting portion 1045.

The outlet duct 1210 is installed at a lower part of the filter 1070. The outlet duct 1210 is connected to the filter 1070. Air discharged from the drum 1030 sequentially passes through the filter 1070 and the outlet duct 1210, and is then supplied to the connection duct 1230.

Referring to the drawing, the protruding portion 1042 is formed in a circumference of the front opening 1044 of the front supporter 1040, the connecting portion 1043 is formed in a circumference of the protruding portion 1042, and the connecting portion 1043 is formed in a circumference of the front base portion 1040'.

The sensor mounting portion 1046 is formed such that at least a part of the connecting portion 1043 is recessed toward the front base portion 1040'. The sensor mounting portion 1046 may be provided at an upper part of the connecting portion 1043. The upper part of the connecting portion 1043 means an upper side of the front opening 1044. The sensor mounting portion 1046 is an area provided for mounting a sensor capable of detecting various physical properties required for controlling the clothes treatment apparatus 1000. Sensors that can be mounted to the sensor mounting portion 1046 may include a thermometer and a hygrometer.

The roller mounting portions 1047*a* and 1047*b* are provided to allow the rollers 1061 and 1062 to be installed. The roller mounting portions 1047*a* and 1047*b* may be configured as holes capable of accommodating rotating shafts of the rollers 1061 and 1062. The rollers 1061 and 1062 may be rotatably mounted to the roller mounting portions 1047*a* and 1047*b*. The rollers 1061 and 1062 may be disposed beneath the drum 1030 to rotatably support the drum 1030, and the roller mounting portions 1047*a* and 1047*b* may be provided beneath the drum 1030 to correspond to positions of the rollers 1061 and 1062.

The drum 1030 is provided at the rear of the front supporter 1040. The drum 1030 may be rotatably supported by the front supporter 1040 and the rear supporter 1050. The drum 1030 has a cylindrical shape and is provided with the front opening 1030' and the rear opening 1030". An object to be treated, such as clothes, is put into the front opening 1030', and hot dry air is supplied to the rear opening 1030'.

The drum 1030 and the drum motor 1800 may be connected by a drum belt (not shown). The drum belt may surround the pulley 1810 and the drum 1030. Tension of the drum motor 1800 transferred through the pulley 1810 and the drum belt allows the drum 1030 to be rotated.

The rear supporter 1050 is disposed at the rear of the drum 1030. The rear supporter 1050 may be directly coupled to a rear surface of the clothes treatment apparatus 1000, or the rear cover 1070 that corresponds to a rear surface of the cabinet 1010. The rear supporter 1050 is disposed to face the rear cover 1070. When a screw passes through the rear supporter 1050 and is inserted into the rear cover 1070, the rear supporter 1050 and the rear cover 1070 are coupled to each other.

The rear supporter 1050 includes a rear base portion 1052, the drum support ring 1051, the protruding portion 1050", a connecting portion 1053, and roller mounting portions 1055*a* and 1055*b*. Hereinafter, these constituent components will be described in order.

The rear base portion 1052 has a flat plate shape. The rear base portion 1052 is disposed to face the rear cover 1070.

A plurality of fastening holes 1052*c* may be provided at the base portion 1052. The rear base portion 1052 may be coupled to the rear cover 1070 by screws inserted into the screw fastening holes 1052*c*. However, the coupling mechanism between the rear base portion 1052 and the rear cover 1070 is not limited to the screws.

The rear base portion 1052 is divided into an outer portion 1052*a* and an inner portion 1052*b* based on the drum support ring 1051 protruding in a circular shape. When the drum 1030 is mounted on the drum support ring 1051, the outer portion 1052*a* is disposed outside the drum 1030, and the inner portion 1052*b* is disposed inside the drum 1030. For example, the outer portion 1052*a* is exposed to an outer space of the drum 1030, and the inner portion 1052*b* is exposed to an inner space of the drum 1030.

The protruding portion 1050" protrudes from the rear base portion 1052 toward the rear of the clothes treatment apparatus 1000. In detail, the protruding portion 1050" protrudes toward the rear of the clothes treatment apparatus 1000 from an area surrounded by the inner portion 1052*b* of the rear base portion 1052 and the drum support ring 1051. Accordingly, the front surface of the rear supporter 1050 may have a shape that is relatively recessed toward the rear.

The protruding portion 1050" is located behind than the rear base portion 1052 in the front and rear direction of the clothes treatment apparatus 1000. Accordingly, the inner space of the drum 1030 may be increased.

When the rear supporter 1050 is viewed from the front of the clothes treatment apparatus 1000, the inner portion 1052*b* and the protruding portion 1050" of the rear base portion 1052 have a semicircular shape, respectively. However, sizes of the two semicircles may be different, and a boundary of the semicircles may be perpendicular or inclined at a predetermined angle in the vertical direction. The protruding portion 1050" has a semicircular shape, not a circular shape. This is because it requires a space for installing the inlet duct 1220 behind the inner portion 1052*b* of the rear base portion 1052. For example, the inlet duct 1220 is installed in a space provided between the inner portion 1052*b* of the rear base portion 1052 and the rear cover 1070.

A boundary exists between the rear base portion 1052 and the protruding portion 1050". A boundary between the outer portion 1052*a* of the rear base portion 1052 and the protruding portion 1050" is formed by the drum support ring 1051. A boundary between the inner portion 1052*b* of the rear base portion 1052 and the protruding portion 1050" is formed by the connecting portion 1053.

The connecting portion 1053 is formed in a circumference of the protruding portion 1050". The connecting portion 1053 extends toward the inner portion 1052*b* of the rear base portion 1052 and the drum support ring 1051 from a semicircular edge of the protruding portion 1050", so as to be connected to the inner portion 1052*b* of the rear base portion 1052 and the drum support ring 1051.

A front edge of the connecting portion 1053 is connected to an inner part of the rear base portion 1052 and the drum support ring 1051, and a rear edge of the connecting portion 1053 is connected to the protruding portion 1050". The rear base portion 1052, the connecting portion 1053, and the protruding portion 1050" have a stepped shape along the front and rear direction of the clothes treatment apparatus 1000.

The drum support ring 1051 is provided at a boundary between the outer portion 1052*a* and the inner portion 1052*b* of the rear base portion 1052, and a boundary between the outer portion 1052*a* and the protruding portion 1050" of the rear base portion 1052. The drum support ring 1051 protrudes along a circumference of a predetermined size corresponding to the circumference of the cylindrical drum 1030.

An edge of the rear opening 1030" of the drum 1030 is placed onto the drum support ring 1051. Accordingly, the drum 1030 may be rotated relative to the drum support ring 1051.

A plurality of vent holes 1050' is formed at the inner portion 1052*b* of the rear base portion 1052. The vent holes 1050' are disposed to face the inlet duct 1220. Hot dry air is introduced into the drum 1030 from the inlet duct 1220 through the vent holes 1050'. A shape corresponding to the second opening 1220" of the inlet duct 1220 is formed in a periphery of the vent holes 1050'.

The roller mounting portions 1055*a* and 1055*b* are provided to allow rollers 1063 and 1064 to be installed. The roller mounting portions 1055*a* and 1055*b* may be configured as holes capable of accommodating rotating shafts of the rollers 1063 and 1064. The rollers 1063 and 1064 may be rotatably mounted to the roller mounting portions 1055*a* and 1055*b*. The rollers 1063 and 1064 may be disposed beneath the drum 1030 to rotatably support the drum 1030, and the roller mounting portions 1055*a* and 1055*b* may be provided beneath the drum 1030 so as to correspond to positions of the rollers 1063 and 1064.

The inlet duct 1220 is installed at the rear of the rear supporter 1050. In more detail, the inlet duct 1220 is installed at the rear of the inner portion 1052*b* of the rear base portion 1052.

The first opening 1220' and the second opening 1220" are formed at the inlet duct 1220. The inlet duct 1220 has a structure that vertically extends between the first opening 1220' and the second opening 1220". However, the inlet duct 1220 does not extend in the vertical direction, but may extend to be inclined with respect to the vertical direction. In addition, a flow path inside the inlet duct 1220 may be formed along an inclined straight line or curved line.

The first opening 1220' is formed on a lower end of the inlet duct 1220, and the first opening 1220' is open toward a lower side of the clothes treatment apparatus 1000. A circumference of the first opening 1220' is connected to a circumference of the exhaust port 1313" of the circulation fan accommodating portion 1313. Hot dry air is introduced into the inlet duct 1220 from the exhaust port 1313" through the first opening 1220'.

The second opening 1220" is formed on an upper end of the inlet duct 1220, and the second opening 1220" is opened toward the front of the clothes treatment apparatus 1000. The second opening 1220" is disposed to face the vent holes 1050' of the rear supporter 1050. A periphery 1223 of the second opening 1220" has a shape that corresponds to a periphery 1054 of the vent holes 1050'. Accordingly, the periphery 1223 of the second opening 1220" may be coupled to the periphery 1054 of the vent holes 1050'. Hot dry air is supplied from the inlet duct 1220 to the inside of the drum 1030 through the second opening 1220" and the vent holes 1050'.

A grid-shaped reinforcing rib 1224 for reinforcing strength may be provided at an outer circumferential surface of the inlet duct 1220. The grid-shaped reinforcing rib 1224 may protrude from the outer circumferential surface of the inlet duct 1220.

A guide rib 1215 for guiding the flow of hot dry air may be provided inside the inlet duct 1220. The guide rib 1215 protrudes from an inner circumferential surface of the inlet duct 1220 and extends in the vertical direction. The guide rib 1215 is visually exposed to an outside of the inlet duct 1220 through the second opening 1220". The guide rib 1215 serves to guide or induce a natural flow change of hot dry air flowing upward from the first opening 1220' to be supplied to the drum 1030.

The inlet duct 1220 may be formed by coupling two members 1221 and 1222 or more. A coupling portion 1225 that allows the two members 1221 and 1222 constituting the inlet duct 1220 to be coupled to each other may be provided at an outer circumferential surface of the inlet duct 1220. Examples of the coupling portion 1225 may include a screw fastening hole, a screw, a hook, and the like.

The inlet duct 1220 includes a coupling bracket 1226. The coupling bracket 1226 is provided to be coupled to the rear surface of the rear supporter 1050. The coupling bracket 1226 may protrude from the periphery 1223 of the second opening 1220". A screw fastening hole may be formed at the coupling bracket 1226. The screw inserted into the rear supporter 1050 is fastened to the screw fastening hole of the coupling bracket 1226, so that the rear supporter 1050 and the inlet duct 1220 may be securely coupled to each other.

The rear cover 1070 is located at the rearmost part of the clothes treatment apparatus 1000 and defines a rear appearance of the clothes treatment apparatus 1000. In this sense, the rear cover 1070 corresponds to a rear wall of the clothes treatment apparatus 1000 or a rear wall of the cabinet 1010. Meanwhile, the front surface of the cabinet 1010 located at an opposite side of the rear cover 1070 may be referred to as a front cover.

The rear cover 1070 includes a rear cover base portion 1070*a*, the recessed portion 1070', a connecting potion 1070*b*, vent holes 1070*c*, an exhaust port 1070*d*, a bracket 1070*e*, a water tank insertion port 1070*f*, and a protective cover coupling portion 1070*g*. Hereinafter, these constituent components will be described in order.

The rear cover base portion 1070*a* has a flat plate shape.

The recessed portion 1070' protrudes from the rear cover base portion 1070*a* toward the rear of the clothes treatment apparatus 1000. The recessed portion 1070' is formed in a position that faces the inlet duct 1220 to provide an installation area of the inlet duct 1220.

The connecting portion 1070*b* extends from an edge of the recessed portion 1070' toward the rear cover base portion 1070*a* and connects the edge of the recessed portion 1070' and the rear cover base portion 1070*a*.

A plurality of vent holes 1070*c* may be formed in one region of the recessed portion 1070'. The plurality of vent holes 1070*c* may be provided in a position that faces the inlet duct 1220. The plurality of vent holes 1070*c* may have a shape that is open toward an inclined direction. The plurality of vent holes 1070*c* guides passive inflow and outflow of air through the space between the cabinet 1010 and the drum 1030 so as to allow hot and humid air to be discharged to the outside of the clothes treatment apparatus 1000.

The exhaust port 1070*d* and the water tank insertion port 1070*f* are provided at an upper part of the rear cover base portion 1070*a*. The exhaust port 1070*d* and the water tank insertion port 1070*f* may be provided at the opposite sides from each other. For example, referring to the drawings, the exhaust port 1070*d* is located on the right side, and the water tank insertion port 1070*f* is located on the left side. The positions of the exhaust port 1070*d* and the water tank insertion port 1070*f* may be changed to each other. In this case, positions of the water tank 1410, the printed circuit board constituting the control unit 1600, the exhaust fan 1750, and the like should also be changed.

If the vent holes 1070*c* are for inducing or guiding the passive entry and exit of air, the exhaust port 1070*d* is associated with the exhaust fan 1750 for active discharge of air. In order to actively discharge air, the bracket 1070*e* is installed in a periphery of the exhaust port 1070*d*, and the exhaust fan 1750 is installed at the bracket 1070*e*.

The bracket 1070*e* has a shape protruding toward the exhaust port 1070*d* in the periphery thereof. The bracket 1070*e* may be provided on both right and left sides of exhaust port 1070*d*.

The exhaust fan 1750 is mounted to the bracket 1070*e* and disposed to face the exhaust port 1070*d*. Accordingly, a position of the exhaust fan 1750 is determined according to a position of the exhaust port 1070*d*, and the exhaust fan 1750 may be disposed on an upper left or upper right side of the drum 1030. The rear cover base portion 1070*a* corresponds to an inner rear wall of the cabinet 1010, and thus the exhaust fan 1750 may be understood to be mounted to the inner rear wall of the cabinet 1010.

The exhaust fan 1750 generates wind to discharge air existing in the space between the cabinet 1010 and the drum 1030 to the outside of the clothes treatment apparatus 1000. The space between the cabinet 1010 and the drum 1030 means the second space II between an inner circumferential surface of the cabinet 1010 and the outer circumferential surface of the drum 1030. The exhaust fan 1750 may be configured as an axial fan that makes wind in the direction of the rotating shaft. The exhaust fan 1750 produces wind in a direction of blowing wind toward the exhaust port 1070*d* (direction in which air existing in the space between the cabinet 1010 and the drum 1030 is sucked and discharged to the exhaust port 1070*d*).

The water tank insertion port 1070*f* is formed to pass through an end of the water tank 1410. Here, the end of the water tank 1410 refers to an opposite part of the water tank cover 1420. A size of the water tank 1410 that can be accommodated in the water tank support frame 1430 is limited. If the end of the water tank 1410 can pass through the water tank insertion port 1070*f* formed at the rear cover 1070, a length of the water tank 1410 may be increased accordingly. Here, the length of the water tank 1410 may refer to a length of the clothes treatment apparatus 1000 in the front and rear direction.

The protective cover coupling portion 1070*g* is provided at a rear part of the rear base portion 1070*a*. A protective cover 1080 is coupled to a periphery of the protective cover coupling portion 1070*g*. When maintenance and repairs of the compressor 1120 or the drum motor 1800 are required, an operator may access to the compressor 1120 or the drum motor 1800 by simply opening the protective cover 1080 without disassembling the clothes treatment apparatuses 1000.

Referring to FIG. 48, a lower part of the inlet duct 1220 is exposed through a gap between the rear supporter 1050 and the rear cover 1070. The rear supporter 1050 and the rear cover 1070 have a shape that allows the lower part of the inlet duct 1220 to be exposed to a space between the drum 1030 and the cabinet 1010. In detail, the recessed portion 1070' of the rear cover 1070 has a portion extending downward, and the rear supporter 1050 is designed not to cover this portion. The first opening 1220' is provided at the lower part of the inlet duct 1220, and the first opening 1220' is coupled to the exhaust port 1313" of the circulation fan accommodating portion 1313.

As described above, the inner space of the cabinet 1010 is divided into the first space I and the second space II by the drum 1030. The heat pump cycle devices 1100 are installed in the second space II. The connection duct 1230 is installed in the second space II, and the evaporator 1110 and the condenser 1130 corresponding to a heat exchanger, among the heat pump cycle devices 1100, are installed inside the connection duct 1230. Accordingly, the connection duct 1230 surrounds the heat exchanger and is connected to the drum 1030 to form an air circulation flow path between the heat exchanger and the drum 1030.

The exhaust fan 1750 is installed in the second space II. Of the second space II, the exhaust fan 1750 is installed an outside of the duct. Here, the outside of the duct means an outside of the connection duct 1230. As described above, not only the exhaust fan 1750, but also the drum motor 1800 and the blower fan 1820 are installed at the outside of the connection duct 1230 of the second space II. The blower fan 1820 and the exhaust fan 1750 are installed at the outside of the connection duct 1230 to prevent dew condensation by circulating and discharging humid air leaked into the second space II from the connection duct 1230 or drum 1030.

The air volume and size of the exhaust fan 1750 are closely related to the size of the drum 1030. In particular, it should be considered that one of the important functions of the clothes treatment apparatus 1000 is to dry an object to be treated such as clothes using hot air. This is because if exhaust performance of the exhaust fan 1750 is too strong, a temperature in the cabinet 1010 may be decreased, and drying performance of the clothes treatment apparatus 1000 may be reduced. Therefore, the air volume and size of the exhaust fan 1750 should be set in a range capable of suppressing dew condensation without excessively reducing the drying performance of the clothes treatment apparatus 1000.

From this perspective, when a cross-sectional area of the drum 1030 is approximately 330,000 to 360,000 $mm^2$, an area of rotation radius (or radius of gyration) of the exhaust fan 1750 may be, preferably, set to 2,350 to 2,700 $mm^2$.

The cross-sectional area of the drum 1030 refers to an area of a circle with the circumference of the drum 1030. In order to accommodate such a large-sized drum 1030, left and right widths of the cabinet 1010 should be approximately 27 inches.

A rotation radius of the exhaust fan 1750 refers to a range of a circle whose radius is a straight line connecting the outermost part of the vane from the central rotating shaft of the exhaust fan 1750, and an area of the rotation radius refers to an area of the circle.

As for a ratio of the cross-sectional area, the ration between 1) the cross-sectional area of the drum 1030 and 2) the cross-sectional area of the rotation radius of the exhaust fan 1750 may be, preferably, 130:1 to 140:1. In addition, the air volume of the exhaust fan 1750 may be, preferably, 0.3 to 0.9 $m^3$/min. These values are in the range that can suppress dew condensation without reducing drying performance of the clothes treatment apparatus 1000 having the large-sized drum 1030 due to the exhaust fan 1750.

The blower fan 1820 and the exhaust fan 1750 are disposed at opposite sides of the drum 1030 in the up, down, left, right, front, and rear direction of the clothes treatment apparatus 1000. For example, the blower fan 1820 is located closer to the front from the center of the drum 1030, and the exhaust fan 1750 is located closer to the rear from the center of the drum 1030. The blower fan 1820 is disposed adjacent to a left side of the drum 1030, and the exhaust fan 1750 is disposed adjacent to a right side of the drum 1030. The blower fan 1820 is located close to the front of the drum 1030, and the exhaust fan 1750 is located close to the rear of the drum 1030. The opposite arrangement may also be available.

This arrangement of the blower fan 1820 and the exhaust fan 1750 may prevent dew condensation due to moist or humid air. After hot and dry air supplied to the drum 1030 absorbs moisture from an object to be treated such as clothes, it becomes hot and humid air. When the hot humid air leaks into the gap between the drum 1030 and the front supporter 1040, or the gap between the drum 1030 and the rear supporter 1050, dew condensation due to humid air may occur.

The blower fan 1820 serves to prevent dew condensation due to humid air by forming a circulation flow in the space between the cabinet 1010 and the drum 1030. The exhaust fan 1750 serves to prevent dew condensation due to moist air by exhausting the circulation flow, formed by the blower fan 1820, to the outside of the clothes treatment apparatus 1000.

The heat dissipation fan 1760 also contributes to forming a circulation flow in the space between the cabinet 1010 and the drum 1030. Similar to the exhaust fan 1750, the heat dissipation fan 1760 and the blower fan 1820 are located at opposite sides with respect to the drum 1030. For example, the blower fan 1820 is disposed below one side of the drum 1030, and the heat dissipation fan 1760 is disposed above another side of the drum 1030. The exhaust fan 1750 is located at the rear of the heat dissipation fan 1760 based on a direction in which the clothes treatment device 1000 is viewed from the front thereof. The blower fan 1820, the exhaust fan 1750, and the heat dissipation fan 1760 are installed in the space between the cabinet 1010 and the drum 1030, thereby preventing dew condensation in the space.

Hereinafter, dew condensation prevention effects according to the presence or absence of the exhaust fan 1750 will be described.

Figure 49:
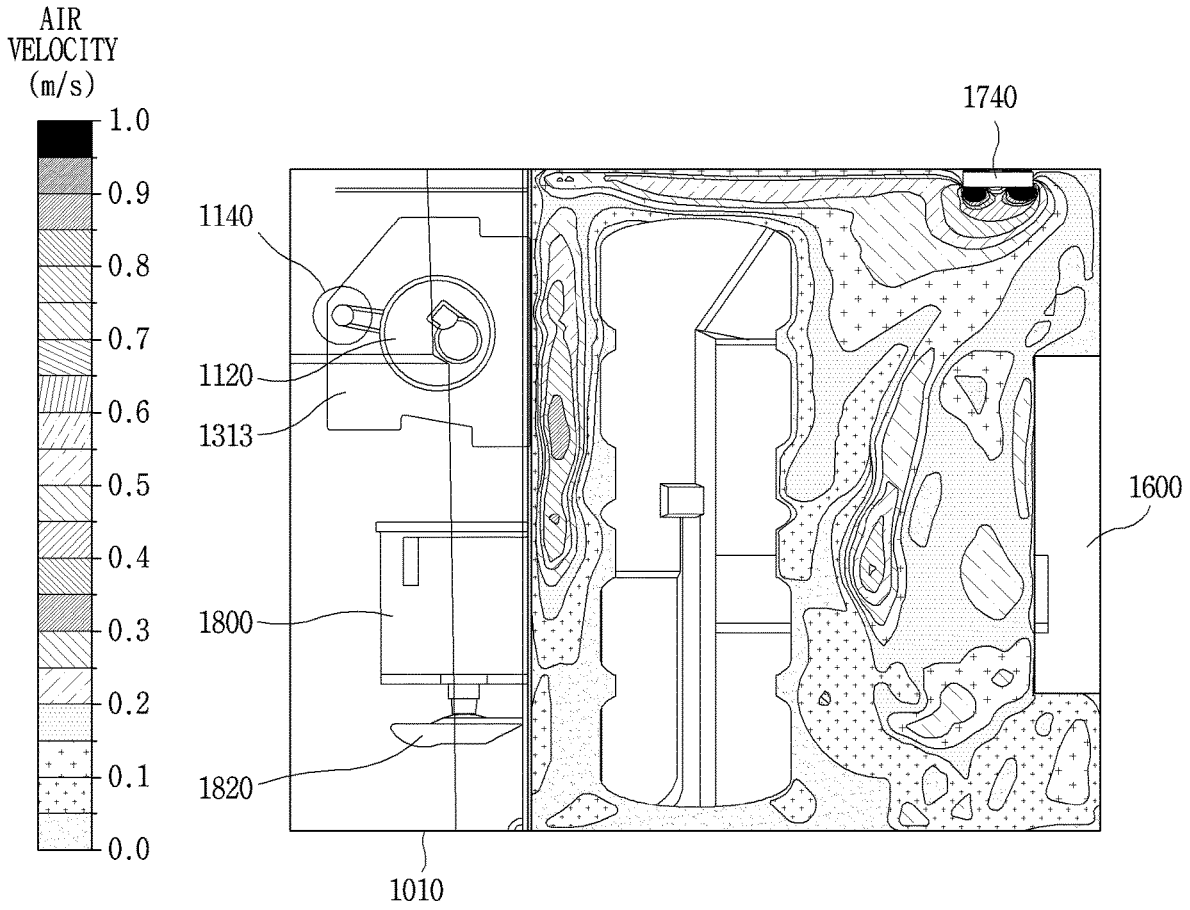
FIGS. 49 and 50 are conceptual views illustrating air velocity for each region in a cabinet according to the presence or absence of the exhaust fan.
Figure 50:
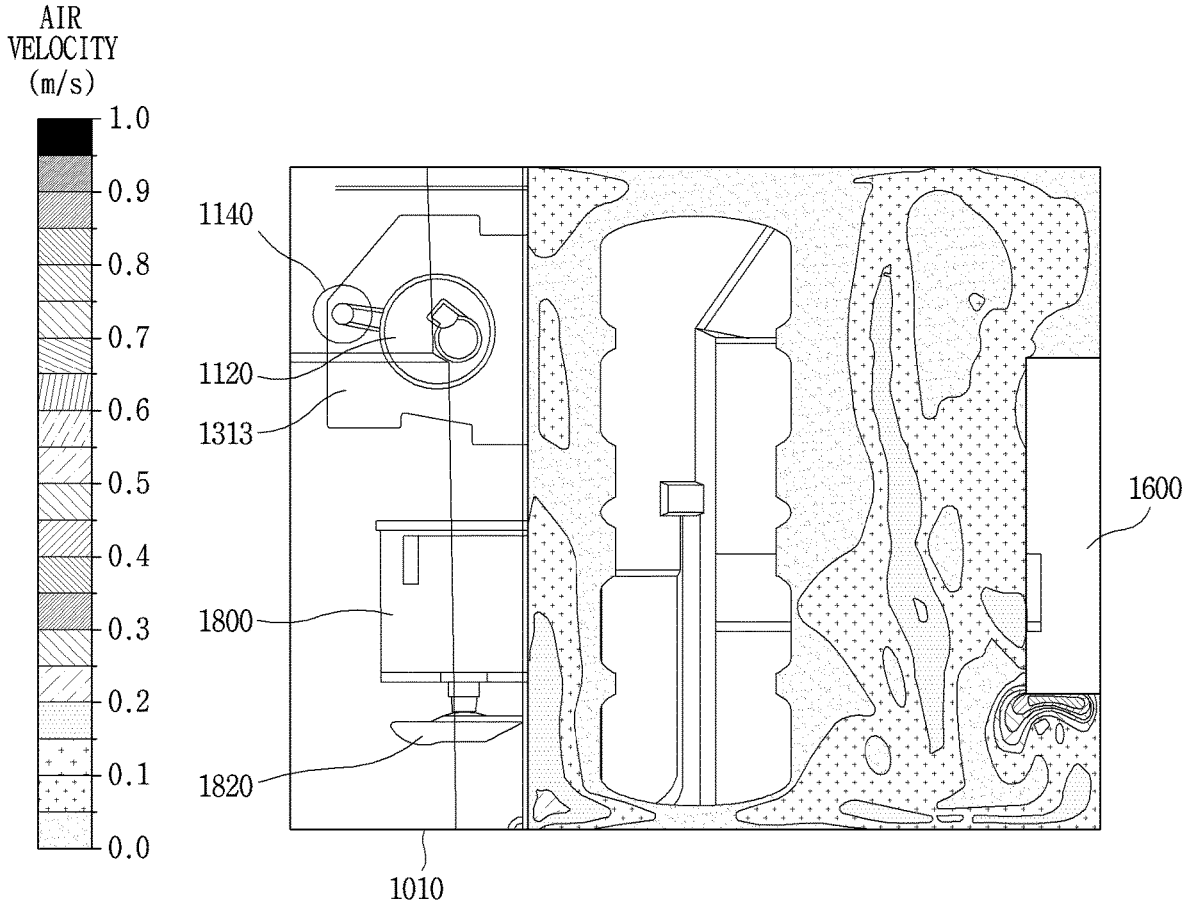

FIGS. 49 and 50 are conceptual views illustrating air velocity for each region in the cabinet according to the presence or absence of the exhaust fan 1750.

Referring to FIGS. 49 and 50, air velocity for each region (or section) measured at a position of "A-A" of FIG. 2. The exhaust fan 1750 is installed at the clothes treatment apparatus disclosed in FIG. 49, and no exhaust fan is provided at the clothes treatment apparatus disclosed in FIG. 50.

In FIG. 49, it can be seen that the flow of air is very active in the space between the cabinet and the drum. In particular, the air velocity is the fastest in the region where the exhaust fan 1750 is installed. In can be seen from the results of FIG. 49, the active flow of air allows humid or moist air to be discharged without being stagnated in the space between the cabinet and the drum.

In FIG. 50, it can be seen that the flow of air is relatively stagnant in the space between the cabinet and the drum. In particular, since there is little change in air velocity among regions, humid or moist air is stagnant.

It can be inferred from the comparison of FIGS. 49 and 50, dew condensation may be prevented by installing the exhaust fan. In FIGS. 49 and 50, unexplained reference numerals 1010, 1120, 1140, 1600, 1800, 1820 denote the cabinet, the compressor, the gas-liquid separator, the control unit constituting the printed circuit board, the drum motor, and the blower fan, respectively.

The clothes treatment apparatus described above is not limited to the configurations and the methods of the embodiments described above, but the embodiments may be configured by selectively combining all or part of the embodiments so that various modifications or changes can be made.

INDUSTRIAL AVAILABILITY

The present disclosure may be used in industries related to clothes treatment apparatus.

What is claimed is:

1. A clothes processing apparatus, comprising:

a drum configured to receive clothes therein, the drum defining a front opening and a rear opening;

a front supporter that supports a front side of the drum and defines a supporter opening in communication with the front opening of the drum;

a rear supporter that supports a rear side of the drum and defines vent holes in communication with the rear opening of the drum;

a base cabinet that is disposed below the drum;

a drum motor that is mounted on the base cabinet and configured to rotate drum;

a first flow path that is configured to guide air discharged from the front opening of the drum and extends downward to a front side of the base cabinet;

a second flow path that extends from the first flow path toward a rear side of the base cabinet and is configured to guide air heated therein by heat exchange;

a third flow path that connects the second flow path to the vent holes of the rear supporter and extends upward from the base cabinet;

a circulation fan accommodating portion that is opened at a rear surface of the third flow path facing the second flow path;

a circulation fan that is disposed in the circulation fan accommodating portion, wherein an inner surface of the circulation fan accommodating portion faces an outer surface of the circulation fan;

a condenser that is disposed in the base cabinet and arranged forward relative to the circulation fan accommodating portion;

a cover member that is coupled to the rear surface of the third flow path and covers the circulation fan, the cover member having a plate shape; and a drive motor that is mounted on a rear surface of the cover member and configured to rotate the circulation fan, the drive motor being provided separately from the drum motor and spaced apart from the drum motor, wherein the circulation fan accommodating portion comprises a condensate water drain path that is defined at a position lower than a center of rotation of the circulation fan and that is recessed downward from the inner surface of the circulation fan accommodating portion, the condensate water drain path extending in a front-rear direction toward the condenser, and wherein the condensate water drain path comprises:

a side groove that extends in the front-rear direction toward the condenser, and a communication hole that fluidly connects a front of the side groove with the second flow path and that is configured to guide water from the side groove to a bottom of the condenser.

2. The apparatus of claim 1, wherein the vent holes are located at an eccentric position with respect to a vertical reference line that passes through a center of the rear supporter.

3. The apparatus of claim 2, wherein the vent holes are located above a horizontal reference line that passes through the center of the rear supporter.

4. The apparatus of claim 1, wherein the circulation fan is configured to generate air flow from the second flow path toward the vent holes.

5. The apparatus of claim 4, wherein the third flow path has:

an intake port that is opened forward and faces the second flow path; and an exhaust port that is opened upward in a direction perpendicular to the intake port.

6. The apparatus of claim 5, wherein the circulation fan comprises a sirocco fan configured to laterally blow air along the second flow path.

7. The apparatus of claim 1, wherein the base cabinet defines a base flow path including parts of the first flow path, the second flow path, and the third flow path.

8. The apparatus of claim 7, further comprising:

a rear cover that is disposed at a rear side of the base flow path and covers an evaporator and the condenser that are mounted in the base flow path, the rear cover defining the part of the second flow path; and a front cover that covers a front side of the base flow path and defines the part of the first flow path.

9. The apparatus of claim 8, wherein the front supporter defines a communication hole at a lower periphery of the front supporter, and wherein the apparatus further comprises a front duct connector that is disposed at the front supporter and connects the communication hole of the front supporter to the base flow path.

10. The apparatus of claim 8, further comprising a rear duct connector that is disposed at the rear supporter and connects the base flow path to the vent holes.

11. The apparatus of claim 1, wherein the cover member comprises:

a cover base that has the plate shape and supports the drive motor; and a sealing portion that is bent from an outer surface of the cover base and coupled to an outer peripheral surface of the circulation fan accommodating portion.

12. A clothes processing apparatus, comprising:

a drum configured to receive clothes therein, the drum defining a front opening and a rear opening;

a circulation flow path configured to guide air discharged from the front opening of the drum to the rear opening of the drum;

a base cabinet that is disposed below the drum and defines a base flow path corresponding to a part of the circulation flow path, the base flow path extending rearward from an eccentric position at one side with respect to a center of the base cabinet;

a drum motor that is mounted on the base cabinet and configured to rotate drum;

a circulation fan configured to cause an air inside the drum to move to the base flow path;

an evaporator that is mounted on the base flow path and configured to cool the air;

a condenser that is mounted on the base flow path and configured to heat the air that has passed through the evaporator;

a circulation fan accommodating portion that is opened at a rear surface of the base flow path and configured to accommodate the circulation fan, wherein an inner surface of the circulation fan accommodating portion faces an outer surface of the circulation fan;

a cover member that is coupled to the rear surface of the base flow path and covers the circulation fan; and a drive motor that is mounted on the cover member and configured to rotate circulation fan, the drive motor being provided separately from the drum motor and spaced apart from the drum motor, wherein the condenser is arranged rearward relative to the evaporator, and the circulation fan is arranged rearward relative to the condenser, wherein the base flow path extends from the base cabinet in a front-rear direction, wherein the circulation fan accommodating portion comprises a condensate water drain path that is defined at a position lower than a center of rotation of the circulation fan and that is recessed downward from the inner surface of the circulation fan accommodating portion, the condensate water drain path extending in the front-rear direction toward the condenser, and wherein the condensate water drain path comprises:

a side groove that extends in the front-rear direction toward the condenser, and a communication hole that fluidly connects a front of the side groove with a space accommodating the condenser and that is configured to guide water from the side groove to a bottom of the condenser.

13. The apparatus of claim 12, wherein the circulation fan comprises a rotating shaft that extends in the front-rear direction toward the condenser and the evaporator, and wherein the circulation fan comprises a sirocco fan configured to laterally blow air from a front side of the base flow path to a rear side of the base flow path.

14. The apparatus of claim 12, wherein the base flow path extends from the eccentric position along a widthwise direction passing through the center of the base cabinet.

15. The apparatus of claim 14, further comprising:

a rear base cover that covers a rear portion of the base flow path and is disposed above the evaporator and the condenser; and a front base cover that covers a front portion of the base flow path, the front base cover defining an opening that is opened upward and in communication with the base flow path.

16. The apparatus of claim 15, further comprising a front duct connector that extends downward from the front opening of the drum to the opening of the front base cover and is configured to guide air discharged from the front opening of the drum to the base flow path.

17. The apparatus of claim 16, wherein the front duct connector comprises a filter guide configured to receive one or more filters.

18. The apparatus of claim 12, wherein the circulation flow path is configured to guide air exchanged heat with the evaporator and the condenser.

19. The apparatus of claim 12, further comprising:

an inlet duct disposed forward relative to the base cabinet and connected to the front opening of the drum; and an outlet duct disposed rearward relative to the base cabinet and connected to the rear opening of the drum, wherein the inlet duct, the base cabinet, and the outlet duct define portions of the circulation flow path.

20. The apparatus of claim 12, wherein the base cabinet defines an upper opening, and wherein the apparatus further comprises a base cover that is disposed above the evaporator and the condenser and covers at least a portion of the opening, the base cover defining the base flow path with the base cabinet.

21. The apparatus of claim 20, further comprising an inlet duct that is disposed forward relative to the base cabinet and connects the front opening of the drum to another portion of the upper opening.

* * * * *